US012013144B2

(12) United States Patent
Yu et al.

(10) Patent No.: US 12,013,144 B2
(45) Date of Patent: Jun. 18, 2024

(54) MOUNTING BRACKET FOR WINDOW AIR CONDITIONER AND WINDOW AIR CONDITIONER ASSEMBLY

(71) Applicants: GD MIDEA AIR-CONDITIONING EQUIPMENT CO., LTD., Foshan (CN); MIDEA GROUP CO., LTD., Foshan (CN)

(72) Inventors: Hui Yu, Foshan (CN); Jianping Meng, Foshan (CN); Zhigang Xing, Foshan (CN); Ali Zhao, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 86 days.

(21) Appl. No.: 17/785,521

(22) PCT Filed: Dec. 9, 2020

(86) PCT No.: PCT/CN2020/134963
§ 371 (c)(1),
(2) Date: Jun. 15, 2022

(87) PCT Pub. No.: WO2021/121101
PCT Pub. Date: Jun. 24, 2021

(65) Prior Publication Data

US 2023/0026722 A1 Jan. 26, 2023

(30) Foreign Application Priority Data

Dec. 17, 2019 (CN) ..... 201911303245
Dec. 17, 2019 (CN) ..... 201922273159.1
(Continued)

(51) Int. Cl.
*F24F 13/32* (2006.01)
*F24F 1/031* (2019.01)

(52) U.S. Cl.
CPC ..... *F24F 13/32* (2013.01); *F24F 1/031* (2019.02)

(58) Field of Classification Search
CPC ..... F24F 13/32; F24F 1/031
(Continued)

(56) References Cited

U.S. PATENT DOCUMENTS 8,091,844 B1 * 1/2012 Bragg ..... F24F 13/32 248/220.21
8,584,998 B1 * 11/2013 Peterson ..... F24F 13/32 182/62
(Continued)

FOREIGN PATENT DOCUMENTS

CN 2112114 U 8/1992
CN 201476251 U 5/2010
(Continued)

OTHER PUBLICATIONS

World Intellectual Property Organization (WIPO) International Search Report for PCT/CN2020/134963 Mar. 1, 2021 8 Pages (with translation).

*Primary Examiner* — Muhammad Ijaz
(74) *Attorney, Agent, or Firm* — Anova Law Group, PLLC

(57) ABSTRACT

A mounting bracket includes a support frame extending in an inside-outside direction and including an outdoor part configured to be arranged outdoors, and a support leg configured to be arranged outdoors. An upper end of the support leg is connected to the outdoor part of the support frame and a lower end of the support leg is configured to directly or indirectly abut against an outer wall surface of a wall body. The outdoor part of the support frame includes a
(Continued)

first limiting structure. The support leg includes a second limiting structure provided at the upper end of the support leg. The second limiting structure is in a limiting fit with the first limiting structure to limit a maximum included angle between the support leg and the support frame facing towards an indoor side so as to prevent a rotation angle of the support leg relative to the support frame in a direction facing away from the wall body from exceeding the maximum included angle.

23 Claims, 26 Drawing Sheets

(30) Foreign Application Priority Data

| | | |
|---|---|---|
| Dec. 17, 2019 | (CN) | 201922273412.3 |
| Dec. 17, 2019 | (CN) | 201922273415.7 |
| Dec. 17, 2019 | (CN) | 201922286733.7 |
| Dec. 17, 2019 | (CN) | 201922294065.2 |

(58) Field of Classification Search
USPC ..... 248/208, 200; 16/357, 362, 360
See application file for complete search history.

(56) References Cited

U.S. PATENT DOCUMENTS

| | | | | |
|---|---|---|---|---|
| 9,163,854 | B2 * | 10/2015 | Arbucci | E04B 1/388 |
| 11,168,920 | B1 * | 11/2021 | Leezer | F24F 1/027 |
| 11,339,993 | B2 * | 5/2022 | Zhao | F24F 13/32 |
| 2015/0097096 | A1 * | 4/2015 | Arbucci | E04G 3/18 52/741.1 |
| 2019/0056143 | A1 * | 2/2019 | Zhang | F24F 13/32 |

FOREIGN PATENT DOCUMENTS

| | | | |
|---|---|---|---|
| CN | 204880450 | U | 12/2015 |
| CN | 207247398 | U | 4/2018 |
| CN | 207365244 | U | 5/2018 |
| CN | 208075296 | U | 11/2018 |
| CN | 208671324 | U | 3/2019 |
| CN | 208804781 | U | 4/2019 |
| CN | 110966687 | A | 4/2020 |
| CN | 211345568 | U | 8/2020 |
| CN | 211345569 | U | 8/2020 |
| CN | 211345570 | U | 8/2020 |
| CN | 211345798 | U | 8/2020 |
| CN | 211575506 | U | 9/2020 |
| EP | 0553880 | A2 | 8/1993 |
| KR | 20030080778 | A | 10/2003 |

* cited by examiner

Backward ← → Forward

MOUNTING BRACKET FOR WINDOW AIR CONDITIONER AND WINDOW AIR CONDITIONER ASSEMBLY

CROSS-REFERENCE TO RELATED APPLICATIONS

The present application is a National Stage Entry under 35 U.S.C. § 371 of International Application No. PCT/CN2020/134963, filed on Dec. 9, 2020, which is submitted based on and claims priority to Chinese Patent Application No. 201922286733.7 filed on Dec. 17, 2019, Chinese Patent Application No. 201922273415.7 filed on Dec. 17, 2019, Chinese Patent Application No. 201922273412.3 filed on Dec. 17, 2019, Chinese Patent Application No. 201922273159.1, Chinese Patent Application No. 201911303245.0 filed on Dec. 17, 2019, and Chinese Patent Application No. 201922294065.2 filed on Dec. 17, 2019, the entire contents of all of which are incorporated herein by reference.

TECHNICAL FIELD

The present disclosure relates to the field of air conditioning equipment technologies, and more particularly, to a mounting bracket for a window air conditioner and a window air conditioner assembly.

BACKGROUND

A mounting bracket mounted at a wall body can be used to support a window air conditioner, etc., so as to realize mounting of a window air conditioner, etc. In the related art, the mounting bracket has poor stability and is complicated to mount. In addition, an operator is easy to be scratched by members of the mounting bracket during operation, resulting in loosening of the mounting bracket, injuries to the operator, or the like.

SUMMARY

The present disclosure aims to solve at least one of the technical problems in the related art. To this end, the present disclosure provides a mounting bracket for a window air conditioner. The mounting bracket has a stable and reliable structure and is convenient to mount.

The present disclosure also provides a window air conditioner assembly having the mounting bracket.

In a first aspect of the present disclosure, a mounting bracket for a window air conditioner is provided. The mounting bracket is adapted to be mounted at a window opening in a wall body, and the window air conditioner is adapted to be arranged at the mounting bracket. The mounting bracket includes: a plurality of support units that are spaced apart from each other in a transverse direction, each of the plurality of support units including a support frame extending in an inside-outside direction and being adapted to be at least partially arranged outdoors, the support frame having a first connection part at an outdoor end part thereof, the first connection part extending in a vertical direction; and a connection unit adapted to be arranged outdoors and connected to each of the plurality of support units, the connection unit including a connection rod extending in the transverse direction and a plurality of second connection parts arranged at the connection rod, the plurality of second connection parts being spaced apart from each other to be connected to the plurality of first connection parts in a one-to-one correspondence. Each of the plurality of second connection parts includes a mounting structure adapted to be fixedly connected to the first connection part by a connection member and a shielding structure connected to the mounting structure and adapted to at least shield an upper side and/or both transverse sides of the connection member.

In the mounting bracket for the window air conditioner according to embodiments of the present disclosure, by arranging the shielding structure adapted to at least shield the upper side and/or both transverse sides of the connection member, the connection member can be protected, which prevents scratching from being easily generated between the connection member and an operator during an operation, facilitates the operation and improves the assembly and mounting efficiency. Further, it is possible to assist in ensuring structural stability of the mounting bracket. In addition, to a certain extent, the shielding structure can provide shielding rainwater function. Also, the mounting bracket has a simple structure and reliable support, which facilitates mounting and fixing of the window air conditioner, and ensures mounting stability of the window air conditioner, thereby preventing the window air conditioner from easily falling from the window opening and fascinating safe use of the window air conditioner.

In some embodiments, the shielding structure includes a first visor plate located above the first connection part, and/or two second visor plates located at two transverse sides of the first connection part, respectively.

In some embodiments, the mounting structure includes a mounting plate extending in the vertical direction. The mounting plate is located at a side of the first connection part close to an indoor space and adapted to be fixedly connected to the first connection part by the connection member.

In some embodiments, the shielding structure includes: a first visor plate connected to an upper edge of the mounting plate and located above the first connection part; and two second visor plates connected to edges on two transverse sides of the mounting plate respectively, the two second visor plates being located at two transverse sides of the first connection part, respectively.

In some embodiments, the first connection part extends upwardly from the outdoor end part of the support frame, and the second connection part is located above the support frame. The connection rod is located at a side of the second connection part close to the indoor space.

In some embodiments, the connection rod includes: a top plate supported at the plurality of support frames; two side plates connected below the top plate and located at two transverse sides of the plurality of support units respectively; and at least two reinforcement plates located between two adjacent support frames.

In some embodiments, the support frame is adapted to pass through the window opening and a part of the support frame is adapted to be arranged indoors. The mounting bracket further includes a positioning unit adapted to be arranged indoors and connected to the part of the support frame located indoors. The positioning unit is adapted to be in a positioning fit with the window opening and/or a window frame.

In some embodiments, the positioning unit includes a main frame extending in the transverse direction. The support frame is supported above the main frame and includes a support plate and a flange part extending downwardly from each of both transverse sides of the support plate. The support plate has a recess formed in an indoor end part thereof. The recess is recessed downwardly and has a bottom wall supported at an upper surface of the main frame. The recess is adapted to be fixedly connected to the main frame by the connection member.

In some embodiments, each of the plurality of support units further includes a support leg adapted to be arranged outdoors. The support leg has an upper end connected to the part of the support frame located outdoors and a lower end directly or indirectly abutting against an outer wall surface of the wall body.

In some embodiments, each of the plurality of support units is adapted to pass through the window opening in the inside-outside direction, and the at least a part of each of the plurality of support units located outdoors is adapted to abut against the outer wall surface of the wall body. The mounting bracket further includes a positioning unit adapted to be arranged indoors and connected to a part of each of the plurality of support units located indoors. The positioning unit is adapted to be in a positioning fit with the window opening and/or the window frame and includes a main frame and a plurality of sub-frames. Each of the main frame and the plurality of sub-frames extend in the transverse direction, and each of the plurality of sub-frames are capable of cooperating with the main frame in a withdrawable manner in the transverse direction in such a manner that the positioning unit has an adjustable transverse length. The plurality of sub-frames are configured to cooperate with the main frame in a replaceable manner, and at least two of the plurality of sub-frames have different transverse lengths.

In some embodiments, each of the plurality of sub-frames includes a frame rod extending in the transverse direction and a stop rod extending in the vertical direction. The stop rod is arranged at a transverse end of the frame rod.

In some embodiments, the stop rod includes two stop plates that extend in the transverse direction and are spaced apart from each other in the inside-outside direction and a connection plate extending in the inside-outside direction and connected to the two stop plates.

In some embodiments, the connection plate has a first connection hole formed therein. The first connection hole extends in the transverse direction. The frame rod has a plurality of second connection holes extending in the vertical direction and/or a plurality of third connection holes extending in the inside-outside direction. The plurality of second connection holes are spaced apart from each other in the transverse direction, and the plurality of third holes are spaced apart from each other in the transverse direction.

In some embodiments, the main frame has a sliding groove formed therein. The sliding groove extends in the transverse direction and is opened at both transverse ends thereof. The frame rod is introduced into the sliding groove and the frame rod is withdrawable relative to the main frame in the transverse direction, and the stop rod is stopped outside the sliding groove.

In some embodiments, the main frame includes a main body segment having an open bottom surface and two end segments that each have a closed bottom surface and are located at two transverse ends of the main body segment respectively.

In some embodiments, any cross section of the main frame is ⊏-shaped. The main frame has a plurality of first positioning holes formed in an indoor side wall surface thereof. The plurality of first positioning holes are spaced apart from each other in the transverse direction. The frame rod has a second positioning hole formed in each of an indoor side wall surface and an outdoor side wall surface thereof. The second positioning hole is adapted to be fixedly connected to any one of the plurality of first positioning holes by the connection member.

In some embodiments, the plurality of sub-frames at least include a first sub-frame and a second sub-frame, and a total transverse length of a frame rod of the first sub-frame and a frame rod of the second sub-frame is equal to a transverse length of the main frame.

In some embodiments, a plurality of support units spaced apart from each other is provided. Each of the plurality of support units includes a support frame and a support leg. The support frame extends in the inside-outside direction and is adapted to pass through the window opening in such a manner that one part of the support frame is arranged indoors and the other part of the support frame is arranged outdoors. The support leg is adapted to be arranged outdoors, and the support leg has an upper end connected to the part of the support frame located outdoors and a lower end directly or indirectly abutting against the outer wall surface of the wall body. The part of the support frame located indoors is connected to the main frame.

In some embodiments, each of the plurality of support units includes: a support frame extending in the inside-outside direction and adapted to be at least partially arranged outdoors; and a support leg adapted to be arranged outdoors, the support leg having an upper end connected to the part of the support frame located outdoors and a lower end directly or indirectly abutting against the outer wall surface of the wall body. The part of the support frame located outdoors has a first limiting structure, and the support leg has a second limiting structure provided at the upper end thereof. The second limiting structure is in a limiting fit with the first limiting structure to limit a maximum included angle between the support leg and the support frame facing towards an indoor side so as to prevent a rotation angle of the support leg relative to the support frame in a direction facing away from the wall body from exceeding the maximum included angle.

In some embodiments, the support frame has two limiting grooves that are spaced apart from each other in the transverse direction. Each of the two limiting grooves extends in the inside-outside direction. Each of the two limiting grooves has an opening on one transverse side thereof and a side wall on the other transverse side thereof, and each of the two limiting groove is capable of serving as the first limiting structure. The second limiting structure is assembled in the limiting groove through the opening, and includes an upper limiting member abutting against a top wall of the limiting groove and a lower limiting member abutting against a bottom wall of the limiting groove.

In some embodiments, the support leg includes two leg side plates that are spaced apart from each other in the transverse direction. The lower limiting member is arranged at an upper end of each of the two leg side plates and located at a side of the leg side plate close to the indoor space.

In some embodiments, the lower limiting member extends towards the side wall of the limiting groove in the transverse direction.

In some embodiments, the upper limiting member includes a support surface and a first extension member. The support surface is a top surface of the leg side plate, and the first extension member extends from the upper end of the leg side plate towards the side of the leg side plate close to the indoor space.

In some embodiments, the leg side plate has a fourth connection hole formed in the upper end thereof, and the limiting groove has a plurality of fifth connection holes formed in the side wall thereof. The plurality of fifth connection holes are spaced apart from each other in the inside-outside direction, and the fourth connection hole is adapted to be fixedly connected to any one of the plurality of fifth connection holes by the connection member.

In some embodiments, the support frame includes: a support plate extending in the inside-outside direction and adapted to be supported at a bottom of the window air conditioner; and two mounting plates connected at positions below both transverse sides of the support plate, respectively. Each of the two mounting plates has a flange provided at a lower end thereof. The flange is ben towards the other mounting plate. The limiting groove is formed among the flange, the mounting plate, and the support plate. The support plate is formed as the top wall of the limiting groove, the mounting plate is formed as the side wall of the limiting groove, and the flange is formed as the bottom wall of the limiting groove.

In some embodiments, each of the plurality of support units further includes a support foot connected to the lower end of the support leg, the support foot being adapted to be arranged outdoors to abut against the outer wall surface of the wall body; and the support leg has a second extension member provided at the lower end thereof, the second extension member being adapted to abut against a side of the support foot facing away from the outer wall surface of the wall body.

In some embodiments, each of the plurality of support units further includes: a support frame extending in the inside-outside direction and adapted to be at least partially arranged outdoors; a support leg adapted to be arranged outdoors and connected to the part of the support frame located outdoors at an upper end thereof; and a support foot adapted to be arranged outdoors and connected to a lower end of the support leg. The support foot includes a body mounted at the support leg and a cladding wrapping around the body. The support foot is adapted to abut against the outer wall surface of the wall body with the cladding. The body is in a positioning fit with the cladding by a positioning structure including a positioning hole and a positioning protrusion engaged with the positioning hole.

In some embodiments, the body has one or more connection holes formed therein, and the connection member is adapted to pass through the connection holes and the cladding to be fixed at the outer wall surface of the wall body.

In some embodiments, the body includes a panel member, and two side plate members located at two transverse sides of the panel member. Each of the side plate members is connected to the support leg. the cladding includes: an end surface part covering one side of the panel member in a thickness direction of the panel member; an upper flange part connected to a longitudinal upper end of the end surface part and bent towards the other side of the panel member in the thickness direction of the panel member; and a lower flange part connected to a longitudinal lower end of the end surface part and bent towards the other side of the panel member in the thickness direction of the panel member.

In some embodiments, the cladding has a plurality of slots on a surface of the cladding facing away from the body. The plurality of slots are spaced apart from each other in an upward-downward direction.

In some embodiments, the mounting bracket for the window air conditioner further includes: two support units that are spaced apart from each other in the transverse direction. The support frame is adapted to pass through the window opening in such a manner that a part of the support frame is arranged indoors; and a positioning unit adapted to be arranged indoors and connected to the part of the support frame located indoors. The positioning unit is adapted to be in a positioning fit with the window opening and/or the window frame.

In a second aspect of embodiments of the present disclosure, there is provided a window air conditioner assembly. The window air conditioner assembly includes a window air conditioner, and the mounting bracket for the window air conditioner according to the first aspect of the present disclosure. The mounting bracket is adapted to be mounted at the window opening in the wall body, and the window air conditioner is arranged at the mounting bracket.

In some embodiments, the window air conditioner assembly further includes a connection assembly adapted to connect the mounting bracket and the window air conditioner.

In some embodiments, the connection assembly has a bottom support part provided at a lower end thereof. The bottom support part is configured to be supported at a windowsill.

In some embodiments, the connection assembly is configured such that a relative height between the bottom support part and a bottom surface of the window air conditioner is adjustable.

In some embodiments, the connection assembly includes a third connection part configured to be connected to the window air conditioner and a fourth connection part configured to be connected to the mounting bracket. The connection assembly is configured such that a relative distance between the third connection part and the fourth connection part in a direction from an indoor space to an outdoor space is adjustable.

In some embodiments, the connection assembly includes a first connection member adapted to be connected to the window air conditioner, a second connection member adapted to be connected to the mounting bracket, and a third connection member configured to connect the first connection member and the second connection member. The first connection member has a first elongated hole formed therein. The first elongated hole extends in the upward-downward direction and is adapted to be connected to the window air conditioner by a first fastening member. The third connection member is connected to the second connection member through the first elongated hole, and the first connection member has a bottom surface configured to be supported at the windowsill. Alternatively, or additionally, the second connection member has a second elongated hole formed therein and an outer end configured to be connected to the mounting bracket, and the second elongated hole extends in the inside-outside direction. The third connection member is connected to the first connection member through the second elongated hole.

In some embodiments, when the first elongated hole extending in the upward-downward direction is formed in the first connection member, the first connection member includes a first plate member extending in the upward-downward direction and a bottom support plate member connected to a lower part of the first plate member. The first elongated hole is formed in the first plate member, and each of a bottom surface of the first plate member and a bottom surface of the bottom support plate member are configured to be supported at the windowsill.

In some embodiments, the bottom support plate member includes a second plate member extending in the inside-outside direction and connected to an indoor side and/or an outdoor side of the first plate member.

In some embodiments, the bottom support plate member further includes a third plate member extending from an end of the second plate member facing away from the first plate member in the transverse direction.

In some embodiments, the third plate member has a third elongated hole formed therein. The third elongated hole extends in the transverse direction.

In some embodiments, when second elongated hole extending in the inside-outside direction is formed in the second connection member, the second connection member includes a fourth plate member extending in the inside-outside direction and a fifth plate member connected to an outer end of the fourth plate member and extending in the transverse direction. The second elongated hole is formed in the fourth plate member, and the fifth plate member is configured to be connected to the mounting bracket.

In some embodiments, the fifth plate member has a fourth elongated hole formed therein. The fourth elongated hole extends in the transverse direction and is adapted to be connected to the mounting bracket by a second fastening member.

In some embodiments, the connection assembly is adapted to be arranged indoors.

In some embodiments, the window air conditioner assembly further includes a connection assembly adapted to be at least connected to the window air conditioner. The connection assembly has a bottom support part provided at a lower end thereof. The bottom support part being supported at the windowsill.

In some embodiments, the connection assembly is configured such that a relative height between the bottom support part and a bottom surface of the window air conditioner is adjustable.

In some embodiments, the connection assembly is also connected to the mounting bracket. The connection assembly includes a third connection part connected to the window air conditioner and a fourth connection part connected to the mounting bracket. The connection assembly is configured such that a relative distance between the third connection part and the fourth connection part in the direction from the indoor space to the outdoor space is adjustable.

Additional aspects and advantages of the present disclosure will be provided at least in part in the following description, or will become apparent at least in part from the following description, or can be learned from practicing of the present disclosure.

BRIEF DESCRIPTION OF DRAWINGS

The above and/or additional aspects and advantages of the present disclosure will become more apparent and more understandable from the following description of embodiments taken in conjunction with the accompanying drawings, in which.

DESCRIPTION OF EMBODIMENTS

Figure 1:
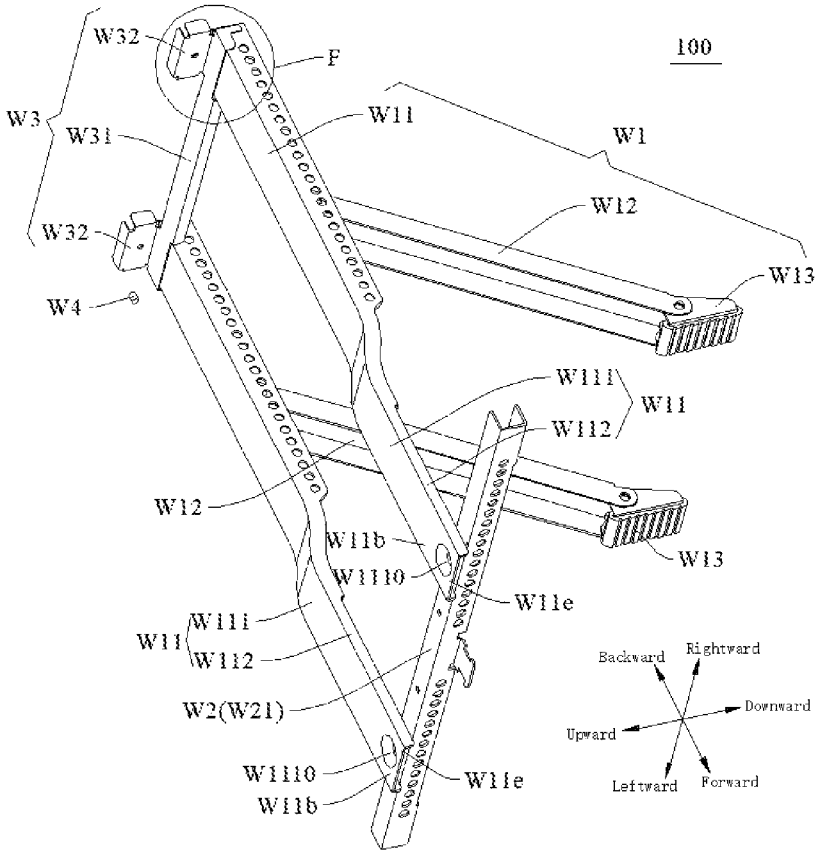
FIG. 1 is a schematic view of a mounting bracket for a window air conditioner according to an embodiment of the present disclosure.

Embodiments of the present disclosure are described below in detail, examples of the embodiments are shown in accompanying drawings, and throughout the description, the same or similar reference signs represent the same or similar components or the components having the same or similar functions. The embodiments described below with reference to the accompanying drawings are exemplary and intended to explain the present disclosure, rather than being construed as limitation on the present disclosure.

Various embodiments or examples for implementing different structures of the present disclosure are provided below. In order to simplify the description of the present disclosure, components and arrangements of specific examples are described herein. Of course, these specific examples are merely for the purpose of illustration, and they are not intended to limit the present disclosure. Furthermore, the same reference numerals and/or reference letters may appear in different examples of the present disclosure for the purpose of simplicity and clarity, instead of indicating a relationship between different discussed embodiments and/or arrangements. In addition, the present disclosure provides examples of various specific processes and materials. However, applicability of other processes and/or the use of other materials are conceivable for those skilled in the art.

A mounting bracket 100 for a window air conditioner 200 according to embodiments in a first aspect of the present disclosure will be described below with reference to FIG. 1 to FIG. 10.

Figure 39:
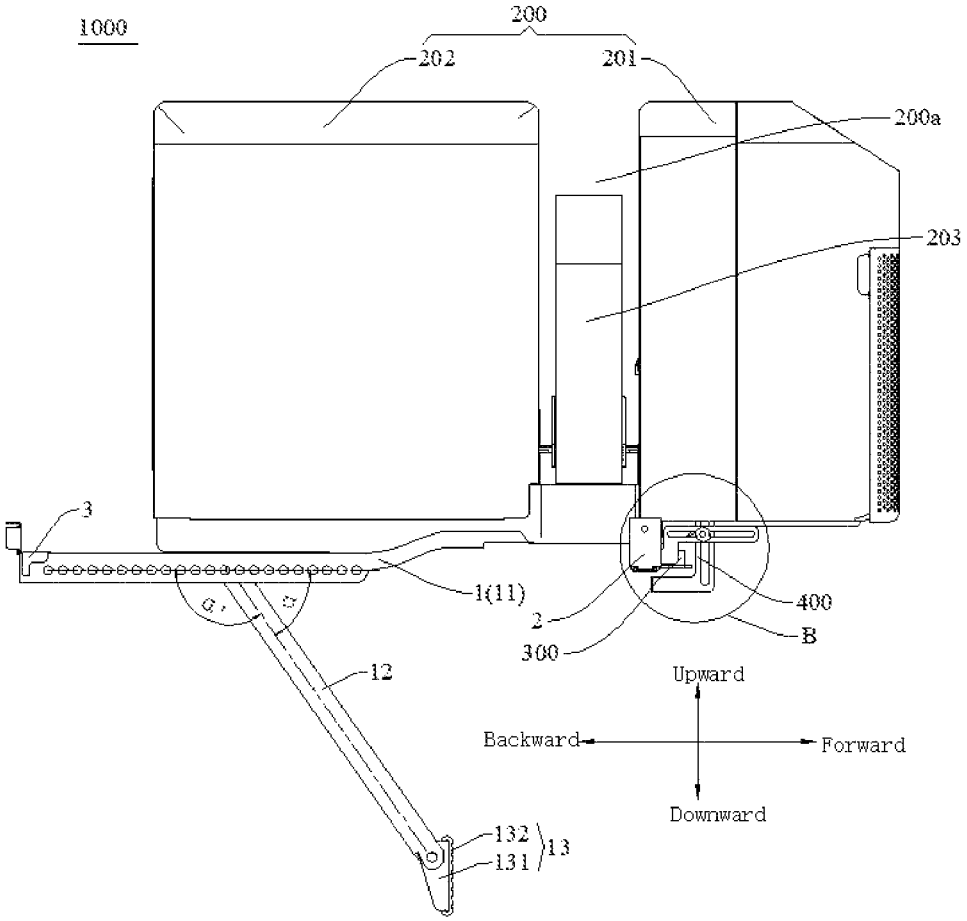
FIG. 39 is another schematic view of the window air conditioner assembly illustrated in FIG. 37.
Figure 41:
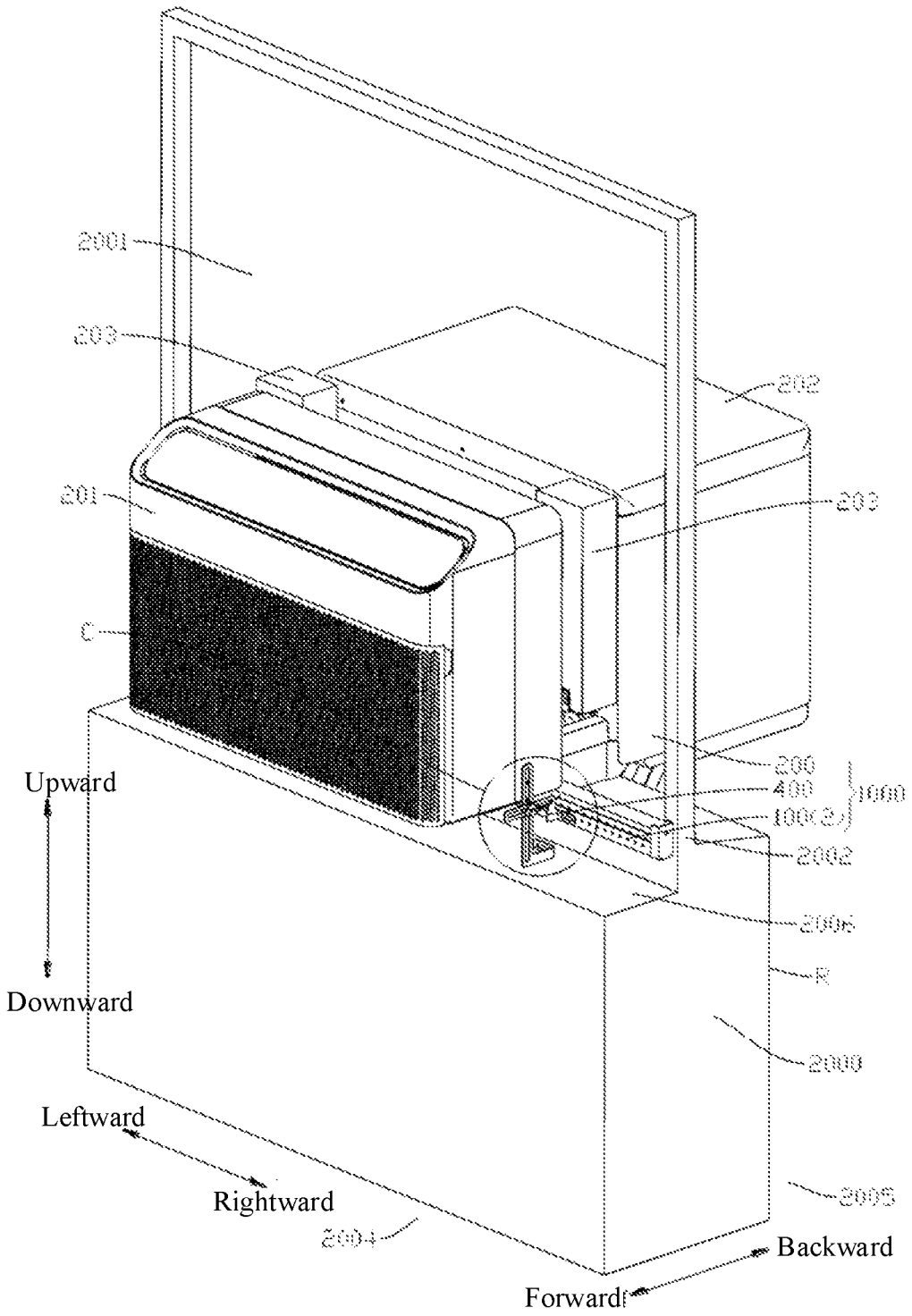
FIG. 41 is a schematic mounting view of a window air conditioner assembly according to an embodiment of the present disclosure.
Figure 43:
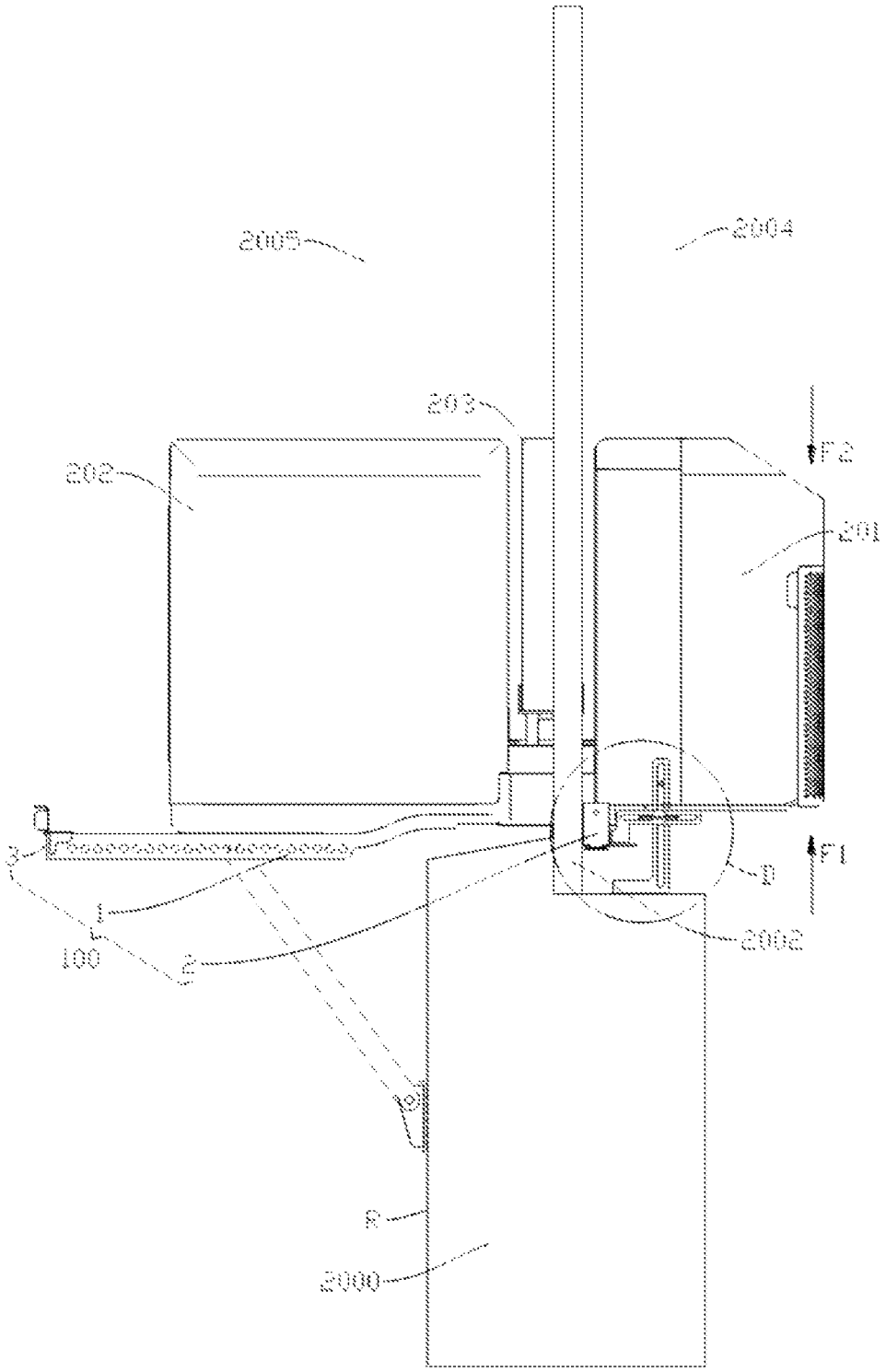
FIG. 43 is another schematic mounting view of the window air conditioner assembly illustrated in FIG. 41.

As illustrated in FIG. 1, and with reference to FIG. 39, FIG. 41, and FIG. 43, the mounting bracket 100 is adapted to be mounted at a window opening 2001 in a wall body 2000, and the window air conditioner 200 is adapted to be arranged at the mounting bracket 100. The window air conditioner 200 may be mounted at the window opening 2001 by the mounting bracket 100. The mounting bracket 100 may be mounted at the wall body 2000 for fixing and supporting the window air conditioner 200 mounted at the window opening 2001.

As illustrated in FIG. 1, the mounting bracket 100 includes a plurality of support units W1 that are spaced apart from each other in a transverse direction (for example, in a leftward-rightward direction in FIG. 1). Each support unit W1 is configured to fix and support the window air conditioner 200. Such a configuration is conducive to ensuring structural strength and stability of the mounting bracket 100 and provides sufficient support strength to the window air conditioner 200 by the mounting bracket 100. Each support unit W1 includes a support frame W11 extending in an inside-outside direction (for example, a forward-backward direction in FIG. 1) and adapted to be at least partially arranged outdoors. Therefore, a part of the support frame W11 is adapted to be arranged outdoors, or the entire support frame is adapted to be arranged outdoors. That is, the support frame W11 at least includes a first part W11*a* adapted to be arranged outdoors.

It should be understood that the plurality of support units W1 may have a same structure or different structures.

As illustrated in FIG. 1, the mounting bracket 100 also includes a connection unit W3 adapted to be arranged outdoors. The connection unit W3 is connected to the plurality of support units W1, respectively. That is, each support unit W1 is connected to the connection unit W3. For example, connecting the connection unit W3 to the first part W11*a* of the support frame W11 of each of the plurality of support units W1 is conducive to further improving support stability of the mounting bracket 100.

Figure 2:
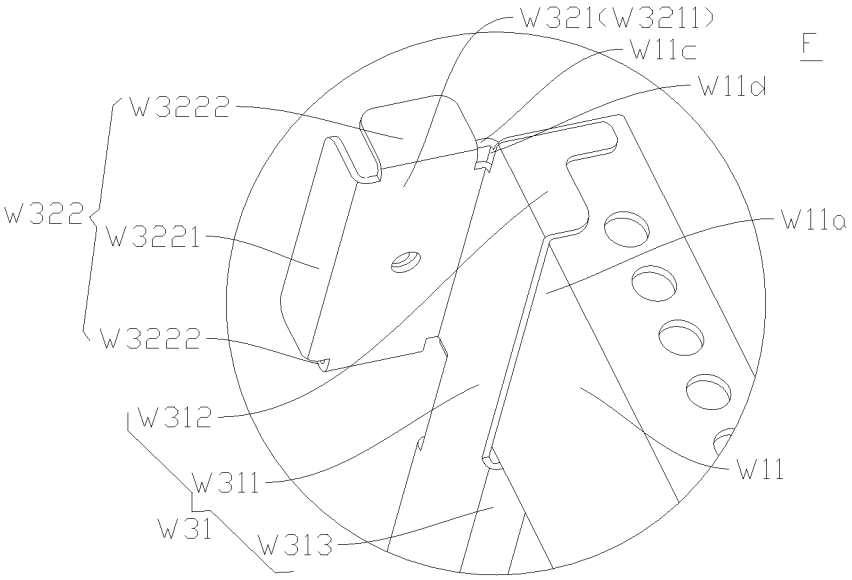
FIG. 2 is an enlarged view of part F circled in FIG. 1.
Figure 3:
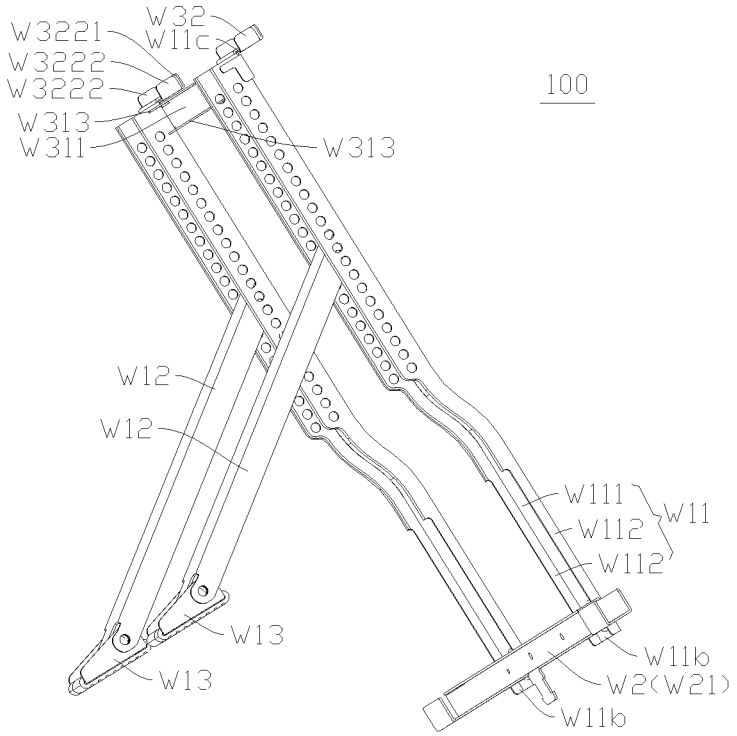
FIG. 3 is another schematic view of the mounting bracket illustrated in FIG. 1.

As illustrated in FIG. 2, the support frame W11 has at an outdoor end part W11*d* thereof a first connection part W11*c* extending in a vertical direction, the mounting bracket 100 therefore has a plurality of first connection parts W11*c*; and the connection unit W3 includes a connection rod W31 extending in the transverse direction and a plurality of second connection parts W31 arranged at the connection rod W32, in which the plurality of second connection parts W32 are spaced apart from each other in the transverse direction to be connected to the plurality of first connection parts W11*c* in a one-to-one correspondence. Each support unit W1 is therefore connected to a corresponding one of the plurality of second connection parts W32 by the first connection part W11*c* for being connected to the connection unit W3, such that the plurality of support units W1 may be integrally connected, which is conducive to improving support reliability of the mounting bracket 100. In addition, since the first connection part W11*c* is located at the outdoor end part W11*d* of the support frame W11, the first connection part W11*c* is far away from the window opening 2001 in the inside-outside direction, thereby ensuring that enough mounting space is available to the window air conditioner 200 and the mounting bracket 100 can be used for window air conditioners 200 of different sizes.

Here, as illustrated in FIG. 2, the second connection part W32 includes a mounting structure W321 and a shielding structure W322. The mounting structure W321 is adapted to be fixedly connected to the first connection part W11*c* by a connection member W4. The shielding structure W322 is connected to the mounting structure W321. Also, the shielding structure W322 is adapted to at least shield an upper side and/or both lateral sides of the connection member W4 to at least prevent a part of the connection member W4 from being exposed. Therefore, the connection member W4 can be protected to a certain extent. For example, the shielding structure W322 can avoid injuries to an operator or loosening of the connection member W4 caused by easy scratching with the connection member W4 during operation of the operator, facilitate the operation, improve assembly efficiency, and assist in ensuring structural stability of the mounting bracket 100. Further, to a certain extent, the shielding structure W322 can provide shielding rainwater function to prevent the connection member W4 from being susceptible to corrosion, damages, and the like caused by direct washing of the rainwater. It should be understood that when the connection member W4 is a screw, exposure of a head of the screw can be avoided.

Here, the shielding structure W322 being adapted to at least shield the upper side and/or both lateral sides of the connection member W4 may include: 1) the shielding structure W322 being adapted to at least shield the upper side of the connection member W4; 2) the shielding structure W322 being adapted to at least shield both lateral sides of the connection member W4; and 3) the shielding structure W322 being adapted to at least shield the upper side and both lateral sides of the connection member W4.

Therefore, an arrangement of the shielding structure W322 adapted to at least shield the upper side and/or both lateral sides of the connection member W4 can protect the connection member W4, thereby preventing scratching from being easily generated between the connection member W4 and an operator during an operation, facilitating the operation, and improve the assembly and mounting efficiency. Further, it is possible to assist in ensuring the structural stability of the mounting bracket 100. In addition, to a certain extent, the shielding structure W322 can provide the shielding rainwater function. Also, the mounting bracket 100 has a simple structure and reliable support, which facilitates mounting and fixing of the window air conditioner 200, and ensures mounting stability of the window air conditioner 200, thereby preventing the window air conditioner 200 from easily falling from the window opening 2001, and fascinating safe use of the window air conditioner 200.

Optionally, the connection member W4 may include, but not limited to, a screw or a bolt, etc.

Optionally, the mounting structure W321 is adapted to be detachably connected to the first connection part W11*c* by the connection member W4, such that flexibility of detaching and mounting of the mounting bracket 100 can be easy to implement. Of course, the mounting structure W321 may also be non-detachably connected to the first connection part W11*c* by the connection member W4.

Figure 6:
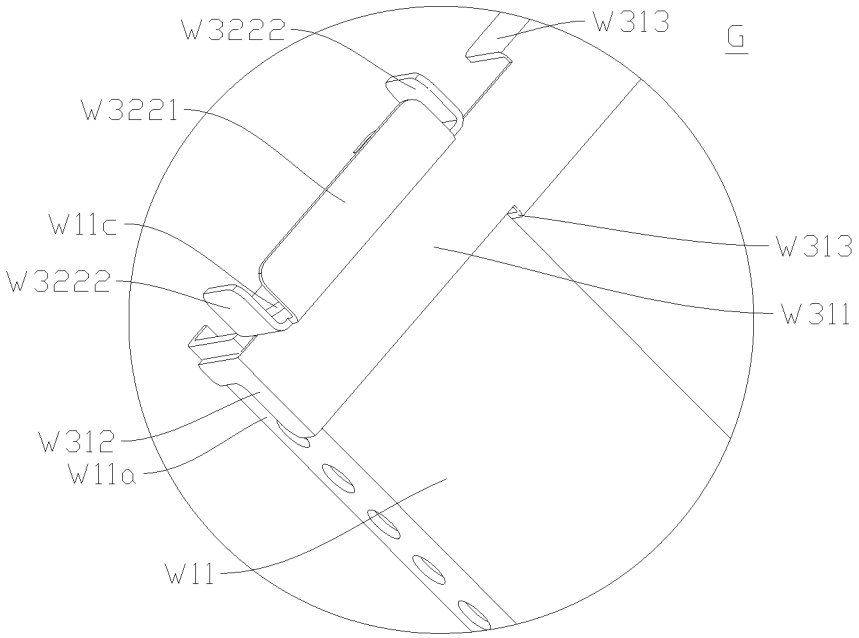
FIG. 6 is an enlarged view of part G circled in FIG. 5.
Figure 7:
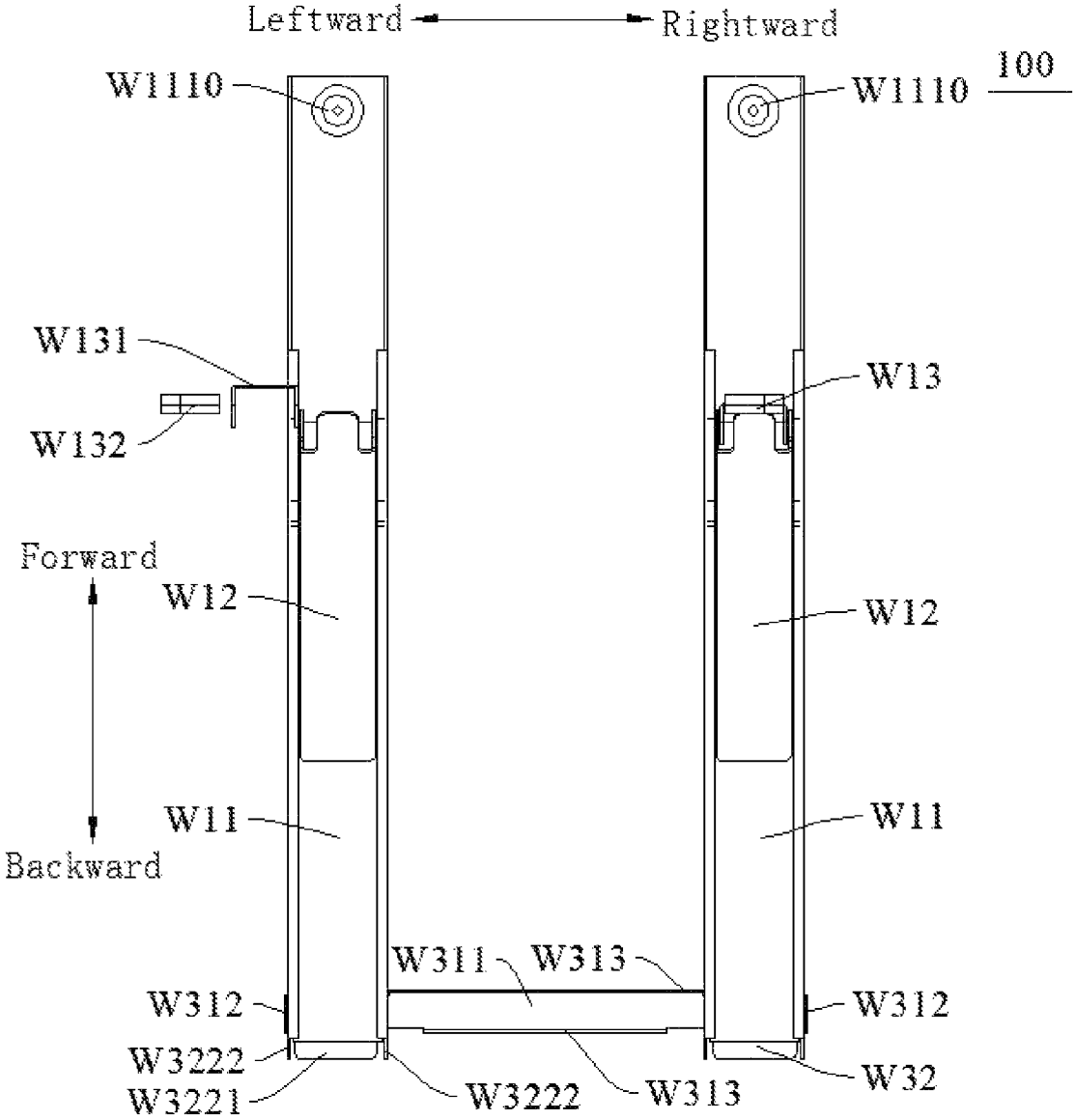
FIG. 7 is still yet another schematic view of the mounting bracket illustrated in FIG. 4.

In some embodiments, as illustrated in FIG. 2 and FIG. 6, the shielding structure W322 includes a first visor plate W3221 and a second visor plate W3222. The first visor plate W3221 is located above the first connection part W11*c*, and thus the first visor plate W3221 may shield an upper side of the first connection part W11*c*. The first visor plate W3221 may be adapted to shield the upper side of the connection member W4. Two second visor plates W3222 are provided and located at both lateral sides of the first connection part W11*c*, respectively, and thus the two second visor plates W3222 may shield both lateral sides of the first connection part W11*c*. The two second visor plates W3222 may be adapted to shield both lateral sides of the connection member W4. In this manner, the first visor plate W3221 and the second visor plate W3222 can facilitate shielding of the upper side and both lateral sides of the connection member W4, thereby protecting the connection member W4. In addition, the first visor plate W3221 and the second visor plate W3222 are simple in structure and easy to be fabricated.

In some embodiments, as illustrated in FIG. 1 and FIG. 2, the mounting structure W321 includes a mounting plate W3211 extending in the vertical direction. The mounting plate W3211 is located at a side of the first connection part W11*c* close to an indoor space. In this manner, when the mounting structure W321 is connected to the first connection part W11*c*, it is convenient for the support frame W11 to provide certain support to the connection unit W3, thereby facilitating quick mounting the connection unit W3 to the support frame W11. Here, the mounting plate W3211 is adapted to be fixedly connected to the first connection part W11*c* by the connection member W4. In this manner, the mounting plate W3211 and the first connection part W11*c* are reasonably arranged to allow the connection member W4 to quickly pass through the mounting plate W3211 and the first connection part W11*c*, thereby connecting the connection unit W3 to the support frame W11.

Figure 8:
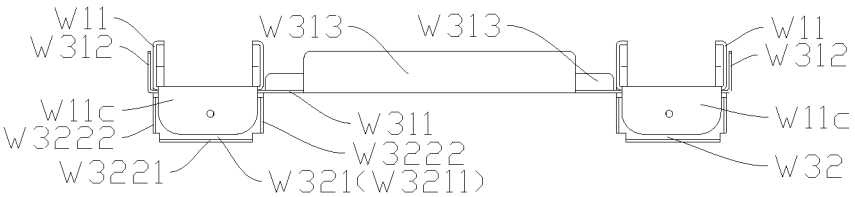
FIG. 8 is still yet another schematic view of the mounting bracket illustrated in FIG. 7.
Figure 9:
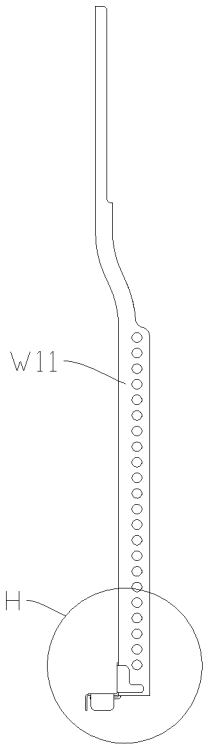
FIG. 9 is a schematic assembled view of a support frame and a connection unit illustrated in FIG. 7.
Figure 10:
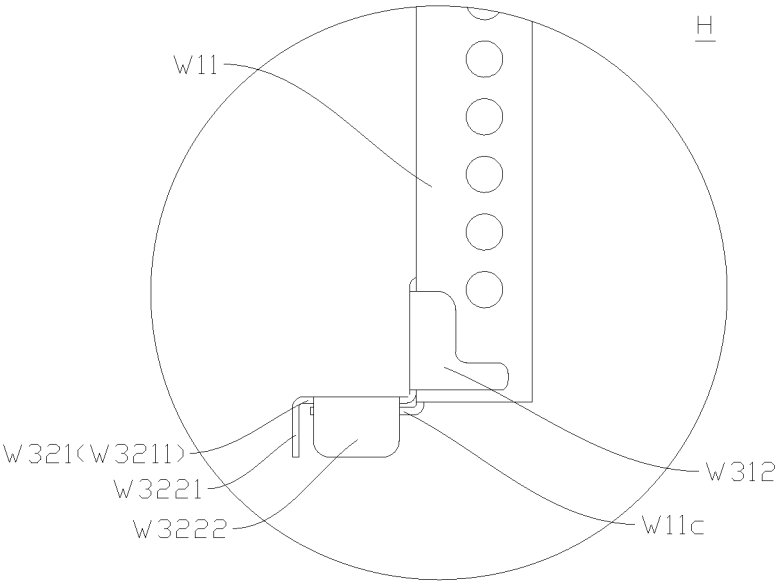
FIG. 10 is an enlarged view of part H circled in FIG. 9.

For example, in examples illustrated in FIG. 2 and FIG. 8, the first connection part W11*c* is formed into a plate-like structure, and the mounting plate W3211 is also formed into a plate-like structure. Further, the first connection part W11*c* and the mounting plate W3211 may be arranged in parallel to facilitate connecting the first connection part W11*c* to the mounting plate W3211 by the connection member W4.

In some embodiments, as illustrated in FIG. 2, FIG. 6, FIG. 8, and FIG. 10, the shielding structure W322 includes the first visor plate W3221 and the second visor plate W3222. The first visor plate W3221 is connected to an upper edge of the mounting plate W3211, extends in an inward-outward direction, and is located above the first connection part W11*c*. Therefore, the first visor plate W3221 can shield the upper side of the first connection part W11*c*. Thus, the first visor plate W3221 is adapted to shield the upper side of the connection member W4. Two second visor plates W3222 are provided, which are connected to edges on both lateral sides of the mounting plate W3211, respectively. Each second visor plate W3222 may extend in the inward-outward direction. The two second visor plates W3222 are located at both lateral sides of the first connection part W11*c*, respectively. Therefore, the two second visor plates W3222 can shield both lateral sides of the first connection part W11*c*, respectively. Thus, the two second visor plates W3222 is adapted to shield both lateral sides of the connection member W4. In this manner, arranging the first visor plate W3221 and the second visor plate W3222 at the edges of the mounting plate W3211 may facilitate shielding of the upper side and both lateral sides of the connection member W4, thereby providing protection to the connection member W4. In addition, the shielding structure W322 is simple in structure and easy to be fabricated.

For example, in examples illustrated in FIG. 2, FIG. 6, FIG. 8, and FIG. 10, the first visor plate W3221 extends outwards from the upper edge of the mounting plate W3211, and thus an edge of the first visor plate W3221 on a side close to the indoor space is arranged flush with the upper edge of the mounting plate W3211 in the inside-outside direction. The second visor plate W3222 extends outwards from a side edge of the mounting plate W3211, and thus an edge of the second visor plate W3222 on a side close to the indoor space is arranged flush with the side edge of the mounting plate W3211 in the inside-outside direction. In this manner, the second connection part W32 is substantially formed into a hood shape, which ensures a shielding effect of the shielding structure W322 and also, facilitates forming the entire second connection part W32 from a single plate by means of a bending process, thereby facilitating processing of the shielding structure W322.

Of course, the edge of the first visor plate W3221 on the side close to the indoor space may be arranged non-flush with the upper edge of the mounting plate W3211 in the inside-outside direction. That is, the upper edge of the mounting plate W3211 is connected between both ends of the first visor plate W3221 in the inside-outside direction. The edge of the second visor plate W3222 on the side close to the indoor space may be arranged not to be flush with the side edge of the mounting plate W3211 in the inside-outside direction. That is, the side edge of the mounting plate W3211 is connected between both ends of the second visor plate W3222 in the inside-outside direction.

In some embodiments, as illustrated in FIG. 2 and FIG. 8, the first connection part W11*c* extends upwardly from the outdoor end part W11*d* of the support frame W11, such that the first connection part W11*c* may be formed by bending the outdoor end part W11*d* of the support frame W11. In addition, the second connection part W32 is located above the support frame W11, and the connection rod W31 is located at a side of the second connection part W32 close to the indoor space. Therefore, the operator can mount the connection unit W3 on the support frame W11 from inside to outside and from top to down. Such an operation is easy to be implemented. Also, it is easy to implement support of the support frame W11 to the connection unit W3 without an additional limiting device in an assembly process or holding the connection unit W3 for a long time, thereby further improving assembly efficiency. After the window air conditioner 200 is mounted, the connection unit W3 may be spaced apart from the window air conditioner 200 in the inside-outside direction.

It should be understood that when the first connection part W11*c* extends upwardly from the outdoor end part W11*d* of the support frame W11, the first connection part W11*c* may also be formed by bending the outdoor end part W11*d* of the support frame W11. In addition, the second connection part W32 is located above the support frame W11, and the connection rod W31 may also be located at a side of the second connection part W32 facing away from the indoor space.

Of course, the first connection part W11*c* may also extend downwardly from the outdoor end part W11*d* of the support frame W11. Alternatively, the outdoor end part W11*d* of the support frame W11 may be connected between an upper end and a lower end of the first connection part W11*c*.

Figure 4:
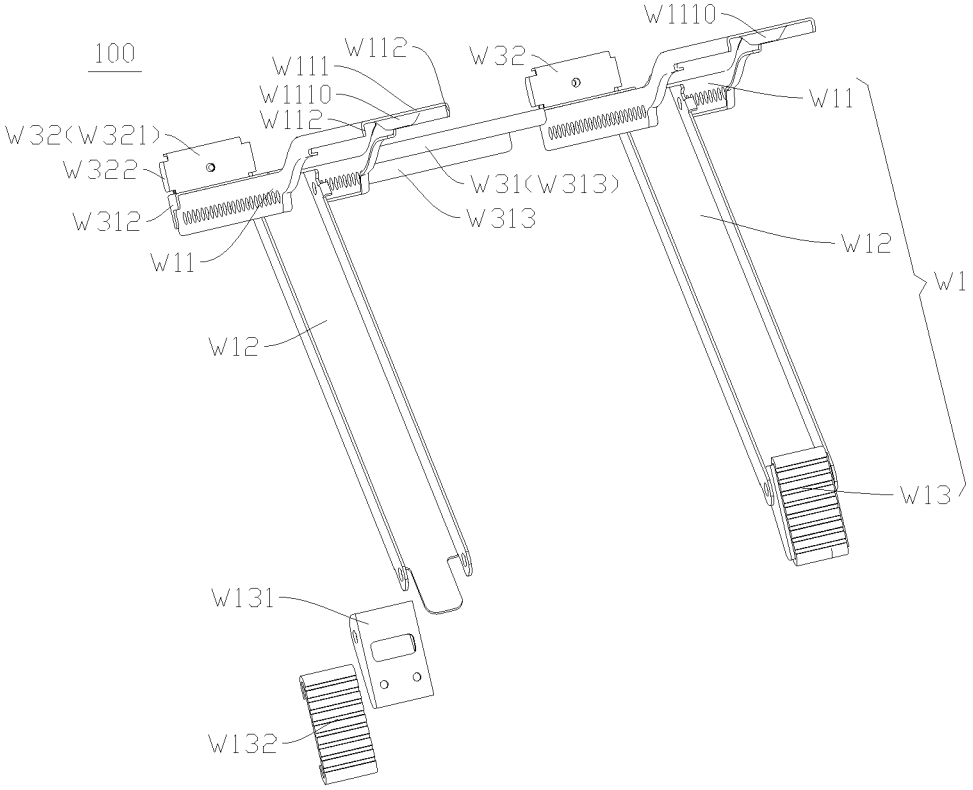
FIG. 4 is a partial schematic view of the mounting bracket illustrated in FIG. 3.
Figure 5:
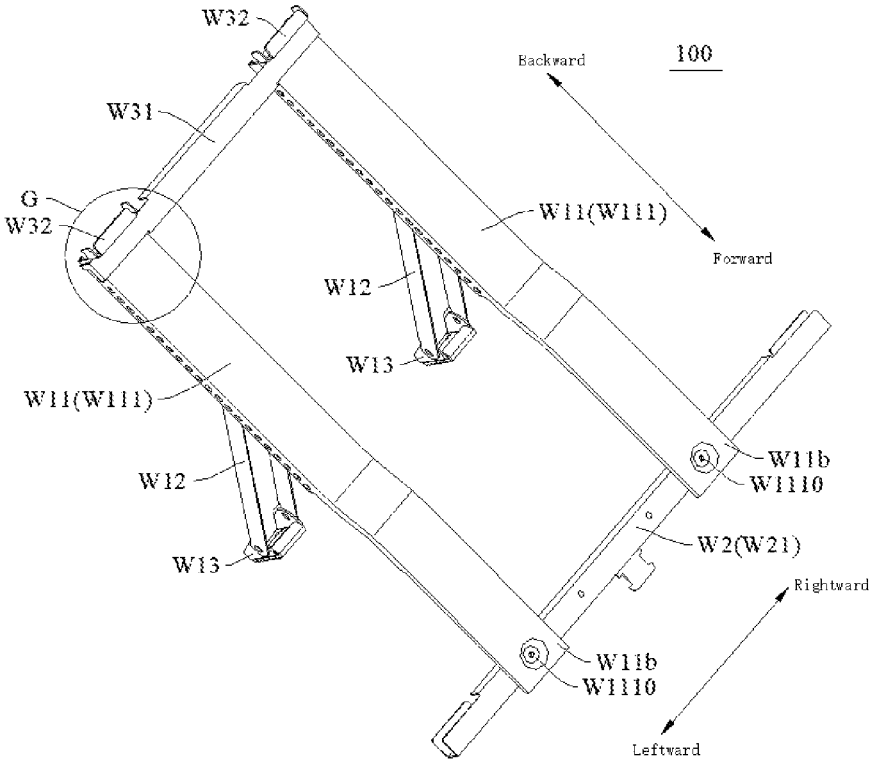
FIG. 5 is yet another schematic view of the mounting bracket illustrated in FIG. 3.

For example, as illustrated in FIG. 2, FIG. 4, and FIG. 6, the connection rod W31 includes a top plate W311, two side plates W312 connected below the top plate W311, and at least two reinforcement plates W313. Each of the side plates W312 and the at least two reinforcement plates W313 may be connected below the top plate W311. The top plate W311 is supported at the plurality of support frames W11. The two side plates W312 are located at both lateral sides of the plurality of support units W1. The at least two reinforcement plates W313 are located between two adjacent support frames W11. To a certain extent, the at least two reinforcement plates W313 facilitate limiting positions of the connection unit W3 and the support frame W11 in the transverse direction. Therefore, the connection rod W31 has a simple structure, and is convenient to ensure structural strength of the connection unit W3 and connection reliability of the plurality of support units W1. In addition, the plurality of support frames W11 may cooperate with the top plate W311 and the two side plates W312 to define a mounting groove. Two adjacent support frames W11 are separated from each other by the at least two reinforcement plates W313, which is conducive to improving assembly efficiency of the connection rod W31 and the plurality of support frames W11.

For example, in examples illustrated in FIG. 2, FIG. 4, and FIG. 6, the top plate W311 may extend in the transverse direction and be supported at upper surfaces of the plurality of support frames W11. In addition, the two side plates W312 may be located at both transverse ends of the top plate W311, respectively, and each side plate W312 may extend downwardly from a corresponding one of the both transverse ends of the top plate W311. Moreover, the two side plates W312 may be engaged with two lateral side surfaces, which face away from each other, of outer two support frames W11 of the plurality of support frames W11, respectively, such that the top plate W311 and the two side plates W312 may be formed into a substantially U-shaped structure with an opening facing downwards. Two reinforcement plates W313 may be provided and connected below the top plate W311. The two reinforcement plates W313 are spaced apart from each other in the inside-outside direction. Each reinforcement plate W313 extends downwardly from an end part of the top plate W311 in the inside-outside direction. In this manner, the top plate W311 and the two reinforcement plates W313 may be formed substantially into a structure having a ⊏-shaped cross section, which effectively improves bending resistance of the connection rod W31 and ensures reliability of a connection among the plurality of support frames W11. Here, the two reinforcement plates W313 may have a same transverse length or different transverse lengths.

It should be understood that the two side plates W312 may abut against the two lateral side surfaces, which face away from each other, of the outer two support frames W11 of the plurality of support frames W11, respectively. Such a manner facilitates limiting a position of the connection unit W3 relative to the plurality of support frames W11 and is easy to be operated.

Of course, when three or more support units W1 are provided, at least one reinforcement plate W313 may be disposed between every two adjacent support frames W11 to space two adjacent support frames W11 apart from each other by the reinforcement plate W313, thereby facilitating limiting or pre-limiting positions of the plurality of support units W1 in the transverse direction.

In an example illustrated in FIG. 1, the connection rod W31 is a one-piece member, which ensures strength of the connection rod W31 and simplifies assembly procedures. For example, the connection rod W31 is formed by bending a single plate.

In some embodiments, as illustrated in FIG. 1 and FIG. 2, the connection rod W31 and the plurality of second connection parts W32 are formed into a one-piece member, which reduces connection steps between the connection rod W31 and the plurality of second connection parts W32, and thus is advantageous to improve processing efficiency of the connection unit W3. In addition, it is possible to ensure a reliable connection between the connection rod W31 and the plurality of second connection parts W32. For example, in the examples illustrated in FIG. 1 and FIG. 2, the connection rod W31 and the plurality of second connection parts W32 may be formed from a single plate through a bending process. That is, the single plate is bent to form the connection rod W31 and the plurality of second connection parts W32. In this manner, the connection unit W3 can be processed in simple steps and at low costs.

For example, in the examples illustrated in FIG. 1 and FIG. 2, the connection unit W3 is formed into a one-piece member to reduce assembly steps of the connection unit W3 and improve mounting efficiency of the mounting bracket 100. For example, the connection unit W3 is formed as a bent member by bending the single plate. Of course, the connection unit W3 may also be formed as a split member. In this case, different parts of the connection unit W3 may be connected to each other by means of assembling.

Figure 45:
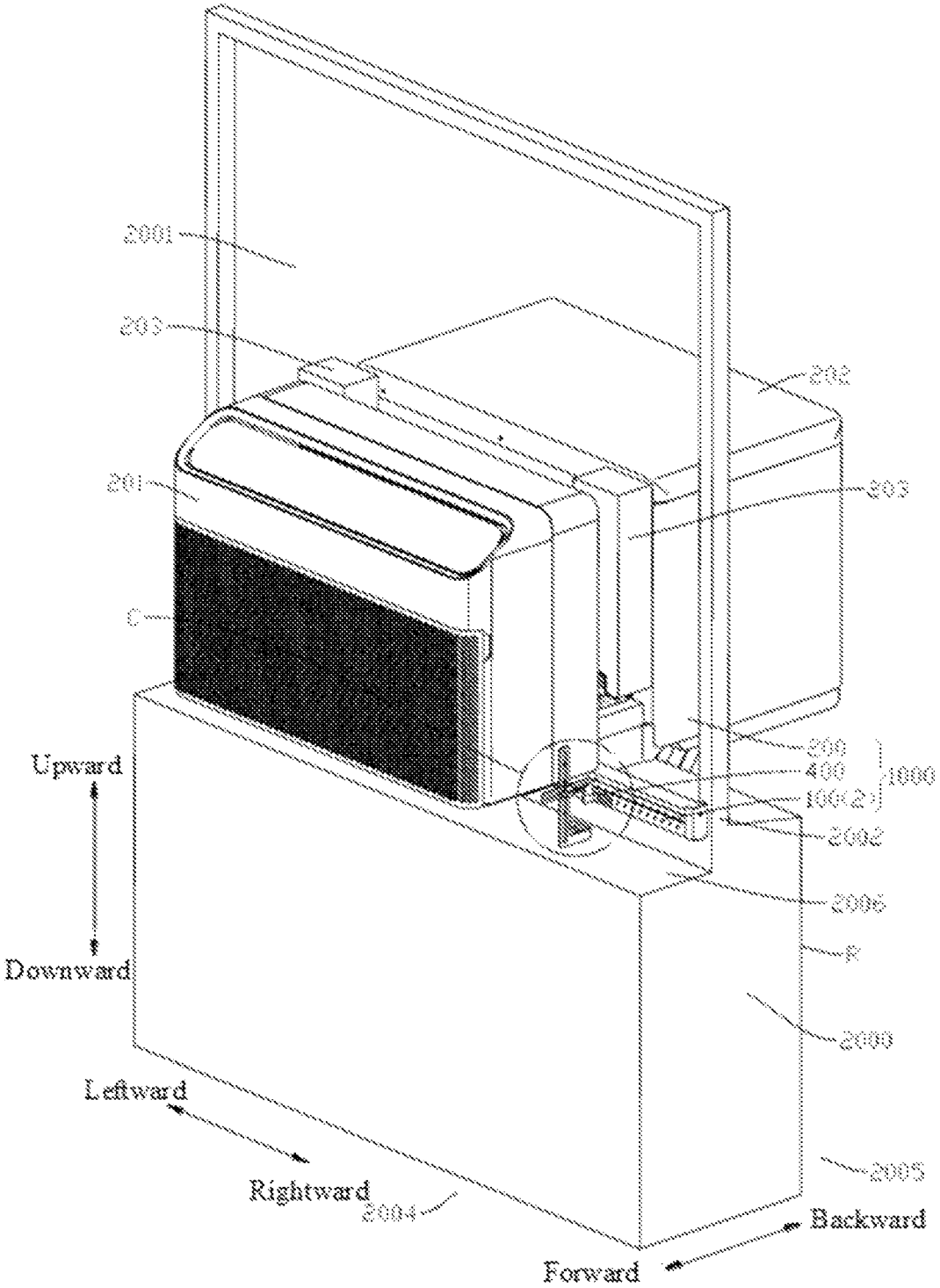
FIG. 45 is a schematic mounting view of a window air conditioner assembly according to another embodiment of the present disclosure.

In some embodiments, as illustrated in FIG. 1, and in connection with FIG. 39, FIG. 43, and FIG. 45, the support frame W11 is adapted to pass through the window opening 2001 in such a manner that a part of the support frame W11 is arranged indoors. Therefore, the support frame W11 also includes a second part W11*b* adapted to be arranged indoors. The mounting bracket 100 includes a positioning unit W2 adapted to be arranged indoors and connected to the part of the support frame W11 located indoors, e.g., the second part W11*b* of the support frame W11. The positioning unit W2 is adapted to be in a positioning fit with the window opening 2001 and/or a window frame 2002 to facilitate stable mounting of the support unit W1 at the window opening 2001.

For example, the positioning unit W2 is adapted to be in a positioning fit with the window opening 2001 to facilitate stable mounting of the positioning unit W2 at the wall body 2000. The support frame W11 of each support unit W1 extends into the indoor space and is connected to the positioning unit W2 by the second part W11*b* thereof to achieve stable mounting of the mounting bracket 100. Of course, when the mounting bracket 100 is in use, the positioning unit W2 may also be in a positioning fit with the window frame 2002 at the window opening 2001, or the positioning unit W2 may be in a positioning fit with both the window opening 2001 and the window frame 2002, such that the stable mounting of the mounting bracket 100 can also be realized.

It should be understood that in the inside-outside direction, a length of the second part W11*b* of the support frame W11 may be shorter than a length of a first part W11*a* of the support frame W11, such that the mounting bracket 100 can be arranged to match a center of gravity of the window air conditioner 200 for ensuring the stability of the mounting of the window air conditioner 200.

Of course, when mounted at the window opening 2001, the support frame W11 may also be mounted outdoors entirely. In this case, if the mounting bracket 100 includes the positioning unit W2, the positioning unit W2 is adapted to be at least partially arranged indoors and is directly or indirectly connected to the support frame W11. For example, in a case where the positioning unit W2 is indirectly connected to the support frame W11, a connection segment may be interposed between the positioning unit W2 and the support frame W11. The connection segment is connected to each of the positioning unit W2 and the support frame W11 to connect the positioning unit W2 to the support frame W11. In addition, in a case where the positioning unit W2 is directly connected to the support frame W11, the positioning unit W2 may partially extend outdoors to be connected to the support frame W11. However, the present disclosure is not limited in this regard.

For example, as illustrated in FIG. 1 and FIG. 4, the positioning unit W2 includes a main frame W21 extending in the transvers direction. Further, the support frame W11 is supported above the main frame W21, and includes a support plate W111 and a flange part W112 extending downwardly from each of both lateral sides of the support plate W111. Furthermore, the support plate W111 has a recess W1110 formed in an indoor end part 11*e* thereof and recessed downwardly, and the recess W1110 has a bottom wall supported at an upper surface of the main frame W21 and adapted to be fixedly connected to the main frame W21 by the connection member W4. Therefore, such a manner is conducive to ensuring a contact area between the support frame W11 and the main frame W21 and strengthening contact strength between the support frame W11 and the main frame W21. Also, due to an arrangement of the flange parts W112, the support frame W11 has good deformability, such that when the bottom wall of the recess W1110 is fixed to the main frame W21 by the connection member W4, the support frame W11 may be deformed to a certain extent to perform a more tight connection among the support frame W11, the main frame W21, and the connection member W4, thereby facilitating ensuring a more reliable connection between the support frame W11 and the main frame W21. Further, the recess W1110 may accommodate the connection member W4 to avoid an exposure of the connection member W4, thereby avoiding injuries to a user or loosening of the connection member W4 caused by easy scratching with the connection member W4, and assisting in ensuring the structural stability of the mounting bracket 100.

In some embodiments, as illustrated in FIG. 1, and in connection with FIG. 39, FIG. 43, and FIG. 45, each of the plurality of support units W1 further includes a support leg W12 adapted to be arranged outdoors. Further, the support leg has an upper end connected to the part of the support frame W11 located outdoors, e.g., connected to the first part W11*a* of the support frame W11, and a lower end directly or indirectly abutting against an outer wall surface R of the wall body 2000. The support leg W12 can provide support to the support frame W11, which is conducive to improving stability of the mounting bracket 100. Here, the support leg W12 may be angled relative to the support frame W11 to allow a stable support arrangement, e.g., a triangular arrangement, to be formed by the support unit W1 and the wall body 2000 together, thereby ensuring structural stability of the support unit W1.

Optionally, in the example illustrated in FIG. 1, and in connection with FIG. 39, FIG. 43, and FIG. 45, the lower end of the support leg W12 may have a support foot W13 provided thereon, and the support foot W13 is adapted to abut against the outer wall surface R of the wall body 2000 to allow the lower end of the support leg W12 to indirectly abut against the outer wall surface R of the wall body 2000. In this way, it is convenient to ensure a sufficient support area between the support foot W13 and the wall body 2000. For example, the support foot W13 and the wall body 2000 are in planar contact with each other, which not only ensures that the support leg W12 stably supports the support frame W11, but also assists in simplifying a structure of the support leg W12.

For example, as illustrated in FIG. 4, the support foot W13 includes a body W131 mounted at the support leg W12 and a cladding W132 wrapping around the body 131. The support foot W13 is adapted to abut against the outer wall surface R of the wall body 2000 with the cladding W132. Here, the body W131 is a sheet metal part and the cladding W132 is a rubber member.

Optionally, in the example illustrated in FIG. 1, the support frame W11 is formed into a one-piece member to reduce assembly steps of the support frame W11 and improve mounting efficiency of the mounting bracket 100. For example, the support frame W11 is formed as a bent member, and the entire support frame W11 is bent and formed from a single plate. Of course, the support frame W11 may also be formed as a split member. In this case, the support frame W11 may include a plurality of support members that may be connected to each other by means of assembling.

Some embodiments of the mounting bracket 100 in the present disclosure will be described below with reference to FIG. 11 to FIG. 17.

Figure 11:
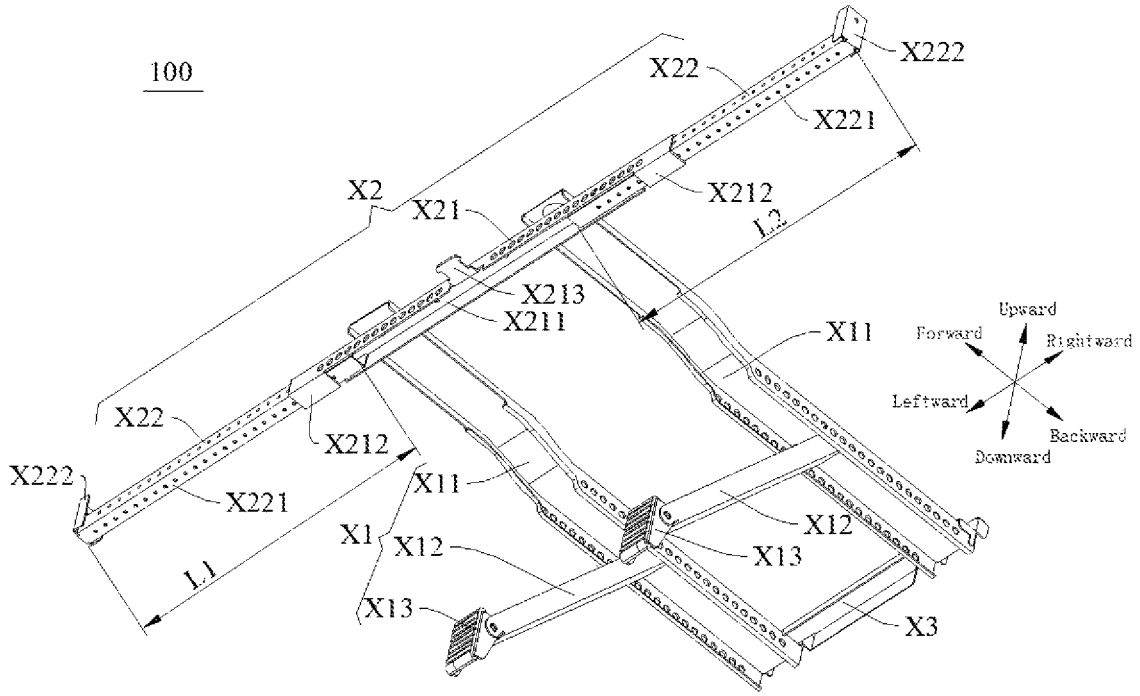
FIG. 11 is a schematic view of a mounting bracket for a window air conditioner according to an embodiment of the present disclosure.

As illustrated in FIG. 11, and in connection with FIG. 39, FIG. 43, and FIG. 45, the mounting bracket 100 includes a support unit X1. The support unit X1 is adapted to pass through the window opening 2001 in the inside-outside direction (e.g., a forward-backward direction in FIG. 11), and the at least a part of the support unit X1 located outdoors is adapted to abut against the outer wall surface R of the wall body 2000, such that the wall body 2000 can provide support to the support unit X1 to ensure support reliability of the support unit X1.

Here, one or more support units X1 may be provided. In a case where the mounting bracket 100 includes a plurality of support units X1, it is beneficial to improve the structural strength and structural stability of the mounting bracket 100, thereby ensuring that the mounting bracket 100 has sufficient support strength for the window air conditioner 200.

As illustrated in FIG. 11, and in connection with FIG. 39 and FIG. 43, the mounting bracket 100 further includes a positioning unit X2 adapted to be arranged indoors and connected to a part of the support unit X1 located indoors. Therefore, the support unit X1 may include an outdoor part adapted to be located outdoors and an indoor part adapted to be located indoors. The positioning unit X2 is connected to the indoor part of the support unit X1, and at least a part of the outdoor part of the support unit X1 is adapted to abut against the outer wall surface R of the wall body 200.

Here, the positioning unit X2 being adapted to be positioned and engaged into the window opening 2001 and/or a window frame 2002 may include: 1) the positioning unit X2 being adapted to be positioned and engaged into the window opening 2001; 2) the positioning unit X2 being adapted to be in a positioning fit with the window frame 2002; and 3) the positioning unit X2 being adapted to be in a positioning fit with both the window opening 2001 and the window frame 2002. Such a manner facilitates reliable mounting of the positioning unit X2 at the window opening 2001, thereby facilitating stable mounting of the support unit X1 at the window opening 2001.

For example, in the case where the positioning unit X2 is adapted to be positioned and engaged into the window opening 2001, the positioning unit X2 is adapted to be positioned and engaged into the wall body 2000, and may be adapted to be in a positioning fit with a bottom wall of the window opening 2001. For example, the positioning unit X2 may be in a positioning fit with a windowsill 2006 or a side wall of the window opening 2001. In this case, the positioning unit X2 may be spaced apart from the window frame 2002. Of course, the positioning unit X2 may also abut against the window frame 2002. In the case where the positioning unit X2 is adapted to be in a positioning fit with the window frame 2002, the positioning unit X2 may be adapted to be in a positioning fit with a lower edge or a side edge of the window frame 2002. In this case, the positioning unit X2 may be spaced apart from a wall surface of the window opening 2001. Of course, the positioning unit X2 may also be arranged at the wall surface of the window opening 2001.

As illustrated in FIG. 11, the positioning unit X2 includes a main frame X21 and a plurality of sub-frames X22. Each of the main frame X21 and the plurality of sub-frames X22 extends in the transvers direction (for example, in a leftward-rightward direction illustrated in FIG. 11). Each of the plurality of sub-frames X22 is capable of cooperating with the main frame X21 in a withdrawable manner in the transverse direction to provide an adjustable transverse length for the positioning unit X2. Therefore, the main frame X21 may be adapted to be positioned and engaged into the window opening 2001 and/or the window frame 2002. For example, when each sub-frame X22 is engaged with the main frame X21, the sub-frame X22 may be moved relative to the main frame X21 in the transverse direction to change a combined transverse length of the sub-frame X22 and the main frame X21, thereby changing the transverse length of the positioning unit X2.

Therefore, an appropriate transverse length of the positioning unit X2 may be selected for window air conditioners 200 of different sizes or based on window openings 2001 of different sizes. That is, the positioning unit X2 may be adapted to the window air conditioners 200 of different sizes, window openings 2001 and window frames 2002 of different sizes, thereby improving applicability of the mounting bracket 100 and facilitating a realization of a good universality of the mounting bracket 100. In addition, the window opening 2001 and/or the window frame 2002 engaged with the positioning unit X2 can be subjected to reasonable forces, thereby avoiding excessive concentration of forces on the window opening 2001 and/or the window frame 2002 and improving the mounting reliability of the window air conditioner 200.

As illustrated in FIG. 11 and FIG. 15 to FIG. 17, the plurality of sub-frames X22 may be configured to cooperate with the main frame X21 in a replaceable manner. Therefore, the main frame X21 may be alternatively engaged with the plurality of sub-frames X22. The plurality of sub-frames X22 can be used alternatively, which allows the main frame X21 to have good universality and facilitates a realization of different adjustment ranges of transverse lengths of the positioning unit X2, thereby assisting in further enhancing applicability of the positioning unit X2. In addition, it is easy to replace a sub-frame X22 based on a practical demand, thereby allowing the positioning unit X2 to better satisfy practical differentiated demands. In addition, if a certain sub-frame X22 cannot be used normally, one of the remaining sub-frames 2 may be used instead, such that at least two of the plurality of sub-frames X22 can serve as a backup for each other, thereby improving redundancy of the use of the positioning unit X2.

Here, transverse lengths of at least two of the plurality of sub-frames X22 are different from each other. Therefore, if sub-frames X22 of unequal lengths are engaged with the main frame X21, the resulting positioning assemblies X2 may have different adjustment ranges of the transverse lengths. Such a manner is conducive to extending the adjustment range of the transverse length of the positioning unit X2 and improves the applicability of the positioning unit X2 again. For example, in a case where two sub-frames X22 are provided, the two sub-frames X22 may have unequal transverse lengths. In addition, in a case where three sub-frames X22 are provided, at least two of the three sub-frames X22 may have unequal transverse lengths, i.e., at least two of the three sub-frames may have unequal transverse lengths, or all three sub-frames X22 may have unequal transverse lengths. Of course, more than three sub-frames X22 may also be provided. For example, the sub-frame X22 may include a plurality of first sub-frames X22*a* and a plurality of second sub-frames X22*b*. A transverse length of each of the plurality of first sub-frames X22*a* may be shorter than a transverse length of each of the plurality of second sub-frames X22*b*. During using the mounting bracket 100, the plurality of first sub-frames X22*a* and the plurality of second sub-frames X22*b* may be engaged with both lateral sides of the main frame X21, respectively. However, the present disclosure is not limited in this regard. For example, also, two of the plurality of first sub-frames X22*a* may be engaged with both lateral sides of the main frame X21, respectively.

It should be understood that during using the positioning unit X2, the main frame X21 may be respectively engaged with the plurality of sub-frames X22 in a withdrawable manner at both sides in the transverse direction. In this case, the plurality of sub-frames X22 at both sides of the main frame X21 in the transverse direction may have different transverse lengths to allow the positioning unit X2 to have a minimum transverse length. For example, the minimum transverse length of the positioning unit X2 may be equal to or slightly greater than the transverse length of the main frame X21. Of course, the transverse lengths of the plurality of sub-frames X22 at both sides of the main frame X21 in the transverse direction may also be equal to each other.

For example, the transverse length of the main frame X21 is 1,000 mm, and the transverse lengths of two of the plurality of sub-frames X22 may be 200 mm and 800 mm, respectively. In this case, the transverse length of the positioning unit X2 may be substantially adjusted in a range of 1,000 mm to 2,000 mm when two sub-frames X22 of the plurality of sub-frames X22 are engaged with both sides of the main frame X21 in the transverse direction, respectively. Compared with a case where the two sub-frames X22 of a transverse length of 800 mm are engaged with both sides of the main frame X21 in the transverse direction, this case can reduce a maximum value and a minimum value of the transverse length of the positioning unit X2, so that the minimum value of the transverse length of the positioning unit X2 approximates the transverse length of the main frame X21. Therefore, to a certain extent, when the main frame X21 has a certain length, it is easy for the positioning unit X2 to be engaged with the window opening 2001 and/or the window frame 2002 to make the positioning unit X2 applicable to different window openings 2001 as many as possible, thereby facilitating an increase in a utilization rate of the transverse length of the two sub-frames, and avoiding a waste of length caused by the too long transverse length of the positioning unit X2 relative to the window opening 2001. In addition, compared with a case where two sub-frames X22 of a transverse length of 200 mm are engaged with both sides of the main frame X21 in the transverse direction, this case facilitates an extending of the adjustment range of the transverse length of the positioning unit X2 and improves the applicability of the mounting bracket 100.

For another example, the transverse length of the main frame X21 is 1,000 mm, and the transverse lengths of two sub-frames X22 of the plurality of sub-frames X22 may both be 500. In this case, the transverse length of the positioning unit X2 may be substantially adjusted in a range of 1,000 mm to 2,000 mm when the two sub-frames X22 are engaged with both sides of the main frame X21 in the transverse direction, respectively. This case may also allow the minimum value of the transverse length of the positioning unit X2 to approximate the transverse length of the main frame X21, thereby improving the utilization rate of the transverse length of the positioning unit X2.

Therefore, with the plurality of sub-frames X22 configured to cooperate with the main frame X21 in the replaceable manner, and different transverse lengths of the at least two sub-frames X22 of the plurality of sub-frames X22, it is conducive to extending the adjustment range of the transverse length of the positioning unit X2, such that the mounting bracket 100 can be applicable to window openings 2001 and window frames 2002 of different sizes, thereby improving the applicability of the mounting bracket 100 and facilitating a redundant arrangement of the plurality of sub-frames X22. In addition, it is convenient to allow the minimum value of the transverse length of the positioning unit X2 to approximate the transverse length of the main frame X21, thereby assisting in improving the utilization rate of the transverse length of the positioning unit X2, ensuring that the mounting bracket 100 is engaged with the window opening 2001 and/or the window frame 2002, and realizing reasonable use of the mounting bracket 100. Also, the mounting bracket 100, which has a simple structure and reliable support, facilitates mounting and fixation of the window air conditioner 200, and ensures the mounting stability of the window air conditioner 200. Further, it is possible to prevent the window air conditioner 200 from easily falling from the window opening 2001, thereby facilitating the safe use of the window air conditioner 200.

Figure 12:
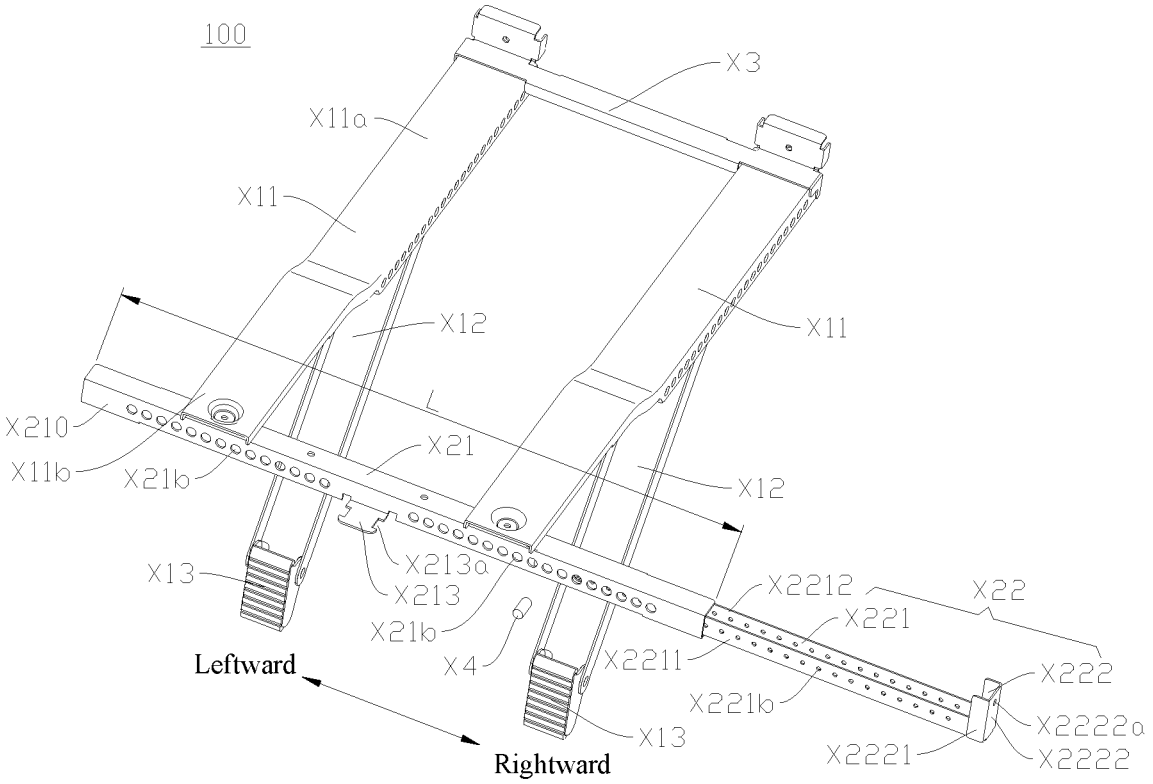
FIG. 12 is another schematic view of the mounting bracket illustrated in FIG. 11.

In some embodiments, as illustrated in FIG. 11 and FIG. 12, and in connection with FIG. 45, each of the plurality of sub-frames X22 includes a frame rod X221 extending in the transverse direction and capable of cooperating with the main frame X21 in a withdrawable manner in the transverse direction and a stop rod X222 extending in the vertical direction. The stop rod X222 is arranged at an end of the frame rod X221 in the transverse direction. Therefore, the stop rod X222 is adapted to abut against an edge of the window opening 2001 and/or an edge of the window frame 2002. In this manner, when the positioning unit X2 is engaged with the window opening 2001 and/or the window frame 2002, the transverse length of the positioning unit X2 may be adjusted to be substantially the same as a transverse size of the window opening 2001, and the stop rod X222 may be positioned against a side edge of the window opening 2001 and/or the window frame 2002. Such a manner facilitates an effective dispersion of at least a part of the force exerted on the main frame X21 towards the side edge of the window opening 2001 or the window frame 2002, thereby increasing an engagement area between the positioning unit X2 and the window opening 2001 and/or the window frame 2002. In addition, it is possible to balance the force exerted on the window opening 2001 and/or the window frame 2002 and improve the mounting reliability of the window air conditioner 200.

Figure 17:
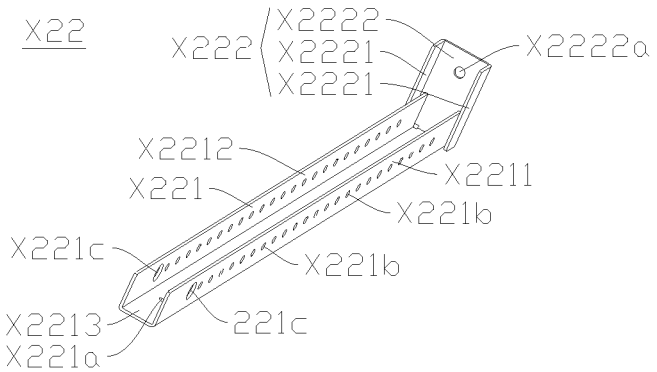
FIG. 17 is a schematic view of the sub-frame illustrated in FIG. 13.

Optionally, in examples illustrated in FIG. 12 and FIG. 17, the stop rod X222 may extend upwards from the transverse end of the frame rod X221. In this case, the transverse end of the frame rod X221 can be connected to a lower end of the stop rod X222. Of course, the stop rod X222 may also extend downwards from the transverse end of the frame rod X221 in the vertical direction. In this case, the transverse end of the frame rod X221 may be connected to an upper end of the stop rod X222 or between the upper and lower ends of the stop rod X222.

In some embodiments, as illustrated in FIG. 12 and FIG. 15 to FIG. 17, the stop rod X222 includes a stop plate X2221 extending in the transverse direction. The stop plate X2221 may be formed as a flat plate. A surface on a thickness side of the stop plate X2221 is adapted to abut against the edge of the window opening 2001 and/or the window frame 2002 to form a large abutment area between the stop rod X222 and the edge of the window opening 2001 and/or the window frame 2002, thereby enhancing an effect of the stop rod X222 in dispersing the force on the main frame X21.

In some embodiments, as illustrated in FIG. 12 and FIG. 15 to FIG. 17, the stop rod X222 includes two stop plates X2221 spaced apart from each other in the inside-outside direction and a connection plate X2222 extending in the inside-outside direction and connected to the two stop plates X2221. In this manner, structural stability of the stop rod X222 can be ensured, and the two stop plates X2221 may be both adapted to abut against the edge of the window opening 2001 and/or the window frame 2002, such that the stop rod X222 can be located either on one transverse side or on the other transverse side of the main frame X21. That is, the stop rod X222 may be located at either transverse end of the frame rod X221 to allow the sub-frame X22 to be capable of cooperating with either transverse side of the main frame X21 in a withdrawable manner.

For example, in examples illustrated in FIG. 12 and FIG. 15 to FIG. 17, the two stop plates X2221 may be arranged parallel to each other. Both the two stop plates X2221 and the connection plate X2222 may be arranged vertically. The connection plate X2222 is connected to an end of each of the two stop plates X2221 facing away from a center of the frame rod X221 to facilitate the entire stop rod X222 to be bent and formed from a single plate. Of course, the connection plate X2222 may also be connected to an end of each of the two stop plates X2221 close to the center of the frame rod X221, or the connection plate X2222 may be connected between both transverse ends of each of the two stop plates X2221.

Optionally, in examples illustrated in FIG. 12 and FIG. 15 to FIG. 17, the stop rod X222 is formed into a one-piece member. For example, the stop rod X222 is bent and formed in its entirety from a single plate.

As illustrated in FIG. 12 and FIG. 15 to FIG. 17, the connection plate X2222 has a first connection hole X2222*a* formed therein and extending in the transverse direction, and the first connection hole X2222*a* may run through the connection plate X2222 in a thickness direction of the connection plate X2222. In this manner, the connection plate X2222 is adapted to be fixedly connected to the window opening 2001 and/or the window frame 2002 by the first connection hole X2222*a*, which facilitates an improvement in the mounting stability of the mounting bracket 100. For example, in a case where the positioning unit X2 is adapted to be engaged at a bottom of the window opening 2001 and/or the window frame 2002, the connection plate X2222 is adapted to be connected to a side portion of the window opening 2001 and/or the window frame 2002. For example, the first connection hole X2222*a* has a fastener (a screw, etc.) passing therethrough and connected to the window opening 2001 and/or the window frame 2002.

Of course, the connection plate X2222 may also not be adapted to be fixedly connected to the window opening 2001 and/or the window frame 2002. For example, the connection plate X2222 may be spaced apart from the window opening 2001 and the window frame 2002 in the transverse direction.

As illustrated in FIG. 12 and FIG. 15 to FIG. 17, the frame rod X221 has a second connection hole X221*a* extending in the vertical direction and/or a third connection hole X221*b* extending in the inside-outside direction. Thus, the followings cases are included: 1) the frame rod X221 has a second connection hole X221*a* extending in the vertical direction; 2) the frame rod X221 has the third connection hole X221*b* extending in the inside-outside direction; and 3) the frame rod X221 has s second connection hole X221*a* extending in the vertical direction and/or a third connection hole X221*b* extending in the inside-outside direction.

In a case where the frame rod X221 has the second connection hole X221*a* extending in the vertical direction, the second connection hole 2221*a* may run through the frame rod X221 vertically, and the frame rod X221 may be adapted to be fixedly connected to the window opening 2001 and/or the window frame 2002 through the second connection hole X221*a*, thereby assisting in improving the mounting stability of the mounting bracket 100. For example, when the positioning unit X2 is adapted to be engaged at the bottom of the window opening 2001 and/or the window frame 2002, the frame rod X221 is adapted to be connected to the bottom wall of the window opening 2001 and/or the lower edge of the window frame 2002. For example, the second connection hole X221*a* has a fastener (a screw, etc.) passing therethrough and connected to the window opening 2001 and/or the window frame 2002.

Here, a plurality of second connection holes X221*a* are provided and spaced apart from each other in the transverse direction to prevent, during an adjustment of the transverse length of the positioning unit X2, the plurality of second connection holes X221*a* from being shielded, thereby ensuring that the use of the plurality of second connection holes X221*a* would not be affected by the transverse length of the positioning unit X2.

In a case where the frame rod X221 has a third connection hole X221*b* extending in the inside-outside direction, the third connection hole X221*b* may run through the frame rod X221 in the inside-outside direction. The frame rod X221 is adapted to be fixedly connected to the window opening 2001 and/or the window frame 2002 through the third connection hole X221*b*, thereby facilitating an improvement in the mounting stability of the mounting bracket 100. For example, when the positioning unit X2 is adapted to be engaged at the bottom of the window opening 2001 and/or the window frame 2002, the frame rod X221 is adapted to be connected to the bottom wall of the window opening 2001 and/or the lower edge of the window frame 2002. For example, the third connection hole X221*b* has a fastener (a screw, etc.) passing therethrough and connected to the window opening 2001 and/or the window frame 2002.

Here, a plurality of third connection holes X221*b* are provided and spaced apart from each other in the transverse direction to prevent, during an adjustment of the transverse length of the positioning unit X2, the plurality of third connection holes X221*a* from being shielded, thereby ensuring that the use of the plurality of third connection holes X221*b* would not be affected by the transverse length of the positioning unit X2.

For example, in the example illustrated in FIG. 17, the frame rod X221 includes an indoor side wall surface 2211, an outdoor side wall surface 2212, and a connection wall surface 2213. The indoor side wall surface 2211 and the outdoor side wall surface 2212 are spaced apart from each other in the inside-outside direction. The connection wall surface 2213 is connected between a lower edge of the indoor side wall surface 2211 and a lower edge of the outdoor side wall surface 2212. The frame rod X221 is opened at a top thereof, such that a cross section of the frame rod X221 is ⊏-shaped. The connection wall surface 2213 has a plurality of second connection holes X221*a* formed therein and spaced apart from each other. Each of the indoor side wall surface 2211 and the outdoor side wall surface 2212 has a plurality of third connection holes X221*b* formed therein and spaced apart from each other. In addition, the plurality of third connection holes X221*b* in the indoor side wall surface 2211 and the plurality of third connection holes X221*b* in the outdoor side wall surface 2212 are arranged in a one-to-one correspondence. The fastener may pass through the plurality of third connection holes X221*b* in the indoor side wall 2211 and the plurality of third connection holes X221*b* in the outdoor side wall 2212 and connected to the window opening 2001 and/or the window frame 2002.

It should be noted that an expression "indoor side" in the "indoor side wall surface 2211" does not mean that the "indoor side wall surface 2211" is located at an indoor side 2004 and an expression "outdoor side" in the "outdoor side wall surface 2212" does not mean that the "outdoor side wall surface 2212" is located at an outdoor side 2005. Instead, the "indoor side wall surface 2211" is located at a side of the "outdoor side wall surface 2212" facing towards the indoor space.

Figure 15:
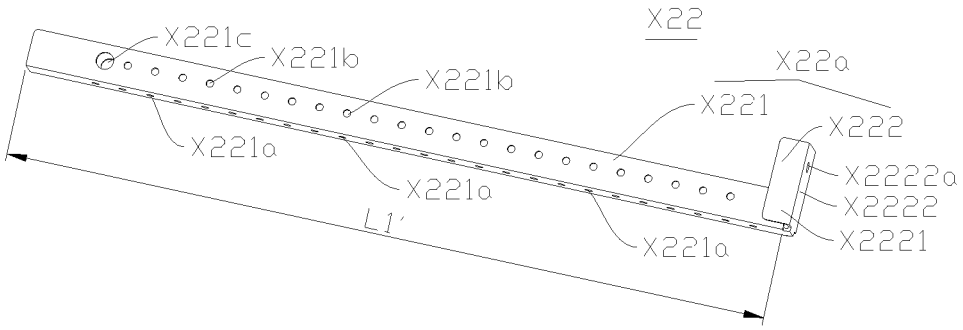
FIG. 15 is a schematic view of one sub-frame illustrated in FIG. 13.
Figure 16:
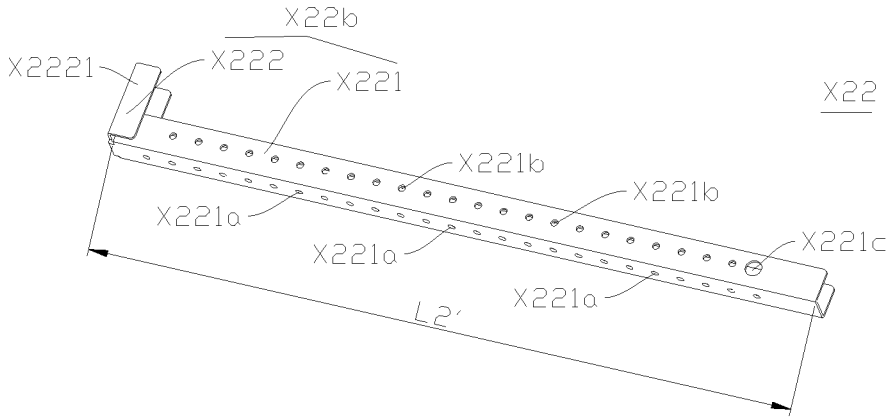
FIG. 16 is a schematic view of another sub-frame illustrated in FIG. 13.

Further, in examples illustrated in FIG. 15 to FIG. 17, the connection plate X2222 has a lower edge connected to a transverse end part of the connection wall surface 2213, and the two stop plates X2221 are located at an outer side of the indoor side wall surface 2211 and the outdoor side wall surface 2212. That is, one of the stop plates X2221 is located at a side of the indoor side wall surface 2211 facing towards the indoor space, and the other stop plate X2221 is located at a side of the outdoor side wall surface 2212 facing towards the outdoor space. Such a manner facilitates a formation of the sub-frame X22 as a one-piece member. For example, the entire sub-frame X22 is bent and formed from a single plate to facilitate processing of the sub-frame X22.

Figure 13:
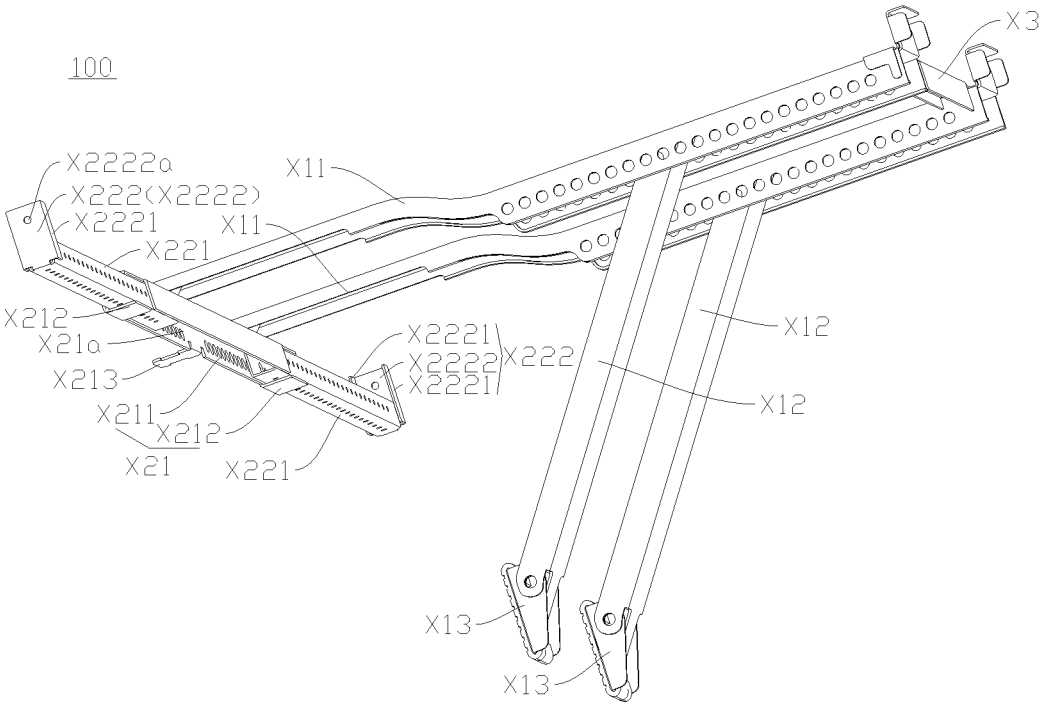
FIG. 13 is yet another schematic view of the mounting bracket illustrated in FIG. 11.
Figure 14:
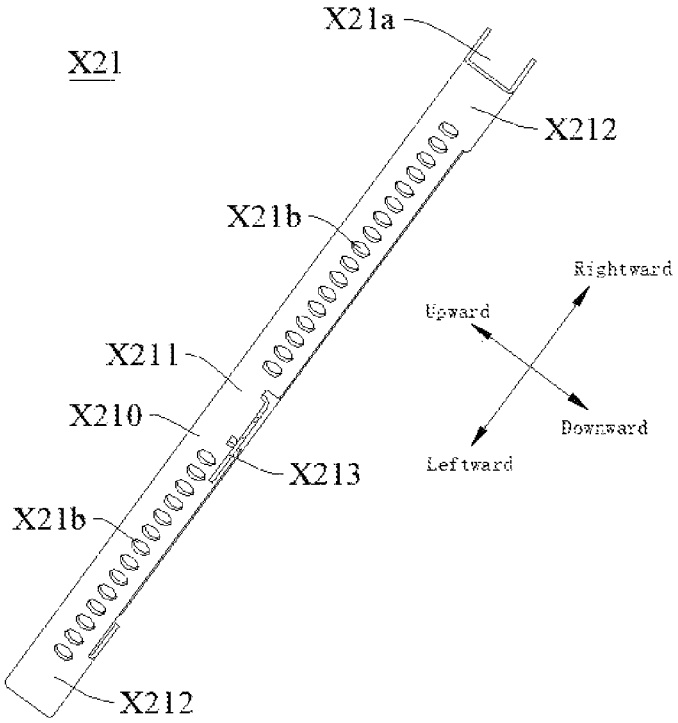
FIG. 14 is a schematic view of a main frame illustrated in FIG. 13.

In some embodiments, as illustrated in FIG. 12 to FIG. 14, the main frame X21 has a sliding groove X21*a* extending in the transverse direction and opened at both transverse ends thereof, and the frame rod X221 is introduced into the sliding groove X21*a* in such a manner that the frame rod X221 is withdrawable relative to the main frame X21 in the transverse direction. The sliding groove X21*a* can guide a movement of the frame rod X221 in the transverse and facilitate a rapid adjustment of the transverse length of the positioning unit X2. Here, the stop rod X222 is stopped outside the sliding groove X21*a*. Therefore, during pulling the frame rod X221 relative to the main frame X21 in the transverse direction, the stop rod X222 may always be properly outside the sliding groove X21*a* to facilitate withdrawable operation through the stop rod 221 by the user.

It should be understood that the stop rod X222 may be stopped outside the sliding groove X21*a* by a transverse end part of the sliding groove X21*a*. For example, in a plane perpendicular to the transverse direction, at least a part of an orthographic projection of the stop rod X222 may be located outside an orthographic projection of the sliding groove X21*a*. Of course, the stop rod X222 may also be stopped outside the sliding groove X21*a* in other ways.

For example, as illustrated in FIG. 13 and FIG. 14, the main frame X21 includes a main body segment X211 and two end segments X212. The two end segments X212 are located at both transverse ends of the main body segment X211, respectively. Here, the main body segment X211 has an open bottom surface, which is conducive to reducing a contact area between the main body segment X211 and the frame rod X221, thereby alleviating friction between the frame rod X221 and the main body segment X211 and improving an adjustment of the transverse length of the positioning unit X2. In addition, it is possible to attenuate noises generated by the friction between the frame rod X221 and the main body segment X211, and form the main body segment X211 into a one-piece member. For example, the main body segment X211 may be bent and formed from a single plate as a whole, and the two end segments X212 each have a closed bottom surface, such that when the frame rod X221 is introduced into the sliding groove X21*a*, the frame rod X221 can be supported at the bottom wall of the end segment X212 to ensure a reliable engagement between the frame rod X221 and the main frame X21, thereby preventing the frame rod X221 from falling off the main frame X21.

In an example illustrated in FIG. 13, the main body segment X211 has an open bottom surface and a closed top surface and is closed on both inner and outer sides, such that a cross section of the main body segment X211 is formed into a shape of ⊏. The end segment X212 is opened on a side thereof facing towards the outdoor space and closed on a side facing away from the outdoor space and has a closed top surface and a closed bottom surface, such that a cross section of the end segment X212 is formed into a shape of ⊏. Therefore, the main frame X21 has a simple structure and good support ability, and may be formed as a one-piece member. For example, the main frame X21 may be bent and formed from a single plate as a whole for easy processing of the main frame X21. Here, the "shape of ⊏" should be understood as a square with three sides.

In some embodiments, as illustrated in FIG. 13, any cross section of the main frame X21 is ⊏-shaped, which is conducive to saving an amount of material used for the main frame X21, lowering costs, and ensuring bending resistance and structural strength of the main frame X21. In addition, the main frame X21 may be bent and formed from a single plate as a whole for easy processing of the main frame X21.

In some embodiments, as illustrated in FIG. 12, FIG. 14, and FIG. 17, the main frame X21 has a plurality of first positioning holes X21*b* formed in an indoor side wall surface X210 thereof, and the plurality of first positioning holes X21*b* are spaced apart from each other in the transverse direction. The frame rod X221 has a second positioning hole X221*c* formed in each of an indoor side wall surface 2211 and an outdoor side wall surface 2212 thereof, and the second positioning hole X221*c* is adapted to be fixedly connected to any one of the plurality of first positioning holes X21*b* by the connection member X4. In this manner, positions of the main frame X21 and the frame rod X221 may be limited in the transverse direction to keep the transverse length of the positioning unit X2 at a predetermined value. In addition, it is possible to facilitate adjusting and fixing, by the operator in the indoor space, the transverse length of the positioning unit X2. Here, the second positioning hole X221*c* and the first positioning hole X21*b* may be adapted to be detachably connected to each other by the connection member X4. The second positioning hole X221*c* is adapted to be connected to any one of the plurality of first positioning holes X21*b* by the connection member X4. Therefore, the second positioning hole X221*c* may be fixedly connected to different first positioning holes X21*b* by the connection member X4 to provide an adjustable transverse length for the positioning unit X2.

Optionally, one second positioning hole X221*c* may be provided for simplifying fabrication steps of the frame rod X221. Of course, a plurality of second positioning holes X221*c* may also be provided and spaced apart from each other in the transverse direction.

Optionally, the connection member X4 is a screw, but is not limited thereto.

In some embodiments, as illustrated in FIG. 12, FIG. 15, and FIG. 16, the plurality of sub-frames X22 at least include a first sub-frame X22*a* and a second sub-frame X22*b*, and a total transverse length of a frame rod X221 of the first sub-frame X22*a* and a frame rod X221 of the second sub-frame X22*b* is equal to the transverse length of the main frame X21, i.e., L1'+L2'=L. When the first sub-frame X22*a* and the second sub-frame X22*b* are engaged with the main frame X21 at both transverse sides of the main frame X21, it is convenient to make the minimum value of the transverse length of the positioning unit X2 approximate the transverse length of the main frame X21 to all the transverse length of the positioning unit X2 to have the minimum value, thereby helping to improve the utilization rate of the transverse length of the positioning unit X2, and avoiding a specific transverse length value of the positioning unit X2 from not be used due to mismatching with the window opening 2001 and the window frame 2002.

It should be understood that the transverse length of the first sub-frame X22*a* may be equal or unequal to the transverse length of the second sub-frame X22*b*.

In some embodiments, as illustrated in FIG. 11 and FIG. 12, a transverse middle position of the main frame X21 has a mounting platform X213 provided thereon. The mounting platform X213 is adapted to mount a level instrument 300. Such a manner facilitates mounting of the level instrument 300, thereby realizing horizontal mounting of the mounting bracket 100. In addition, it is possible to assist in ensuring accuracy of the level instrument 300. Therefore, during mounting of the mounting bracket 100, the level instrument 300 may be mounted at the mounting platform X213 to measure an inclination angle of the main frame X21 relative to a horizontal direction and realize the horizontal mounting of the main frame X21, thereby facilitating horizontal mounting of the mounting bracket 100, ensuring the window air conditioner 200 to be stably supported at the mounting bracket 100, and avoiding a slip tendency of the window air conditioner 200 due to an inclination of the mounting bracket 100.

For example, in an example illustrated in FIG. 12, the mounting platform X213 may be formed into a flat plate structure and may extend indoors from a lower edge of the main frame X21. The mounting platform X213 may have two mounting grooves 213*a* formed in both lateral sides thereof, respectively. Each mounting groove 13*a* is adapted to be engaged with a support of the level instrument 300 to facilitate stable mounting of the level instrument 300.

For example, as illustrated in FIG. 11, the plurality of support units X1 is provided and spaced apart from each other in the transverse direction. Each support unit X1 is adapted to fix and support the window air conditioner 200, such that structural strength and structural stability of the mounting bracket 100 can be improved to further ensure reliable mounting of the window air conditioner 200. It should be understood that the plurality of support units X1 may have a same structure or different structures.

As illustrated in FIG. 11, and in connection with FIG. 43 and FIG. 45, each of the plurality of support units X1 includes a support frame X11. The support frame X11 extends in the inside-outside direction (e.g., the forward-backward direction in FIG. 11) and is adapted to pass through the window opening 2001 in such a manner that one part of the support frame X11 is arranged indoors and the other part of the support frame X11 is arranged outdoors. Therefore, the support frame X11 includes a first part X11*a* and a second part X11*b* that are arranged in the inside-outside direction. The first part X11*a* is adapted to be arranged outdoors and the second part X11*b* is adapted to be arranged indoors. Each support unit X1 includes a support leg X12. The support leg X12 is adapted to be arranged outdoors and has an upper end connected to the part of the support frame X11 located outdoors, e.g., the first part X11*a* of the support frame X11, and a lower end directly or indirectly abutting against the outer wall surface R of the wall body 2000. The support leg X12 may provide support for the support frame X11, which is advantageous to improve the stability of the mounting bracket 100. The part of the support frame X11 located indoors, e.g., the second part X11*b* of the support frame X11, may be connected to the main frame X21, and the main frame X21 is adapted to be in a positioning fit with the window opening 2001 and/or the window frame 2002, thereby realizing the stable mounting of the mounting bracket 100.

Here, the support leg X12 is angled relative to the support frame X11 to allow a stable support arrangement, e.g., a triangular arrangement, to be formed by the support unit X1 and the wall body 2000 together, thereby ensuring structural stability of the support unit X1.

Optionally, in an example illustrated in FIG. 11, the support frame X11 is formed into a one-piece member to reduce assembly steps of the support frame X11 and improve the mounting efficiency of the mounting bracket 100. For example, the support frame X11 is formed into a bent member, and the entire support frame X11 is bent and formed from a single plate as a whole. Of course, the support frame X11 may also be formed into a split member. In this case, the support frame X11 may include a plurality of support members that may be connected to each other by means of assembling.

Optionally, in the example illustrated in FIG. 11, the lower end of the support leg X12 may have a support foot X13 provided thereon, and the support foot X13 is adapted to abut against the outer wall surface R of the wall body 2000 to allow the lower end of the support leg X12 to indirectly abut against the outer wall surface R of the wall body 2000. In this case, it is convenient to ensure a sufficient support area between the support foot X13 and the wall body 2000. For example, the support foot X13 and the wall body 2000 are in planar contact with each other, which not only ensures that the support leg X12 stably supports the support frame X11, but also assists in simplifying a structure of the support leg X12.

For example, as illustrated in FIG. 13, the support foot X13 includes a body mounted at the support leg X12 and a cladding wrapping around the body. The support foot X13 is adapted to abut against the outer wall surface R of the wall body 2000 with the cladding. Here, the body is a sheet metal part and the cladding is a rubber member.

Further, in the examples illustrated in FIG. 11 and FIG. 12, and in connection with FIG. 43, a plurality of support units X1 are provided. The mounting bracket 100 further includes a connection unit X3 adapted to be arranged outdoors and connected to a part of the support frame X11 of each of the plurality of support units X1 arranged outdoors, e.g., the first part X11*a*, which is conducive to further improving the support stability of the mounting bracket 100.

Some embodiments of a mounting bracket 100 in the present disclosure will be described below with reference to FIG. 18 to FIG. 28.

Figure 18:
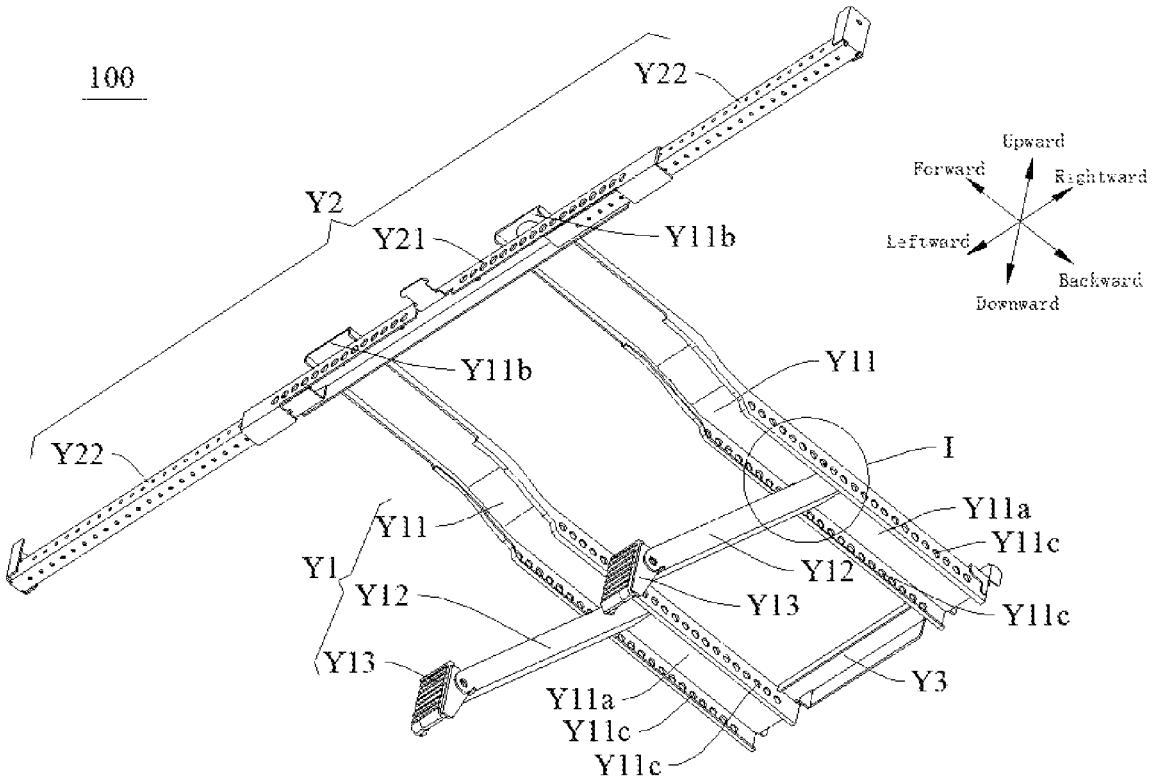
FIG. 18 is a schematic view of a mounting bracket for a window air conditioner according to an embodiment of the present disclosure.

As illustrated in FIG. 18, a mounting bracket 100 includes at least one support unit Y1. That is, the mounting bracket 100 includes one or more support units Y1. In a case where the mounting bracket 100 includes a plurality of support units Y1, it is conducive to improving structural strength and structural stability of the mounting bracket 100 and ensuring that the mounting bracket 100 has sufficient support strength for the window air conditioner 200.

As illustrated in FIG. 18, the support unit X1 includes a support frame Y11 and a support leg Y12. The support frame Y11 extends in an inside-outside direction (e.g., a forward-backward direction in FIG. 18) and is adapted to be at least partially arranged outdoors. Therefore, a part of the support frame Y11 is adapted to be arranged outdoors, or the entire support frame Y11 is adapted to be arranged outdoors. That is, the support frame Y11 includes at least a first part Y11*a* adapted to be arranged outdoors. The support leg Y12 is adapted to be arranged outdoors. The support leg Y12 has an upper end connected to the part of the support frame Y11 located outdoors and a lower end adapted to directly or indirectly abut against the outer wall surface R of the wall body 2000. Therefore, the support leg Y12 may provide support for the support frame Y11, which is advantageous to improve the stability of the mounting bracket 100. Here, the support leg Y12 may be angled relative to the support frame Y11 to allow a stable support arrangement, e.g., a triangular arrangement, to be formed by the support unit Y1 and the wall body 2000, thereby ensuring structural stability of the support unit Y1.

Figure 19:
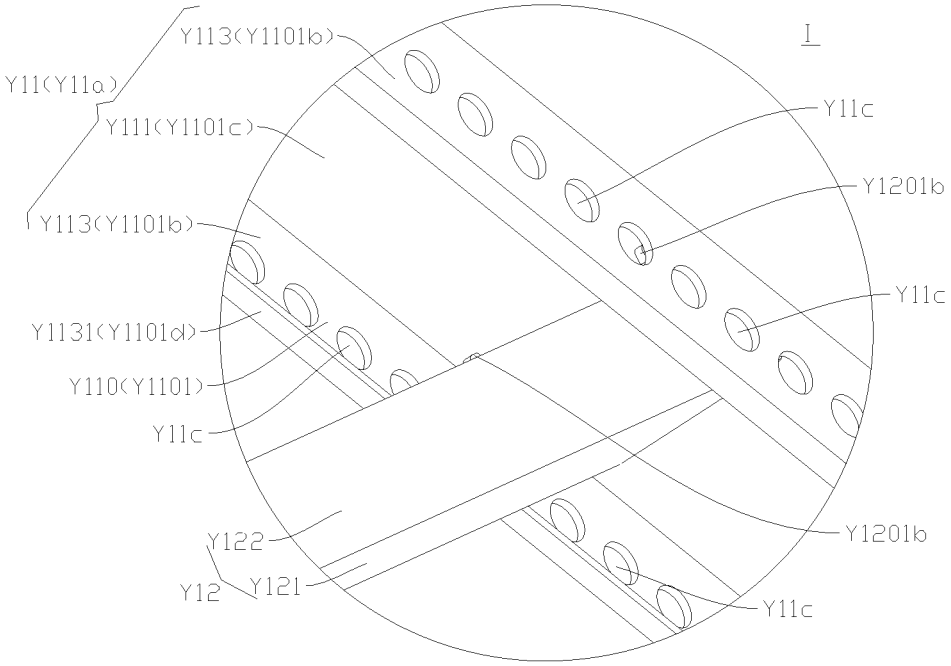
FIG. 19 is an enlarged view of part I circled in FIG. 18.
Figure 20:
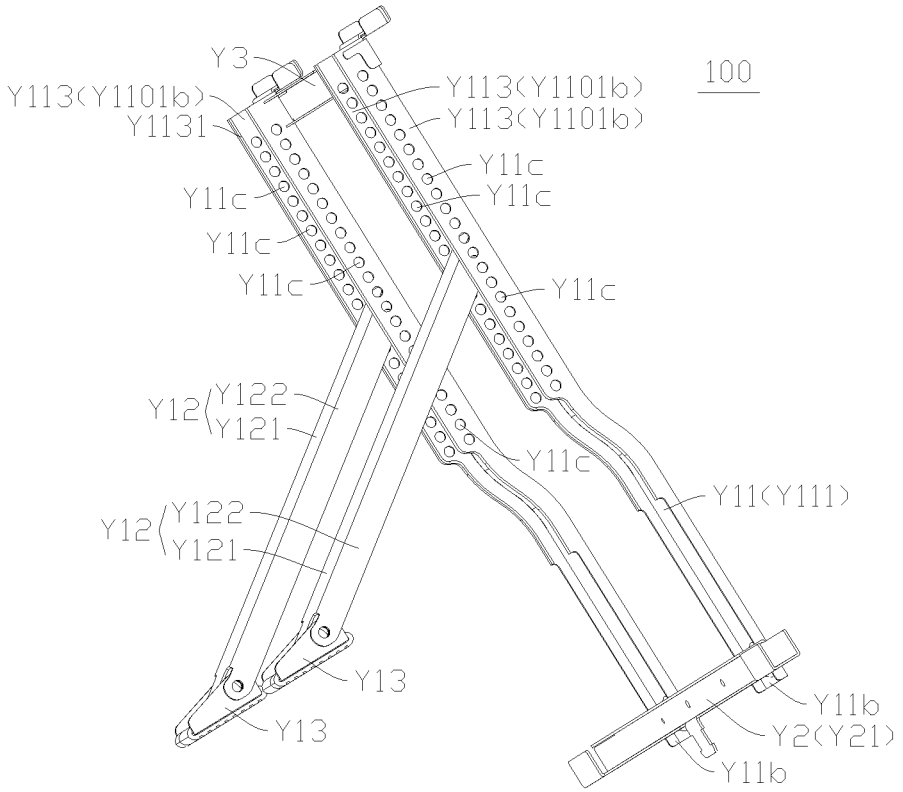
FIG. 20 is another schematic view of the mounting bracket illustrated in FIG. 18.
Figure 23:
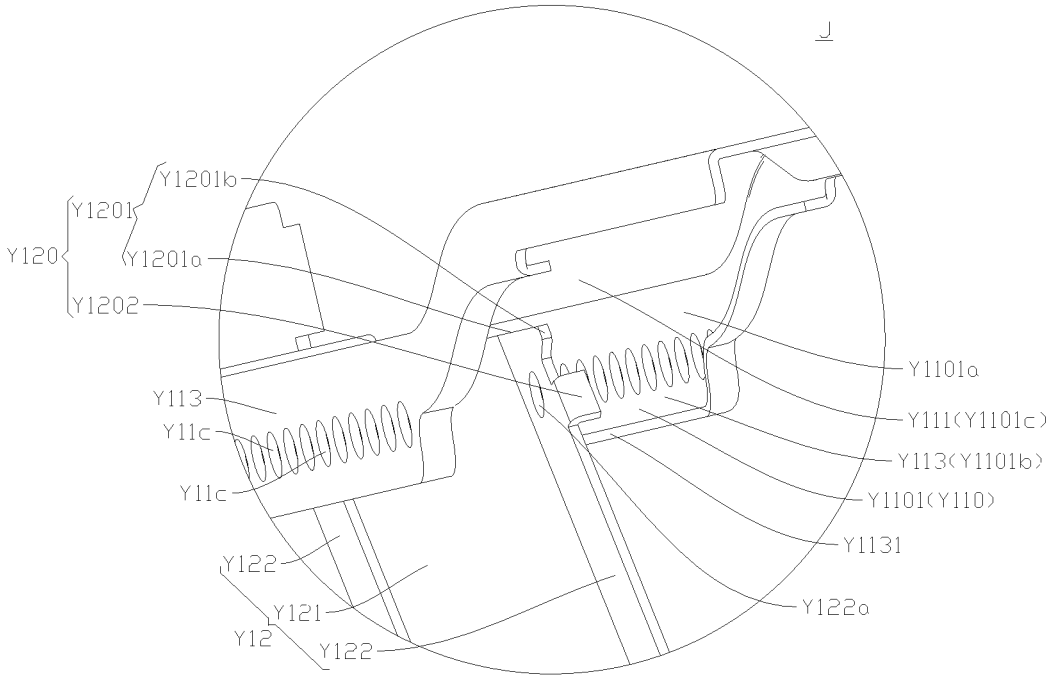
FIG. 23 is an enlarged view of part J circled in FIG. 22.

As illustrated in FIG. 19 and FIG. 23, and in connection with FIG. 45, both sides of the wall body 2000 in a thickness direction thereof are an indoor side 2004 and an outdoor side 2005, respectively. Both the first part Y11*a* of the support frame Y11 and the support leg Y12 are adapted to be arranged at the outdoor side 2005. The part of the support frame Y11 located outdoors, e.g., the first part Y11*a* of the support frame Y11, has a first limiting structure Y110. The support leg Y12 has a second limiting structure Y120 provided at an upper end thereof. The second limiting structure Y120 and the first limiting structure Y110 are configured to cooperate with each other in a limiting manner to limit a maximum included angle between the support leg Y12 and the support frame Y11 facing towards the indoor side 2004. Therefore, it is possible to prevent a rotation angle of the support leg Y12 relative to the support frame Y11 in a direction facing away from the wall body 2000 from exceeding the maximum included angle. For example, if the maximum included angle is αmax, the second limiting structure Y120 and the first limiting structure Y110 cooperate with each other to perform a limiting operation, so as to prevent the included angle α between the support leg Y12 and the support frame Y11 facing towards the indoor side 2004 from exceeding αmax.

Therefore, during the assembly of the support leg Y12 and the support frame Y11, the support leg Y12, under its own gravity, may make the included angle between the support leg Y12 and the support frame Y11 facing towards the indoor side 2004 to be the maximum included angle as described above through position-limiting cooperation between the first limiting structure Y110 and the second limiting structure Y120. That is, α=αmax, in which case the support leg Y12 cannot rotate, relative to the support frame Y11 around a connection part between the support leg Y12 and the support frame Y11 in the direction facing away from the wall body 2000. That is, the support leg Y12 cannot rotate relative to the support frame Y11, so that a exceed αmax, and thus the support leg Y12 may be kept in a state where the included angle between the support leg Y12 and the support frame Y11 facing towards the indoor side 2004 is the maximum included angle. Therefore, the support leg Y12 may be arranged without an additional limiting device, or it is unnecessary to hold the support leg Y12 for a long time, thereby facilitating a subsequent connection between the support leg Y12 and the support frame Y11, facilitates an operation, helps to improve the mounting efficiency of the mounting bracket 100. In addition, it is also possible to assist in improving the stability of the above-mentioned stable support arrangement to ensure stable support for the mounting bracket 100. Moreover, it is convenient to ensure accuracy of the connection between the support leg Y12 and the support frame Y11.

Optionally, the support leg Y12 and the support frame Y11 may be subsequently connected to each other by a connection-fixation member (a screw, etc.). However, the present disclosure is not limited in this regard.

Of course, through the position-limiting cooperation between the first limiting structure Y110 and the second limiting structure Y120, the mounting bracket 100 may still limit a relative rotation between the support leg Y12 and the support frame Y11 to a certain extent even when the fixing member between the support leg Y12 and the support frame Y11 is loose or even falls off during mounting or use, such that the mounting bracket 100 can still stably support the window air conditioner 200, thereby further enhancing the support stability of the mounting bracket 100.

Therefore, the second limiting structure Y120 on the support leg Y12 and the first limiting structure Y110 on the support frame Y11 cooperate with each other to perform the limiting operation, so as to limit the maximum included angle between the support leg Y12 and the support frame Y11 facing towards the indoor side 2004, such that it is convenient to limit positions of the support leg Y12 and the support frame Y11 before the support leg Y12 is connected to the support frame Y11, thereby facilitating the subsequent connection between the support leg Y12 and the support frame Y11, and increasing the mounting efficiency of the mounting bracket 100. In addition, the support stability of the mounting bracket 100 is improved, such that stable mounting of the window air conditioner 200 can be implemented to prevent the window air conditioner 200 from easily falling off from the window opening 2001, thereby facilitating a realization of the safe use of the window air conditioner 200.

Here, the "included angle α between the support leg Y12 and the support frame Y11 facing towards the indoor side 2004" may be understood as an included angle between a center line of the support leg Y12 and a center line of the support frame Y11 facing towards the indoor side 2004. Similarly, "an included angle α' between the support leg Y12 and the support frame Y11 facing away from the indoor side 2004" described later may be understood as an included angle between the center line of the support leg Y12 and the center line of the support frame Y11 facing away from the indoor side 2004.

It should be understood that a specific range of values of the maximum included angle is not limited in the present disclosure and may be set as desired. For example, the maximum included angle may be generally, but is not limited to, an acute angle. For example, in an example illustrated in FIG. 21, and in connection with FIG. 43, the support leg Y12 is adapted to have a tilted arrangement with respect to the vertical direction. Therefore, the support leg Y12 has a tendency to rotate towards a vertically-arranged state under its own gravity. The maximum included angle αmax between the support leg Y12 and the support frame Y11 facing towards the indoor side 2004 may be an acute angle. The acute angle may allow the support leg Y12 to better abut against the outer wall surface R of the wall body 2000. The support leg Y12 is easy to be kept in the tilted arrangement under its own gravity by the position-limiting cooperation between the first limiting structure Y110 and the second limiting structure Y120, thereby facilitating the subsequent connection between the support leg Y12 and the support frame Y11.

In some embodiments, as illustrated in FIG. 19 and FIG. 23, the support frame Y11 has two limiting grooves Y1101 that are spaced apart from each other in a transverse direction (e.g., in a leftward-rightward direction in FIG. 18). Each of the two limiting grooves Y1101 extends in an inside-outside direction (e.g., in a leftward-rightward direction in FIG. 18). The limiting groove Y1101 is adapted to be at least partially arranged outdoors. Therefore, one part of the limiting groove Y1101 is adapted to be arranged outdoors and the other part of the limiting groove Y1101 is adapted to be arranged indoors. Alternatively, the entire limiting groove Y1101 is adapted to be arranged outdoors (e.g., as illustrated in FIG. 18, and in connection with FIG. 43 and FIG. 45). Each of the two limiting grooves Y1101 has an opening Y1101*a* on one side thereof and a side wall Y1101*b* on the other side thereof in the transverse direction, and serves as the first limiting structure Y110. Therefore, the support frame Y11 has two first limiting structures Y110, which facilitate ensuring a more balanced force to be exerted on the support frame Y11 in the transverse direction.

Here, the two openings Y1101*a* may be located at opposite sides of the two limiting grooves Y1101, respectively, or the two openings Y1101*a* may be located at a same side of the two limiting grooves Y1101 in the transverse direction. For example, in examples illustrated in FIG. 19 and FIG. 23, the openings Y1101*a* are located at opposite sides of the two limiting grooves Y1101, respectively.

As illustrated in FIG. 19 and FIG. 23 to FIG. 26, the second limiting structure Y120 is assembled in the limiting groove Y1101 through the opening Y1101*a*, and includes an upper limiting member Y1201 abutting against a top wall Y1101*c* of the limiting groove Y1101 and a lower limiting member Y1202 abutting against a bottom wall Y1101*d* of the limiting groove Y1101. Therefore, through cooperation between the upper limiting member Y1201 and the lower limiting member Y1202, the positions of the support leg Y12 and the support frame Y11 may be further limited before the support leg Y12 is connected to the support frame Y11. In this manner, when the support leg Y12 is engaged with the support frame Y11, i.e., when the upper limiting member Y1201 abuts against the top wall Y1101*c* of the limiting groove Y1101 and the lower limiting member Y1202 abuts against the bottom wall Y1101*d* of the limiting groove Y1101, the support leg Y12 may not spontaneously rotate, under its own gravity, relative to the support frame Y11 in a direction facing away from the indoor side 2004, such that the support leg Y12 and the support frame Y11 can be fixedly connected to each other.

Figure 21:
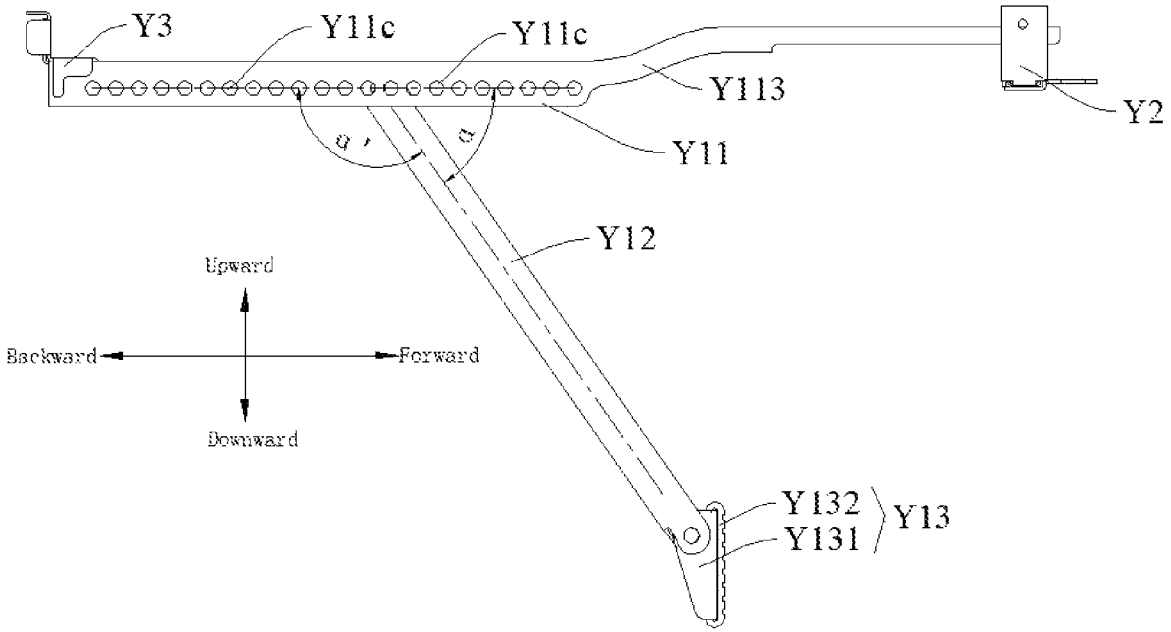
FIG. 21 is yet another schematic view of the mounting bracket illustrated in FIG. 18.

For example, in examples illustrated in FIG. 21 and FIG. 23, and in connection with FIG. 43 and FIG. 45, the support leg Y12 may have the tilted arrangement relative to the vertical direction. The maximum included angle αmax between the support leg Y12 and the support frame Y11 facing towards the indoor side 2004 may be an acute angle. The support leg Y12 has a tendency to rotate, relative to the support frame Y11, in a direction facing away from the indoor side 2004. That is, the included angle α between the support leg Y12 and the support frame 11 facing towards the indoor side 2004 has an increased tendency. When the upper limiting member Y1201 abuts against the top wall Y1101*c* of the limiting groove Y1101 and the lower limiting member Y1202 abuts against the bottom wall Y1101*d* of the limiting groove Y1101, the included angle αbetween the support leg Y12 and the support frame Y11 facing towards the indoor side 2004 may be αmax. Therefore, the upper limiting member Y1201 and the lower limiting member Y1202 may limit the above movement tendency of the support leg Y12 to prevent a from exceeding αmax, thereby facilitating making the support leg Y12 stay, when not subjected to other external forces, in a current tilted state.

Optionally, in an example illustrated in FIG. 23, the support leg Y12 may also include two second limiting structures Y120. The two second limiting structures Y120 may cooperate with the two first limiting structures Y110 in a one-to-one correspondence to limit the positions of the support leg Y12 and the support frame Y11

After reading the above technical solutions, it is conceivable for those skilled in the art to properly determine relative positions of the upper limiting member Y1201 and the lower limiting member Y1202. For example, the relative positions of the upper limiting member Y1201 and the lower limiting member Y1202 in the inside-outside direction may be properly determined in such a manner that when the upper limiting member Y1201 abuts against the top wall Y1101*c* of the limiting groove Y1101 and the lower limiting member Y1202 abuts against the bottom wall Y1101*d* of the limiting groove Y1101, the maximum included angle between the support leg Y12 and the support frame Y11 facing towards the indoor side 2004 may be limited. Therefore, the support leg Y12 cannot rotate in the direction facing away from the indoor side 2004 when the included angle α between the support leg Y12 and the support frame Y11 facing towards the indoor side 2004 is αmax under the gravity of the support leg Y12, such that one-way position limitation can be implemented. In this case, the support leg Y12 may be rotated towards the indoor side 2004.

Of course, those skilled in the art can also properly determine the relative positions of the upper limiting member Y1201 and the lower limiting member Y1202 in such a manner that the upper limiting member Y1201 and the lower limiting member Y1202 may cooperate with each other to limit not only the maximum included angle between the support leg Y12 and the support frame Y11 facing towards the indoor side 2004, but also the maximum included angle facing away from the indoor side 2004 between the support leg Y12 and the support frame Y11. In this manner, when an included angle α' facing away from the indoor side 2004 between the support leg Y12 and the support frame Y11 is α'max under the gravity of the support leg Y12, the support leg Y12 cannot rotate towards the indoor side 2004, thereby realizing two-way position limitation.

Optionally, in examples illustrated in FIG. 18, FIG. 43, and FIG. 45, two openings Y1101*a* are opened on two opposite sides of the two limiting grooves Y1101, respectively. Each of the two limiting grooves Y1101 is adapted to be located outdoors and has at least one open end in the inside-outside direction. In this case, each of the two limiting grooves Y1101 may be substantially formed as a guide rail to facilitate assembly of the second limiting structure Y120 from the open end of the limiting groove Y1101 into the limiting groove Y1101 and a movement, in an extension direction of the limiting groove Y1101, of the second limiting structure Y120 into an appropriate position. For example, the second limiting structure Y120 may moves in the extension direction of the limiting groove Y1101 to allow the lower end of the support leg Y12 to directly or indirectly abut against the outer wall surface R of the wall body 2000, thereby facilitating assembly of the support frame Y11 and the support leg Y12 and the mounting of the mounting bracket 100.

It should be understood that the support frame Y11 may also include one limiting groove Y1101. The support leg Y12 may also include one second limiting structure Y120.

Figure 25:
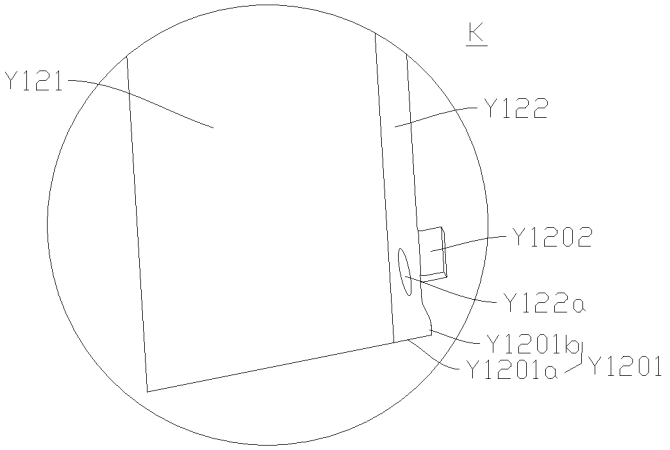
FIG. 25 is an enlarged view of part K circled in FIG. 24.
Figure 26:
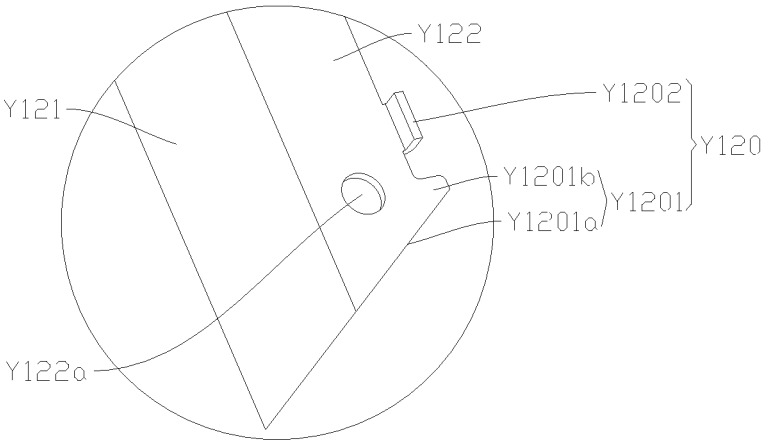
FIG. 26 is another partial schematic view of the support leg illustrated in FIG. 25.

Optionally, in examples illustrated in FIG. 25 and FIG. 26, the upper limiting member Y1201 and the lower limiting member Y1202 may be spaced apart from each other in an upward-downward direction to save an amount of fabrication material. Of course, the upper limiting member Y1201 and the lower limiting member Y1202 may also not be spaced apart from each other in the upward-downward direction.

Optionally, in an example illustrated in FIG. 23, the upper limiting member Y1201 may be in planar contact with the top wall Y1101*c* of the limiting groove Y1101, and the lower limiting member Y1202 may be in planar contact with the bottom wall Y1101*d* of the limiting groove Y1101, such that it is convenient to ensure reliability of position limitation of the first limiting structure Y110 and the second limiting structure Y120. Of course, the upper limiting member Y1201 may also be in linear contact with the top wall Y1101*c* of the limiting groove Y1101. For example, a plurality of contact lines may be formed between the upper limiting member Y1201 and the top wall Y1101*c* of the limiting groove Y1101. The lower limiting member Y1202 may also be in linear contact with the bottom wall Y1101*d* of the limiting groove Y1101. For example, a plurality of contact lines may be formed between the lower limiting member Y1202 and the bottom wall Y1101*d* of the limiting groove Y1101. However, the present disclosure is not limited in this regard.

In some embodiments, as illustrated in FIG. 23, the support leg Y12 includes two leg side plates Y122 that are spaced apart from each other in the transverse direction, and the lower limiting member Y1202 is arranged at an upper end of each of the two leg side plates Y122 to allow the lower limiting member Y1202 to be assembled within the limiting groove Y1101. Here, the lower limiting member Y1202 is located at a side of the leg side plate Y122 close to the indoor space. In this case, when the lower limiting member Y1202 abuts against the bottom wall Y1101*d* of the limiting groove Y1101, the lower limiting member Y1202 may prevent the support leg Y12 from being rotated towards the direction facing away from the indoor side 2004, thereby ensuring that the position-limiting cooperation between the second limiting structure Y120 and the first limiting structure Y110 can limit the maximum included angle between the support leg Y12 and the support frame Y11 facing towards the indoor side 2002.

For example, in an example illustrated in FIG. 23, each leg side plate Y122 has the second limiting structure Y120 provided thereon. Therefore, the support leg Y12 has two second limiting structures Y120, and the two second limiting structures Y120 may cooperate with the two first limiting structures Y110 on the support frame Y11 in a one-to-one correspondence to limit the positions of the support leg Y12 and the support frame Y11.

For example, in examples illustrated in FIG. 23, FIG. 25, and FIG. 26, the lower limiting member Y1202 extends towards the side wall Y1101*b* of the limiting groove Y1101 in the transverse direction, such that it is easy for the lower limiting member Y1202 to abut against the bottom wall Y1101*d* of the limiting groove 1102 to provide the position limitation.

For example, in the example illustrated in FIG. 23, two openings Y1101*a* are opened on opposite sides of the two limiting grooves Y1101, respectively. The two leg side plates Y122 are located between the bottom walls Y1101*d* of the two limiting grooves Y1101. The lower limiting member Y1202 may extend transversely beyond a surface of the leg side plate Y122 in a thickness direction and abut against the bottom wall Y1101*d* of the limiting groove Y1101.

For example, the lower limiting member Y1202 may extend transversely from an edge of the leg side plate Y122 on a side close to the indoor space. In this case, the edge of the leg side plate Y122 on the side close to the indoor space is connected to an edge of the lower limiting member Y1202 on a side facing away from the side wall Y1101*b* of the limiting groove Y1101 to facilitate forming the leg side plate Y122 and the lower limiting member Y1202 as a one-piece member. For example, an entirety formed by the leg side plate Y122 and the lower limiting member Y1202 may be formed by bending a single plate, thereby facilitating the processing of the support leg Y12.

Of course, the edge of the leg side plate Y122 on the side close to the indoor space may also be connected between both transversal ends of the lower limiting member Y1202.

In some embodiments, as illustrated in FIG. 23, FIG. 25, and FIG. 26, the upper limiting member Y1201 includes a support surface Y1201*a* and a first extension member Y1201*b*. The support surface Y1201*a* is a top surface of the leg side plate Y122, and the first extension member Y1201*b* extends from the upper end of the leg side plate Y122 towards the side of the leg side plate Y122 close to the indoor space. Therefore, the first extension member Y1201*b* is formed on the side of the leg side plate Y122 close to the indoor space. In this manner, it is convenient to ensure that a long stopping length in the inside-outside direction is formed between the upper limiting member Y1201 and the top wall Y1101*c* of the limiting groove Y1101, and ensure reliability of position limitation between the upper limiting member Y1201 and the top wall Y1101*c*.

Optionally, the support surface Y1201*a* may be formed as a flat surface and in planar contact with the top wall Y1101*c* of the limiting groove Y1101. Therefore, it is convenient to ensure a large stopping area between the support surface Y1201*a* and the top wall Y1101*c*, thereby improving reliability of position limitation of the upper limiting member Y1201.

Optionally, an upper surface of the first extension member Y1201*b* may be formed as a flat surface and in planar contact with the top wall Y1101*c* of the limiting groove Y1101. Therefore, it is convenient to ensure a large stopping area between the first extension member Y1201*b* and the top wall Y1101*c*, thereby improving reliability of position limitation of the first extension member Y1201*b*.

Optionally, in the examples illustrated in FIG. 25 and FIG. 26, the first extension member Y1201*b* is spaced above the lower limiting member Y1202. Such a manner facilitates saving an amount of fabrication material, thereby lowering the costs.

In addition, it should be understood that the upper limiting member Y1201 may also include only the support surface Y1201*a* and not include the first extension member Y1201*b*. In this case, the upper end of the leg side plate Y122 may be provided without the first extension member Y1201*b*. Through cooperation between the support surface Y1201*a* and the lower limiting member Y1202, it is also possible to limit the maximum included angle between the support leg Y12 and the support frame Y11 facing towards the indoor side 2004.

In the example illustrated in FIG. 23, the upper limiting member Y1201 includes the support surface Y1201*a* and the first extension member Y1201*b*. The support surface Y1201*a* is a top surface of the leg side plate Y122. The first extension member Y1201*b* extends from the upper end towards the side of the leg side plate Y122 close to the indoor space. Therefore, the first extension member Y1201*b* is formed on the side of the leg side plate Y122 close to the indoor space. The lower limiting member Y1202 extends from the edge of the leg side plate Y122 on the side close to the indoor space in the transverse direction. Therefore, the first extension member Y1201*b* and the lower limiting member Y1202 are both located at the side of the leg side plate Y122 close to the indoor space. Such a manner realizes flexible position-limiting cooperation between the first limiting structure 110 and the second limiting structure Y120, and thus the one-way position limitation or two-way position limitation of the support leg Y12 may be implemented as desired.

In some embodiments, as illustrated in FIG. 23, FIG. 25, and FIG. 26, the leg side plate Y122 has a fourth connection hole Y122*a* formed in an upper end thereof, and the limiting groove Y1101 has a plurality of fifth connection holes Y11*c* formed in the side wall Y1101*b* thereof. The plurality of fifth connection holes Y11*c* are spaced apart from each other in the inside-outside direction. For example, each limiting groove Y1101 of the support frame Y11 has a plurality of fifth connection holes Y11*c* formed in the side wall Y1101*b* thereof. Here, the fourth connection hole Y122*a* is adapted to be fixedly connected to any one of the plurality of fifth connection holes Y11*c* by the connection member Y4. Therefore, the positions of the support leg Y12 and the support frame Y11 may be limited in the inside-outside direction, so that the support leg Y12 at least cannot move relative to the support frame Y11 in the inside-outside direction, thereby ensuring the structural stability of the mounting bracket 100 to achieve stable support. Here, the fourth connection hole Y122*a* and the fifth connection hole Y11*c* are adapted to be detachably connected to each other by the connection member Y4. In this case, the fourth connection hole Y122*a* may be fixedly connected to a different fifth connection hole Y11*c* by the connection member Y4 for adjusting the relative positions of the support leg Y12 and the support frame Y11 in the inside-outside direction, such that the support unit Y1 can be applicable to wall bodies 2000 of different thicknesses, thereby improving the applicability of the mounting bracket 100. In addition, when the mounting position of the window air conditioner 200 in the inside-outside direction needs to be properly adjusted, the relative positions of the support leg Y12 and the support frame Y11 in the inside-outside direction can be adjusted to allow the support unit Y1 to support the window air conditioner 200 in a more stable manner.

Optionally, one fourth connection hole Y122*a* may be provided to simplify fabrication procedures of the leg side plate Y122. Of course, a plurality of fourth connection holes Y122*a* may also be provided and spaced apart from each other in the inside-outside direction.

Optionally, the connection member Y4 is a screw. However, the present disclosure is not limited in the regard.

In some embodiments, as illustrated in FIG. 19 and FIG. 23, the support frame Y11 includes a support plate Y111 and two mounting plates Y113. The support plate Y111 extends in the inside-outside direction and is adapted to be supported at a bottom of the window air conditioner 200. The two mounting plates Y113 are connected at a position below both lateral sides of the support plate Y111, respectively. Each of the two mounting plates Y113 has a flange Y1131 provided at a lower end thereof. The flange Y1131 is bent towards the other mounting plate Y113. The limiting groove Y1101 is formed among the flange Y1131, the mounting plate Y113, and the support plate Y111. The support plate Y111 is formed as the top wall Y1101*c* of the limiting groove Y1101. The mounting plate Y113 is formed as the side wall Y1101*b* of the limiting groove Y1101. The flange Y1131 is formed as the bottom wall Y1101*d* of the limiting groove Y1101. In this case, a cross section of at least a part of the support frame Y11 may be substantially formed into a shape of ⊏. Here, "the shape of ⊏" may be understood as a square with three sides.

Therefore, the support frame Y11 has a simple structure with good structural strength and bending resistance and may be easily formed as a one-piece member. For example, the support frame Y11 may be formed as a bending member. Also, the entire support frame Y11 is formed by bending a single plate. In this case, both the mounting plate Y113 and the flange Y1131 may be processed through the bending process, such that the processing of the support frame Y11 can be facilitated.

In examples illustrated in FIG. 18 and FIG. 19, the mounting plate Y113 is adapted to be arranged outdoors, and thus the limiting groove Y1101 is adapted to be arranged outdoors. Of course, the mounting plate Y113 may also have one part adapted to be arranged outdoors and another part adapted to be arranged indoors in such a manner that one part of the limiting groove Y1101 may be adapted to be arranged outdoors and the other part of the limiting groove Y1101 may be adapted to be arranged indoors.

In some embodiments, as illustrated in FIG. 18, and in connection with FIG. 43, each of the plurality of support units Y1 further includes a support foot Y13 connected to a lower end of a support leg Y12, and the support foot Y13 is adapted to be arranged outdoors to abut against the outer wall surface R of the wall body 2000, such that the lower end of the support leg Y12 may to indirectly abut against the outer wall surface R of the wall body 2000. In this manner, it is convenient to ensure a sufficient support area between the support foot Y13 and the wall body 2000, thereby achieving stable support of the support leg Y12. Further, such a manner is conducive to simplifying a structure of the support leg Y12 and facilitating a formation of the support leg Y12 as a one-piece member. For example, the support leg Y12 is in planar contact with the wall body 2000 and is angled relative to the support frame Y11 to allow a stable support arrangement, e.g., a triangular arrangement, to be formed by the support unit Y1 and the wall body 2000, thereby ensuring the structural stability of the support unit Y1.

Figure 27:
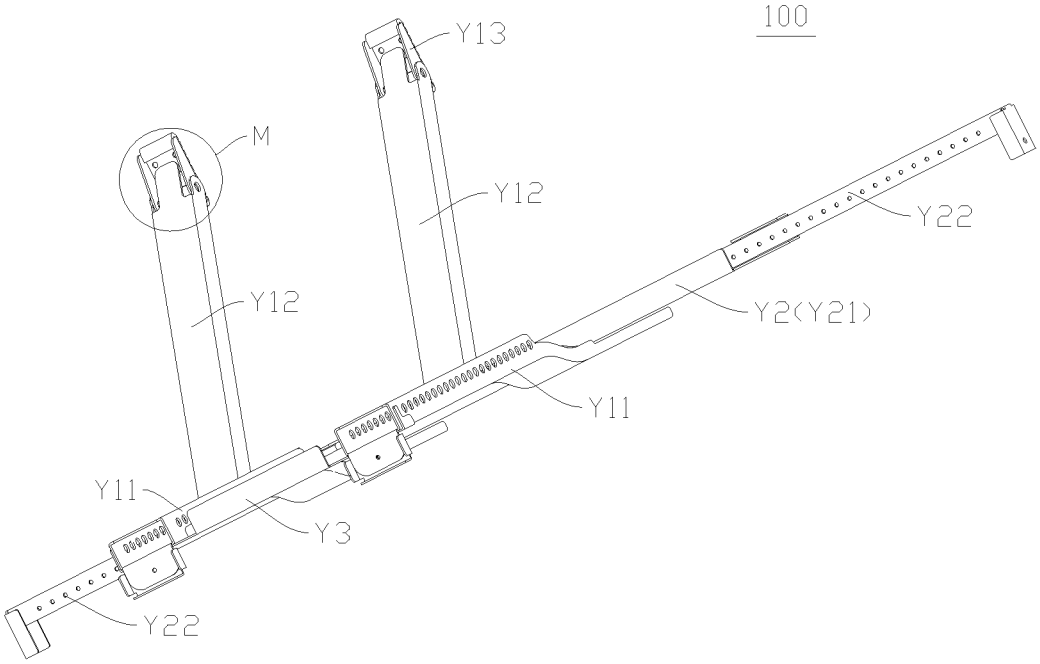
FIG. 27 is still yet another schematic view of a mounting bracket illustrated in FIG. 18.
Figure 28:
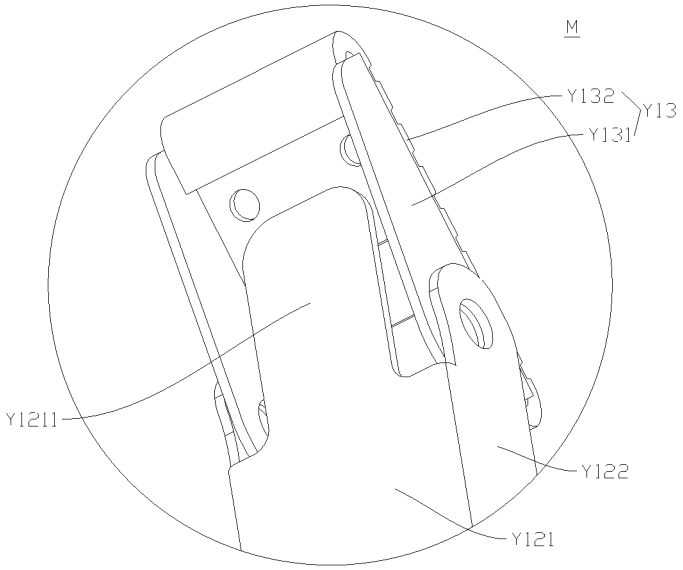
FIG. 28 is an enlarged view of part M circled in FIG. 27.

Here, as illustrated in FIG. 27 and FIG. 28, the support leg Y12 includes a leg panel Y121 and two leg side plates Y122 spaced apart from each other in the transverse direction. The leg panel Y121 is connected between the two leg side plates Y122. The leg panel Y121 has a second extension member Y1211 provided at a lower end thereof and adapted to abut against a side of the support foot Y13 facing away from the outer wall surface R of the wall body 2000. Therefore, support for the support leg Y12 may be realized through a connection position with the support leg Y12, and position limitation and further support for the support leg Y12 may be realized by the second extension member Y1211. Such a manner is conducive to further improving support stability of the support leg Y12.

Figure 22:
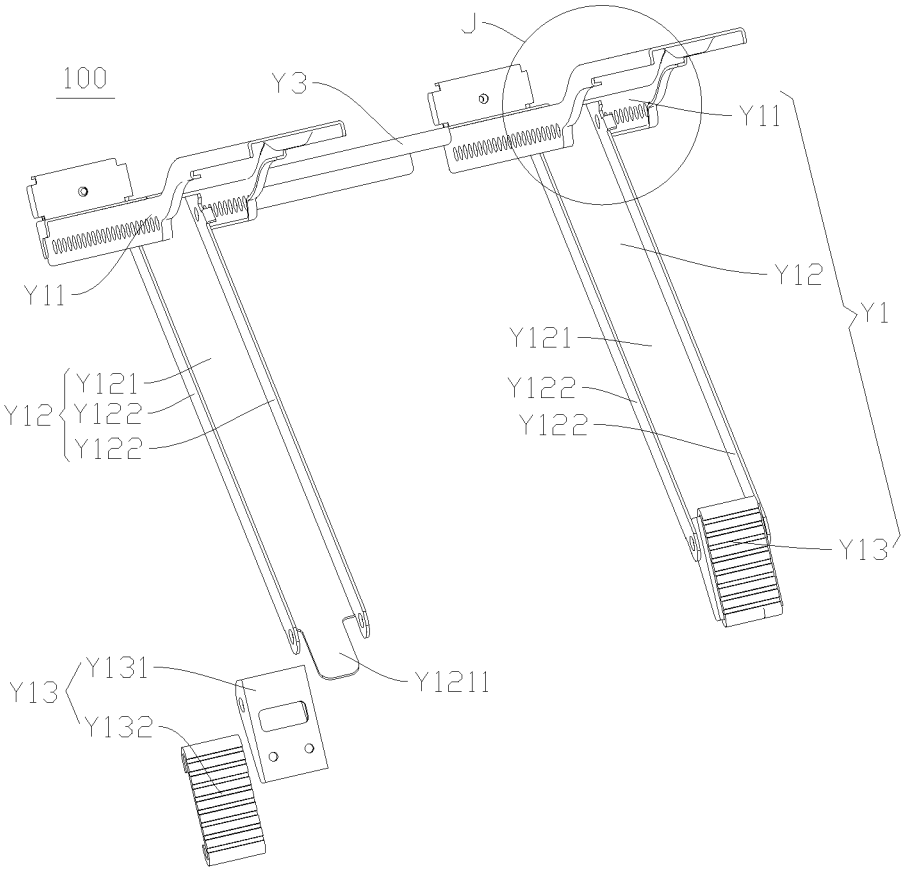
FIG. 22 is still yet another schematic view of the mounting bracket illustrated in FIG. 18.

For example, in examples illustrated in FIG. 22 and FIG. 28, the support foot Y13 includes a body Y131 mounted at the support leg Y12 and a cladding Y132. For example, the body Y131 may be mounted at the two leg side plates Y122 of the support leg Y12, and the cladding Y132 wraps around the body Y131. The support foot Y13 is adapted to abut against the outer wall surface R of the wall body 2000 with the cladding Y132, and the body Y131 may not directly abut against the outer wall surface R of the wall body 2000. Therefore, it is easy to achieve close contact between the support foot Y13 and the wall body 2000, thereby ensuring reliable abutment between the support foot Y13 and the wall body 2000 to avoid easy sliding, relative to the wall body 2000, of the support foot Y13. Here, the cladding Y132 wraps around a part of an outer surface of the body Y131, and the second extension member Y1211 is adapted to abut against the side of the body Y131 facing away from the outer wall surface R of the wall body 2000.

Optionally, the body Y131 is a sheet metal part and the cladding Y132 is a rubber member.

In some embodiments, as illustrated in FIG. 18 and FIG. 28, the support unit Y1 further includes the support foot Y13 connected to the lower end of the support leg Y12. The support foot Y13 is adapted to be arranged outdoors to abut against the outer wall surface R of the wall body 2000, thereby allowing the lower end of the support leg Y12 to indirectly abut against the outer wall surface R of the wall body 2000. Here, the support leg Y12 has the second extension member Y1211 provided at the lower end thereof and adapted to abut against a side of the support foot Y13 facing away from the outer wall surface R of the wall body 2000. Therefore, support for the support leg Y12 may be realized through the connection position with the support leg Y12, and position limitation and further support for the support leg Y12 may be realized by the second extension member Y1211. Such a manner is conducive to further improving the support stability of the support leg Y12.

It should be understood that the two leg side plates Y122 of the support leg Y12 may also be connected to each other by a plurality of connection ribs spaced apart from each other in an extension direction of the two leg side plates Y122.

Optionally, in examples illustrated in FIG. 18 and FIG. 23, the support frame Y11 is formed into a one-piece member to reduce assembly steps of the support frame Y11 and improve the mounting efficiency of the mounting bracket 100. For example, the support frame Y11 is formed into a bent member, and the entire support frame Y11 is bent and formed from a single plate. Of course, the support frame Y11 may also be formed into a split member. In this case, the support frame Y11 may include a plurality of support members that may be connected to each other by means of assembling.

Figure 24:
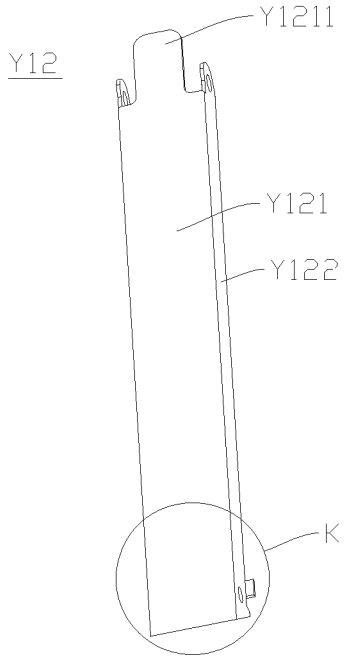
FIG. 24 is a schematic view of a support leg illustrated in FIG. 22.

Optionally, in an example illustrated in FIG. 24, the support leg Y12 is formed into a one-piece member to reduce assembly steps of the support leg Y12. For example, the support leg Y12 is formed into a bent member, and the entire support leg Y12 is bent and formed from a single plate.

In some embodiments, as illustrated in FIG. 18, and in connection with FIG. 43 and FIG. 45, the support frame Y11 is adapted to pass through the window opening 2001 in such a manner that a part of the support frame Y11 is adapted to be arranged indoors. Therefore, the support frame Y11 also includes a second part Y11*b* adapted to be arranged indoors. The mounting bracket 100 also includes a positioning unit Y2 adapted to be arranged indoors and connected to the part of the support frame Y11 located indoors, e.g., the second part Y11*b* of the support frame Y11. The positioning unit Y2 is adapted to be in a positioning fit with the window opening 2001 and/or the window frame 2002 disposed at the window opening 2001 to facilitate stable mounting of the support unit Y1 at the window opening 2001.

For example, the positioning unit Y2 is adapted to be in a positioning fit with the window opening 2001 to facilitate stable mounting of the positioning unit Y2 at the wall body 2000. The second part Y11*b* of the support unit Y11 is connected to the positioning unit Y2 to achieve stable mounting of the mounting bracket 100. Of course, when the mounting bracket 100 is in use, the positioning unit Y2 may also be in a positioning fit with the window frame 2002 at the window opening 2001, or the positioning unit Y2 may be in a positioning fit with both the window opening 2001 and the window frame 2002, such that the stable mounting of the mounting bracket 100 can also be realized.

As illustrated in FIG. 18, the positioning unit Y2 may include a main frame Y21 and a plurality of sub-frames Y22. Each of the main frame Y21 and the plurality of sub-frames Y22 extends in the transverse direction. Each of the plurality of sub-frames Y22 is capable of cooperating with the main frame Y21 in a withdrawable manner in the transverse direction to provide an adjustable length for the positioning unit Y2, such that the positioning unit Y2 can be applied to window openings 2001 and window frames 2002 of different sizes. Here, the plurality of sub-frames Y22 may be configured to cooperate with the main frame Y21 in a replaceable manner. The plurality of sub-frames Y22 can be used alternatively, so that the main frame Y21 has good universality. Therefore, it is possible to realize different adjustment ranges of transverse lengths of the positioning unit Y2, thereby assisting in further enhancing applicability of the positioning unit Y2. The plurality of sub-frames Y22 may have a same length or different lengths.

It should be understood that in the inside-outside direction, a length of the second part Y11*b* of the support frame Y11 may be shorter than a length of a first part Y11*a* of the support frame Y11, such that the mounting bracket 100 can be arranged to match a center of gravity of the window air conditioner 200 for ensuring the stability of the mounting of the window air conditioner 200.

Of course, when mounted at the window opening 2001, the support frame Y11 may also be mounted outdoors entirely. In this case, when the mounting bracket 100 includes the positioning unit Y2, the positioning unit Y2 is adapted to be at least partially arranged indoors and is directly or indirectly connected to the support frame Y11. For example, when the positioning unit Y2 is indirectly connected to the support frame Y11, a connection segment may be disposed between the positioning unit Y2 and the support frame Y11. The connection segment is connected to each of the positioning unit Y2 and the support frame Y11 to connect the positioning unit Y2 to the support frame Y11. In addition, when the positioning unit Y2 is directly connected to the support frame Y11, the positioning unit Y2 may partially extend outdoors to be connected to the support frame Y11. However, the present disclosure is not limited in this regard.

In some embodiments, as illustrated in FIG. 18, a plurality of support units Y1 are provided and arranged at interval in the transverse direction. The mounting bracket 100 also includes a connection unit Y3 adapted to be arranged outdoors. The connection unit Y3 is connected to a part, e.g., the first part Y11*a*, of the support frame Y11 of each of the plurality of support units Y1 located outdoors. Such a manner is conducive to further improving the support stability of the mounting bracket 100.

Some embodiments of a mounting bracket 100 in the present disclosure will be described below with reference to FIG. 29 to FIG. 36.

Figure 29:
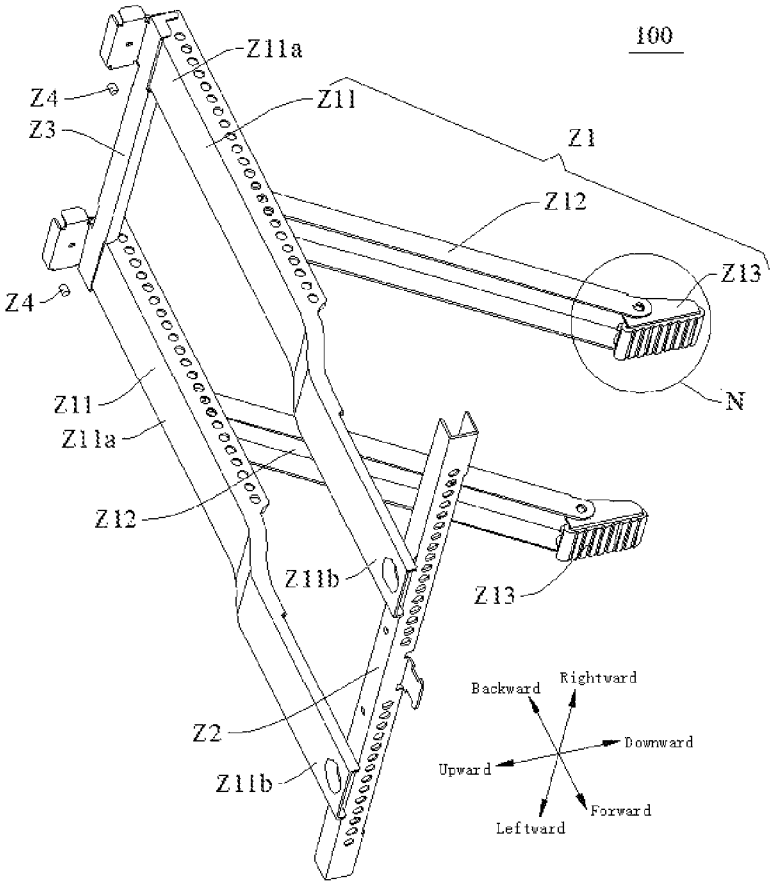
FIG. 29 is a schematic view of a mounting bracket for a window air conditioner according to an embodiment of the present disclosure.

As illustrated in FIG. 29, the mounting bracket 100 includes at least one support unit Z1. That is, the mounting bracket 100 includes one or more support units Z1. In a case where the mounting bracket 100 includes a plurality of support units Z1, it is conducive to improving structural strength and structural stability of the mounting bracket 100 and ensuring that the mounting bracket 100 has sufficient support strength for the window air conditioner 200.

The support unit Z1 includes a support frame Z11, a support leg Z12, and a support foot Z13. The support frame Z11 extends in an inside-outside direction (e.g., a forward-backward direction in FIG. 29) and is adapted to be at least partially arranged outdoors. Therefore, a part of the support frame Z11 is adapted to be arranged outdoors, or the entire support frame Z11 is adapted to be arranged outdoors. That is, the support frame Z11 includes at least a first part Z11*a* adapted to be arranged outdoors; and the support leg Z12 is adapted to be arranged outdoors. In addition, the support leg Z12 has an upper end connected to the part of the support frame Z11 located outdoors. The support foot Z13 is adapted to be arranged outdoors and connected to a lower end of the support leg Z12.

For example, as illustrated in FIG. 29, and in connection with FIG. 43 and FIG. 45, both sides of the wall body 2000 in a thickness direction thereof may be an indoor side 2004 and an outdoor side 2005, respectively. When the mounting bracket 100 is in use, the support frame Z11 may extend, through the window opening 2001, to the outdoor side 2005 in the thickness direction (e.g., a forward-backward direction in FIG. 43 and FIG. 45) of the wall body 2000. Therefore, the support frame Z11 includes at least a first part Z11*a* located outdoors. Both the support leg Z12 and the support foot Z13 are adapted to be arranged at the outdoor side 2005. The support leg Z12 has an upper end connected to the first part Z11*a* of the support frame Z11 and a lower end connected to the support foot Z13. The support foot Z13 is adapted to abut against an outer wall surface R of the wall body 2000 to ensure a large support area between the support foot Z13 and the wall body 2000. For example, the support foot 12 is in planar contact with the wall body 2000, and angled relative to the support frame Z11 to allow a stable support arrangement, e.g., a triangular arrangement, to be formed by the support unit Z1 and the wall body 2000 together, thereby ensuring structural stability of the support unit Z1.

Figure 30:
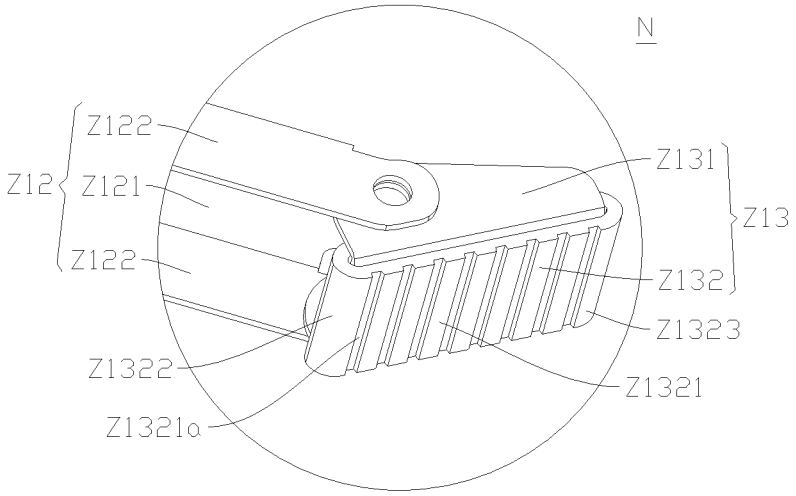
FIG. 30 is an enlarged view of part N circled in FIG. 29.
Figure 31:
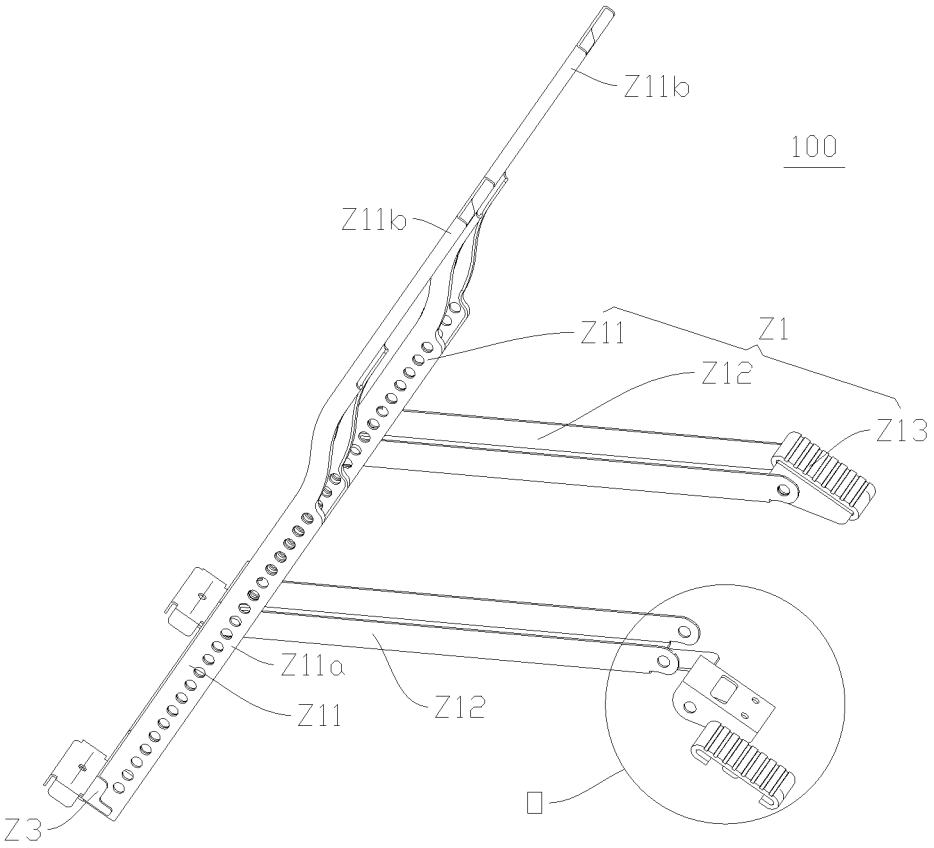
FIG. 31 is a partial schematic view of the mounting bracket illustrated in FIG. 29.

As illustrated in FIG. 30, and in connection with FIG. 43 and FIG. 45, the support foot Z13 includes a body Z131 mounted at the support leg Z12 and a cladding Z132 wrapped around the body Z131. The support foot Z13 is adapted to abut against the outer wall surface R of the wall body 2000 with the cladding Z132. Therefore, when the mounting bracket 100 is mounted at the window opening 2001, the cladding Z132 abuts against the outer wall surface R of the wall body 2000, and the body Z131 does not directly abut against the outer wall surface R of the wall body 2000. Therefore, the body Z131 and the cladding Z132 may be arranged flexibly. For example, a material used for fabrication may be selected suitably, a structure may be determined reasonably, etc., to ensure reliability of use of the support foot Z13. In addition, it is convenient to achieving close contact between the support foot Z13 and the wall body 2000 to ensure reliability of abutment between the support foot Z13 and the wall body 2000, such that the support foot Z13 can stably abut against the wall body 2000, thereby avoiding the support foot Z13 from sliding easily relative to the wall body 2000.

It should be understood that the cladding Z132 may wrap around an outer side of the body Z131. That is, the cladding Z132 may wrap an entire of an outer surface of the body Z131, or a part of the outer surface of the body Z131 (as illustrated in FIG. 30), as long as the cladding Z132 abuts against the outer wall surface R of the wall body 2000 and the body Z131 does not directly abut against the outer wall surface R of the wall body 2000 when the support foot Z13 abuts against the outer wall surface R of the wall body 2000.

Figure 32:
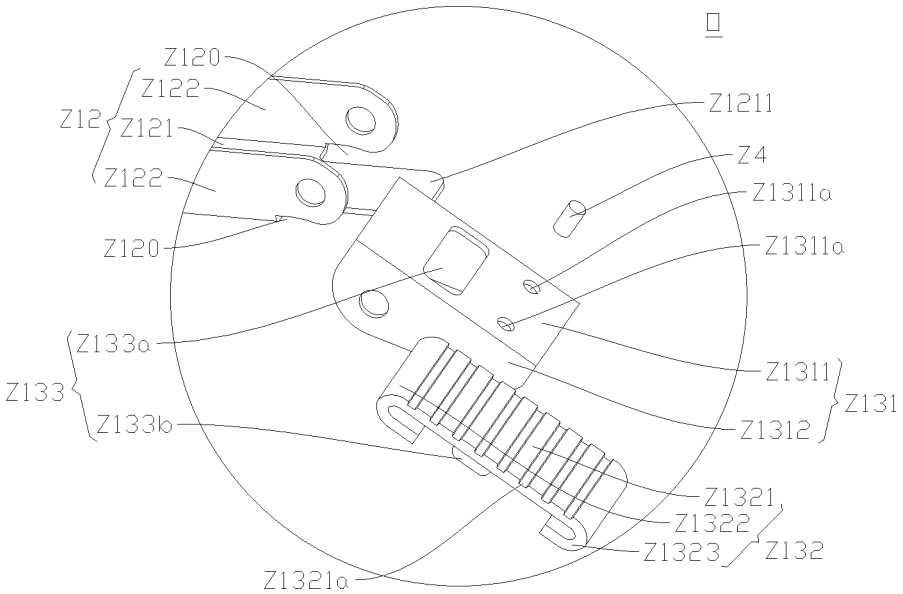
FIG. 32 is an enlarged view of part O circled in FIG. 31.

Here, as illustrated in FIG. 30 and FIG. 32, the body Z131 is in a positioning fit with the cladding Z132 by a positioning structure Z133 to ensure reliable engagement between the body Z131 and the cladding Z132. When the support foot Z13 abuts against the wall body 2000, a movement of the cladding Z132 relative to the body Z131 may be effectively reduced to prevent the cladding Z132 from easily sliding relative to the body Z131, which further facilitates preventing the support foot Z13 from easily sliding relative to the wall body 2000 and improves support stability of the support foot Z13. In addition, a prone to aging of the cladding Z132 due to sliding under a force may be effectively avoided, which is conducive to prolonging a service life of the support foot Z13. The positioning structure Z133 includes a positioning hole Z133*a* and a positioning protrusion Z133*b* engaged with the positioning hole Z133*a*. Such a manner simplifies the positioning structure Z133, facilitates processing of the positioning structure Z133 and a realization of a good load-bearing capacity of the positioning structure Z133, thereby ensuring support reliability of the support foot Z13.

It should be understood that, the positioning hole Z133*a* may be formed on the body Z131, and the positioning protrusion Z133*b* may be disposed on the cladding Z132. Alternatively, the positioning hole Z133*a* may be formed on the cladding Z132, and the positioning protrusion Z133*b* may be disposed on the body Z131.

Referring to FIG. 29, and in connection with FIG. 43 and FIG. 45, during mounting of the mounting bracket 100 at the window opening 2001 in the wall body 2000, the first part Z11*a* of the support frame Z11 is arranged outdoors, and the support frame Z11 is mounted at the window opening 2001. Both the support leg Z12 and the support foot Z13 are arranged outdoors. The support foot Z13 abuts against the outer wall surface R of the wall body 2000 and located below the support frame Z11. The support leg Z12 is connected between the first part Z11*a* of the support frame Z11 and the support foot Z13. In this case, the support leg Z12 extends obliquely relative to a vertical direction to allow a triangular support structure to be formed by the support unit Z1 and the wall body 2000 together, thereby achieving stable support for the window air conditioner 200.

Therefore, by configuring the support foot Z13 to include the body Z131 and the cladding Z132 that are in a positioning fit with each other by the positioning hole Z133*a* and the positioning protrusion Z133*b*, the support foot Z13 abuts against the outer wall surface R of the wall body 2000 with the cladding Z132 when the mounting bracket 100 is in use, such that the cladding Z132 can be effectively prevented from easily sliding relative to the body Z131 to avoid easy sliding of the support foot Z13 relative to the wall body 2000, thereby improving support stability of the support foot Z13. Also, a prone to aging of the cladding Z132 due to sliding under a force may be effectively avoided, which is conducive to prolonging a service life of the support foot Z13, and facilitates maintenance of the mounting bracket 100. Moreover, the mounting bracket 100 has a simple structure, reliable support, and good mounting stability, which facilitates mounting and fixing of the window air conditioner 200 and ensures the mounting stability of the window air conditioner 200. In addition, it is possible to prevent the window air conditioner 200 from falling off easily from the window opening 2001, and assist in achieving the safe use of the window air conditioner 200.

Optionally, an edge of the positioning hole Z133*a* is formed into a closed shape, such as a circular shape, an oval shape, or a polygonal shape, etc., which is conducive to ensuring that the positioning hole Z133*a* is reliably engaged with the positioning protrusion Z133*b*. For example, in an example illustrated in FIG. 32, the positioning hole Z133*a* is formed into a square hole. The edge of the positioning hole Z133*a* includes four sub-edges connected end to end in succession. A shape of a cross section of the positioning protrusion Z133*b* matches with a shape of the positioning hole Z133*a* to effectively ensure a positioning effect of the positioning structure Z133, such that the cladding Z132 is unlikely to slide relative to the body Z131 in both an upward-downward direction and a leftward-rightward direction.

Of course, the edge of the positioning hole Z133*a* may also be formed into a non-closed shape (i.e., a closed shape with a notch formed on it), e.g., a circular shape with a notch, etc.

It should be understood that the positioning hole Z133*a* may be formed as a through hole (as illustrated in FIG. 32) or a blind hole.

Figure 35:
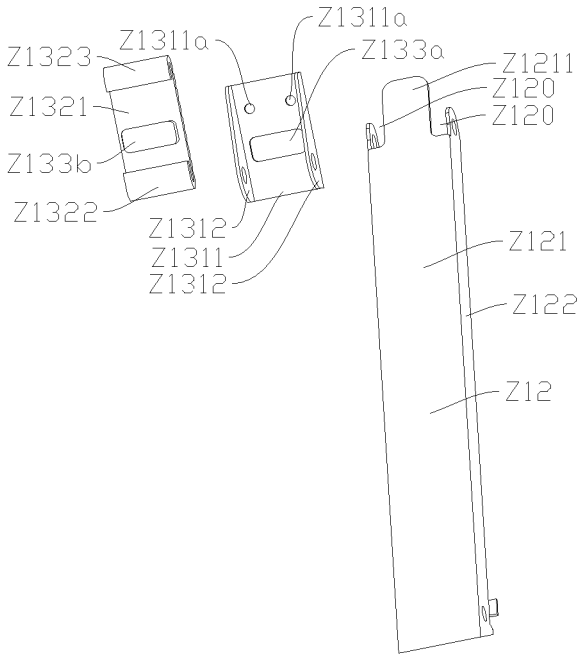
FIG. 35 is a schematic exploded view of a support leg and a support foot illustrated in FIG. 33.
Figure 36:
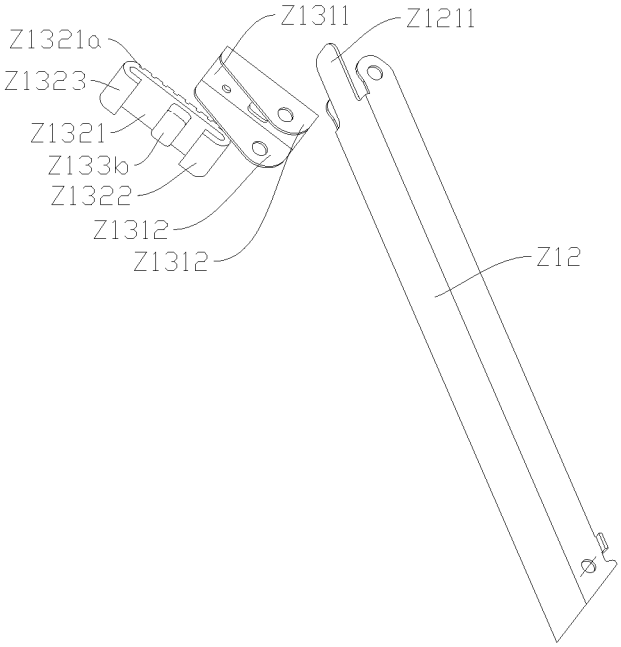
FIG. 36 is another schematic exploded view of the support leg and the support foot illustrated in FIG. 35.

In some embodiments of the present disclosure, as illustrated in FIG. 32, FIG. 35, and FIG. 36, the positioning hole Z133*a* is formed on the body Z131 and the positioning protrusion Z133*b* is integrally formed on the cladding Z132, such that the positioning protrusion Z133*b* and the cladding Z132 are formed as a one-piece member, which is convenient to ensure connection strength between the positioning protrusion Z133*b* and the cladding Z132, and is conducive to improving a load-bearing capacity of the positioning structure Z133, thereby ensuring reliable positioning and engagement between the body Z131 and the cladding Z132.

It should be understood that the positioning protrusion Z133*b* may also be connected to the cladding Z132 by means of assembling.

Of course, in other embodiments of the present disclosure, the positioning hole Z133*a* may also be formed on the cladding Z132, and the positioning protrusion Z133*b* may be integrally formed on the body Z131.

Figure 33:
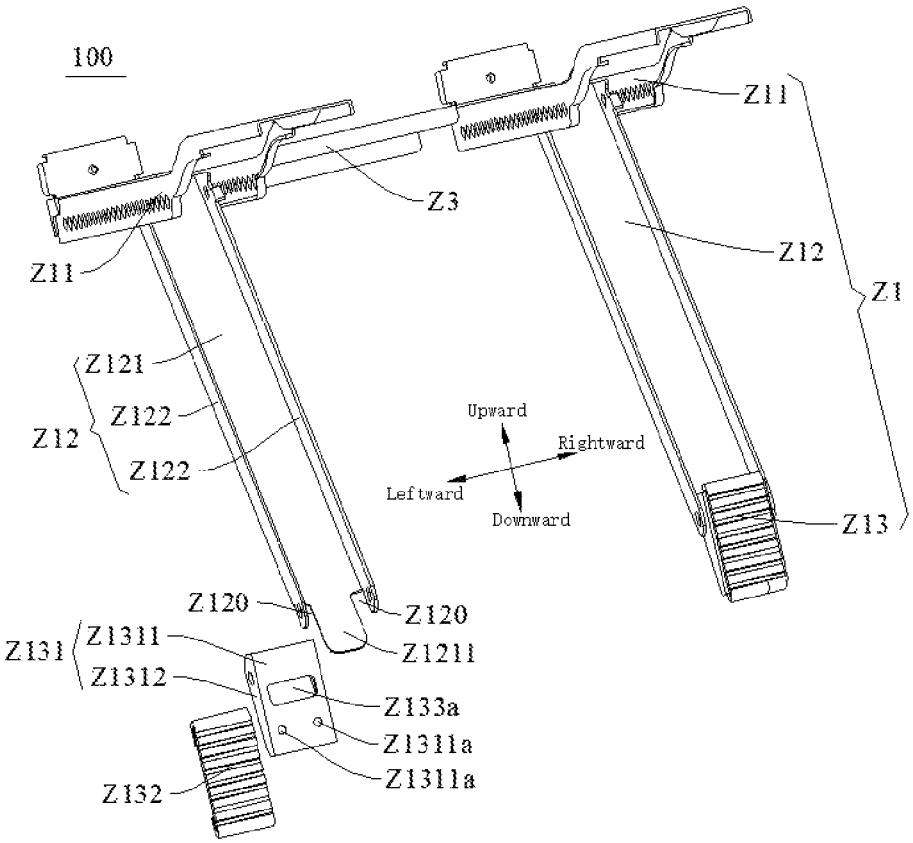
FIG. 33 is another schematic view of the mounting bracket illustrated in FIG. 31.

In some embodiments, as illustrated in FIG. 32, FIG. 33, and FIG. 35, the body Z131 has one or more sixth connection holes Z1311*a* formed therein, and a connection member Z4 is adapted to pass through the one or more sixth connection holes Z1311*a* and the cladding Z132 to be fixed at the outer wall surface R of the wall body 2000. Such a manner realizes fixing of the support foot Z13 to the wall body 2000, prevents the support foot Z13, when subjected to a large external force, from sliding relative to the wall body 2000, and improves the structural stability of the support unit Z1, thereby further improving the support stability of the support unit Z1. Also, such a manner is conducive to weakening a force between the cladding Z132 and the wall body 2000, and therefore, provides protecting for the cladding Z132 to a certain extent. For example, if the cladding Z132 is a rubber member, since the rubber member is fixed to the wall body 2000, the rubber member under a large force may not slide relative to the wall body 2000 when abutting against the wall body 2000, thereby avoiding easy deformation and aging of the rubber member and prolonging a service life of the rubber member.

It should be understood that, since the sixth connection hole Z1311*a* is wrapped by the cladding Z132 on a side thereof facing towards the wall body 2000, a perforation for the connection member Z4 to pass therethrough may be omitted on the cladding Z132, thereby simplifying procedures and facilitating ensuring use reliability of the cladding Z132. When the support foot Z13 abuts against the wall body 2000, under an action of the connection member Z4, the cladding Z132, when compressed by the body Z131, is unlikely to cause the body Z131 to be exposed to the wall body 2000, such that a wrapping effect of the cladding Z132 can be ensured, and it is convenient to realize that the body Z131 is always not in contact with the outer wall surface R of the wall body 2000 during use. However, the present disclosure is not limited in this regard.

In addition, the sixth connection hole Z1311*a* may be or may be not wrapped by the cladding Z132 on a side thereof facing away from the wall body 2000. For example, in an example illustrated in FIG. 32, the sixth connection hole Z1311*a* is not wrapped by the cladding Z132 on the side thereof facing away from the wall body 2000 to facilitate an exposure of a position of the sixth connection hole Z1311*a* to a visual field of an operator and improving the mounting efficiency.

Here, when a plurality of sixth connection holes Z1311*a* are formed on the body Z131, it is beneficial to further enhance the support stability of the mounting bracket 100. In this case, an arrangement of the plurality of sixth connection holes Z1311*a* may be specifically determined as desired.

For example, in examples illustrated in FIG. 32 and FIG. 33, two sixth connection holes Z1311*a* are provided and may be spaced apart from each other in a transverse direction (e.g., in a leftward-rightward direction in FIG. 33). Each sixth connection hole Z1311*a* is not wrapped by the cladding Z132 on the side thereof facing away from the wall body 2000, and is adapted to allow the connection member Z4 to pass therethrough. The connection member Z4 passes through the body Z131 and the cladding Z132 in sequence to fix the body Z131 to the wall body 2000, thereby realizing the fixing of the support foot Z13 to the wall body 2000, and further, ensuring reliability of the fixing of the support foot Z13 to the wall body 2000. In addition, a small number of connection members Z4 is conducive to ensuring the mounting efficiency of the mounting bracket 100. Of course, the two sixth connection holes Z1311*a* may also be spaced apart from each other in a vertical direction.

In addition, three or more sixth connection holes Z1311*a* may also be provided, and the plurality of support units Z1 may be spaced apart from each other in the transverse direction.

Optionally, the connection member Z4 is a screw. However, the present disclosure is not limited in this regard.

As illustrated in FIG. 30 and FIG. 32, each sixth connection hole Z1311*a* is located at a side of the positioning structure Z133 facing away from the support leg Z12. Therefore, each sixth connection hole Z1311*a* may be located at a side of the positioning structure Z133 facing away from a connection part between the positioning structure Z133 and the support leg Z12 to prevent the support leg Z12 from shielding the sixth connection hole Z1311*a* or interfering with mounting of the connection member Z4, thereby exposing a position of each sixth connection hole Z1311*a* to the operator's visual field and an operation space. Therefore, it is possible to facilitate the mounting of the connection member Z4 and reasonable mounting of the mounting bracket 100 by the operator.

For example, in examples illustrated in FIG. 30, FIG. 32, and FIG. 33, the connection position between the positioning structure Z133 and the support leg Z12 is located above the positioning structure Z133, and the sixth connection hole Z1311*a* is located below the positioning structure Z133, thereby facilitating mounting of the connection member Z4 and improving the mounting efficiency of the mounting bracket 100.

Of course, also, each sixth connection hole Z1311*a* may be located at a side of the positioning structure Z133 close to the support leg Z12. In this case, the mounting of the mounting bracket 100 can be facilitated for a reasonable arrangement of the support leg Z12 to allow the sixth connection hole Z1311*a* to be exposed to the operator's visual field and the operation space. In addition, when a plurality of sixth connection holes Z1311*a* are provided, the plurality of sixth connection holes Z1311*a* may also be located at opposite sides of the positioning structure Z133, such that at least one sixth connection hole Z1311*a* may be located at the side of the positioning structure Z133 facing away from the support leg Z12, and at least one sixth connection hole Z1311*a* may be located at the side of the positioning structure Z133 close to the support leg Z12.

In some embodiments, as illustrated in FIG. 30 and FIG. 32, and in connection with FIG. 33, FIG. 35, and FIG. 36, the body Z131 includes a panel member Z1311 and two side plate members Z1312 located at both sides of the panel member Z1311 in the transverse direction (e.g., on both sides in the leftward-rightward direction in FIG. 33). Each of the side plate members Z1312 is connected to the support leg Z12. When the mounting bracket 100 is mounted at the window opening 2001, the side plate member Z1312 may extend away from the wall body 2000, and thus a connection between the side plate member Z1312 and the support leg Z12 facilitates a connection between the support foot Z13 and the support leg Z12. In addition, since two side plate members Z1312 are provided, both side plate members Z1312 can provide support for the support leg Z12, thereby realizing effective and stable support of the support leg Z12 by the support foot Z13.

For example, in the example illustrated in FIG. 32, the support leg Z12 includes a leg panel Z121 and two leg side plates Z122 located at both lateral sides of the leg panel Z121. The two leg side plates Z122 have two lower ends connected to the two side plate members Z1312, respectively. The two leg side plates Z122 may be located at transverse outer sides of the two side plate members Z1312 to position the two side plate members Z1312 between the two leg side plates Z122.

Optionally, in examples illustrated in FIG. 32 and FIG. 35, the support leg Z12 has two avoidance grooves Z120 formed in a lower end thereof. The two avoidance grooves Z120 are spaced apart from each other in the transverse direction. Each avoidance groove Z120 is formed by the leg panel Z121 and one leg side plate Z122. The side plate member Z1312 is engaged in a corresponding one of the avoidance grooves Z120 to be connected to a corresponding one of the leg side plates Z122. Here, the leg panel Z121 has a stop member Z1211 provided at a lower end thereof. The avoidance groove Z120 is formed by the stop member Z1211 and the leg side plate Z122. The stop member Z1211 extends downwardly to abut against a side of the support foot Z13 facing away from the outer wall surface R of the wall body 2000, thereby further improving support stability of the support leg Z12.

As illustrated in FIG. 29, FIG. 32, and FIG. 33, the cladding Z132 includes an end surface part Z1321, an upper flange part Z1322, and a lower flange part Z1323. The upper flange part Z1322 and the lower flange part Z1323 are located at both longitudinal ends (e.g., on both ends in an upward-downward direction in FIG. 33) of the end surface part Z1321, respectively. The end surface part Z1321 wraps around the panel member Z1311 on one thickness side (e.g., a forward side in FIG. 29) of the panel member Z1311. When the support foot Z13 abuts against the wall body 200, the end surface part Z1321 is located between the panel member Z1311 and the wall body 2000. The upper flange part Z1322 is connected to a longitudinal upper end of the end surface part Z1321 and bent towards the other thickness side (e.g., a backward side in FIG. 29) of the panel member Z1311. The lower flange part Z1323 is connected to a longitudinal lower end of the end surface part Z1321 and bent towards the other thickness side of the panel member Z1311. Therefore, a cross section of the cladding Z132 may be substantially formed into a C-shape. The upper flange part Z1322 and the lower flange part Z1323 allow the end surface part Z1321 to tightly engage with the panel member Z1311 to ensure that the cladding Z132 stably wraps around the body Z131, and also facilitate ensuring that the positioning protrusion Z133*b* is reliably engaged with the positioning hole Z133*a*. In addition, due to a certain load-bearing capacity of each of the upper flange part Z1322 and the lower flange part Z1323, a force exerted on the positioning structure Z133 may be relieved.

As illustrated in FIG. 32, the positioning hole Z133*a* is formed on the panel member Z1311, and a transverse width of the positioning hole Z133*a* is greater than more than half of a transverse width of the panel member Z1311. Since the positioning protrusion Z133*b* is positioned and engaged in the positioning hole Z133*a*, the transverse width of the positioning protrusion Z133*b* is greater than more than half of the transverse width of the panel member Z1311. Since the positioning structure Z133 is mainly responsible for bearing a vertical force, a load-bearing capacity of the positioning structure Z133 is further ensured. The positioning protrusion Z133*b* is disposed on the end surface part Z1321. Therefore, the positioning protrusion Z133*b* is disposed on a surface of the end surface part Z1321 on a side facing towards the panel member Z1311. In addition, the positioning protrusion Z133*b* is located at a center position between the upper end and the lower end of the end surface part Z1321. Therefore, the end surface part Z1321 may be divided into a first surface part and a second surface part. The positioning protrusion Z133*b* is arranged to correspond to the first surface part. The second surface part wraps around the entire first surface part. Both the first surface part and the second surface part are adapted to abut against the outer wall surface R of the wall body 2000, such that an edge of the first surface part may be subjected to a reasonable and balanced force, thereby ensuring that the positioning protrusion Z133*b* is subjected to a balanced force. The positioning hole Z133*a* may also be located at a center position between an upper end and a lower end of the panel member Z1311. In this case, it is conducive to ensuring structural stability of the positioning hole Z133*a* and preventing the positioning hole Z133*a* from being easily deformed due to a force.

It should be understood that the positioning protrusion Z133*b* being located at the center position between the upper end and the lower end of the end surface part Z1321 includes, but not limited to, a center of the positioning protrusion Z133*b* being coincident with a center of the end surface part Z1321. Of course, the center of the positioning protrusion Z133*b* may also be offset from the center of the end surface part Z1321. That is, a distance between the positioning protrusion Z133*b* and the upper end of the end surface part Z1321 is identical to or different from a distance between the positioning protrusion Z133*b* and the lower end of the end surface part Z1321.

In some embodiments, as illustrated in FIG. 29 and FIG. 32, the cladding Z132 has a plurality of slots Z1321*a* on a surface of the cladding Z132 facing away from the body Z131. The plurality of slots Z1321*a* are spaced apart from each other in an upward-downward direction. Therefore, the cladding Z132 has the plurality of slots Z1321*a* on a surface thereof abutting against the wall body 2000. The plurality of slots Z1321 are spaced apart from each other in a longitudinal direction (e.g., in an upward-downward direction in FIG. 29). Each slot Z1321*a* may extend in a transverse direction (e.g., in a leftward-rightward direction in FIG. 29) and is formed by recessing a portion of a surface of the cladding Z132 downwardly. Therefore, when the cladding Z132 abuts against the wall body 2000, deformability of the cladding Z132 can be further enhanced when the cladding Z132 is designed into an elastic member with good elasticity, e.g., a rubber member, such that the cladding Z132 may abut against the wall body 2000 more tightly. In this case, the cladding Z132 is less liable to slide relative to the wall body 2000, thereby prolonging service life of the cladding Z132.

Optionally, in the examples illustrated in FIG. 29 and FIG. 32, the body Z131 is a sheet metal part, which is convenient to ensure structural strength of the body Z131 and facilitates a lightweight design of the body Z131. The cladding Z132 is a rubber member. In this case, when the cladding Z132 abuts against the wall body 2000, due to good elasticity of the cladding Z132, the cladding Z132 is in more tight contact with the wall body 2000, thereby increasing a force applied between the support foot Z13 and the wall body 2000, such that the support foot Z13 is less likely to slide relative to the wall body 2000, and a stable position of the support foot Z13 can be ensured to achieve stable support.

In some embodiments, as illustrated in FIG. 29, the mounting bracket 100 includes two support units Z1 spaced apart from each other in the transverse direction. Each support unit Z1 is configured to fix and support the window air conditioner 200. Therefore, it is possible to improve the structural strength and structural stability of the mounting bracket 100, thereby ensuring the reliable mounting of the window air conditioner 200. It should be understood that the two support units Z1 may have a same structure or different structures.

As illustrated in FIG. 29, and in connection with FIG. 43 and FIG. 45, the support frame Z11 is adapted to pass through the window opening 2001 in such a manner that a part of the support frame Z11 is arranged indoors. Therefore, the support frame Z11 further includes a second part Z11*b* adapted to be arranged indoors. The mounting bracket 100 further includes a positioning unit Z2 adapted to be arranged indoors and connected to the part of the support frame Z11 located indoors, e.g., the second part Z11*b* of the support frame Z11. Further, the positioning unit Z2 is adapted to be positioned and engaged into the window opening 2001 and/or the window frame 2002 to facilitate stable mounting of the support unit Z1 at the window opening 2001.

For example, the positioning unit Z2 is adapted to be in a positioning fit with the window opening 2001 to facilitate stable mounting of the positioning unit Z2 at the wall body 2000. The support frame Z11 of each support unit Z1 extends into the indoor space and has the second part Z11*b* connected to the positioning unit Z2 to achieve the stable mounting of the mounting bracket 100. Of course, when the mounting bracket 100 is in use, the positioning unit Z2 may also be in a positioning fit with the window frame 2002 at the window opening 2001, or the positioning unit Z2 may be in a positioning fit with both the window opening 2001 and the window frame 2002, such that the stable mounting of the mounting bracket 100 can also be realized.

It should be understood that in the inside-outside direction, a length of the second part Z11*b* of the support frame Z11 may be shorter than a length of the first part Z11*a* of the support frame Z11, such that the mounting bracket 100 may be arranged to match a center of gravity of the window air conditioner 200 for ensuring the stability of the mounting of the window air conditioner 200.

Of course, when mounted at the window opening 2001, the support frame Z11 may also be mounted outdoors entirely. In this case, when the mounting bracket 100 includes a positioning unit Z2, and the positioning unit Z2 is adapted to be at least partially arranged indoors and is directly or indirectly connected to the support frame Z11. For example, in a case where the positioning unit Z2 is indirectly connected to the support frame W11, a connection segment is provided between the positioning unit Z2 and the support frame Z11. The connection segment is connected to each of the positioning unit Z2 and the support frame Z11 to connect the positioning unit Z2 to the support frame Z11. In addition, in a case where the positioning unit Z2 is directly connected to the support frame Z11, the positioning unit Z2 may partially extend outdoors to be connected to the support frame Z11. However, the present disclosure is not limited in this regard.

Optionally, in the example illustrated in FIG. 29, the support frame Z11 is formed into a one-piece member to reduce assembly steps of the support frame Z11 and improve the mounting efficiency of the mounting bracket 100. For example, the support frame Z11 is formed into a bent member, and the entire support frame Z11 is bent and formed from a single plate. Of course, the support frame Z11 may also be formed into a split member. In this case, the support frame Z11 may include a plurality of support members that may be connected to each other by means of assembling.

Figure 34:
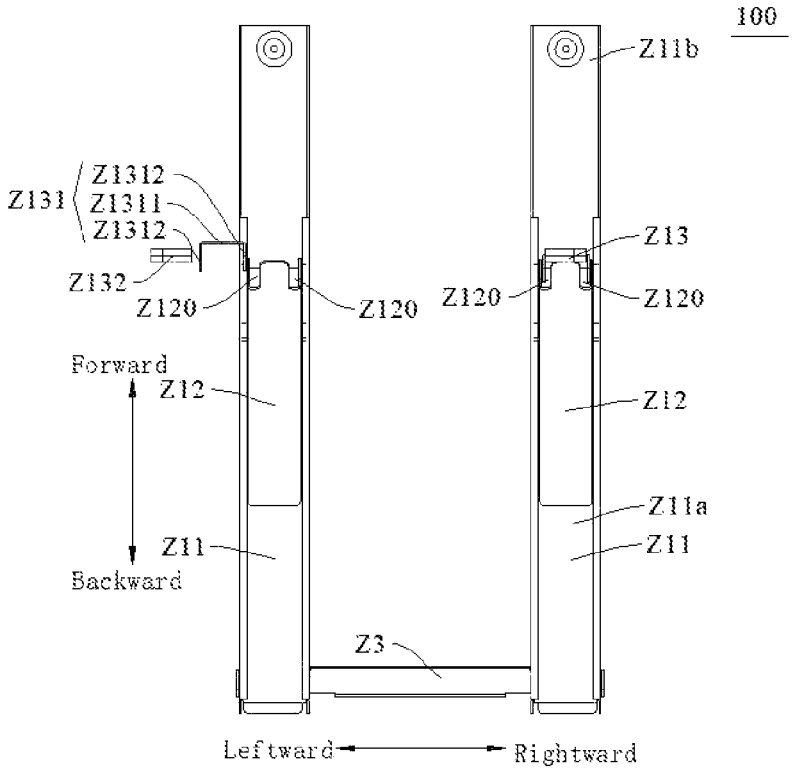
FIG. 34 is yet another schematic view of the mounting bracket illustrated in FIG. 33.

In addition, in examples illustrated in FIG. 29 and FIG. 34, a plurality of support units Z1 are provided. The mounting bracket 100 further includes a connection unit Z3 adapted to be arranged outdoors and connected to a part of the support frame Z11 of each of the plurality of support units Z1 arranged outdoors, e.g., the first part Z11*a*, which further enhancing the support stability of the mounting bracket 100.

A window air conditioner assembly 1000 according to embodiments in a second aspect of the present disclosure will be described below with reference to the accompanying drawings.

As illustrated in FIG. 39 and FIG. 41, the window air conditioner assembly 1000 includes a window air conditioner 200 and the mounting bracket 100 for the window air conditioner 200 according to any one of the embodiments in the first aspect of the present disclosure. The mounting bracket 100 is adapted to be mounted at the window opening 2001 in the wall body 2000. The window air conditioner 200 is arranged at the mounting bracket 100.

With the window air conditioner assembly 1000 according to the embodiments of the present disclosure, by using the mounting bracket 100 as described above, it is possible to facilitate the mounting and fixing of the window air conditioner 200 with high safety and reliability.

Figure 37:
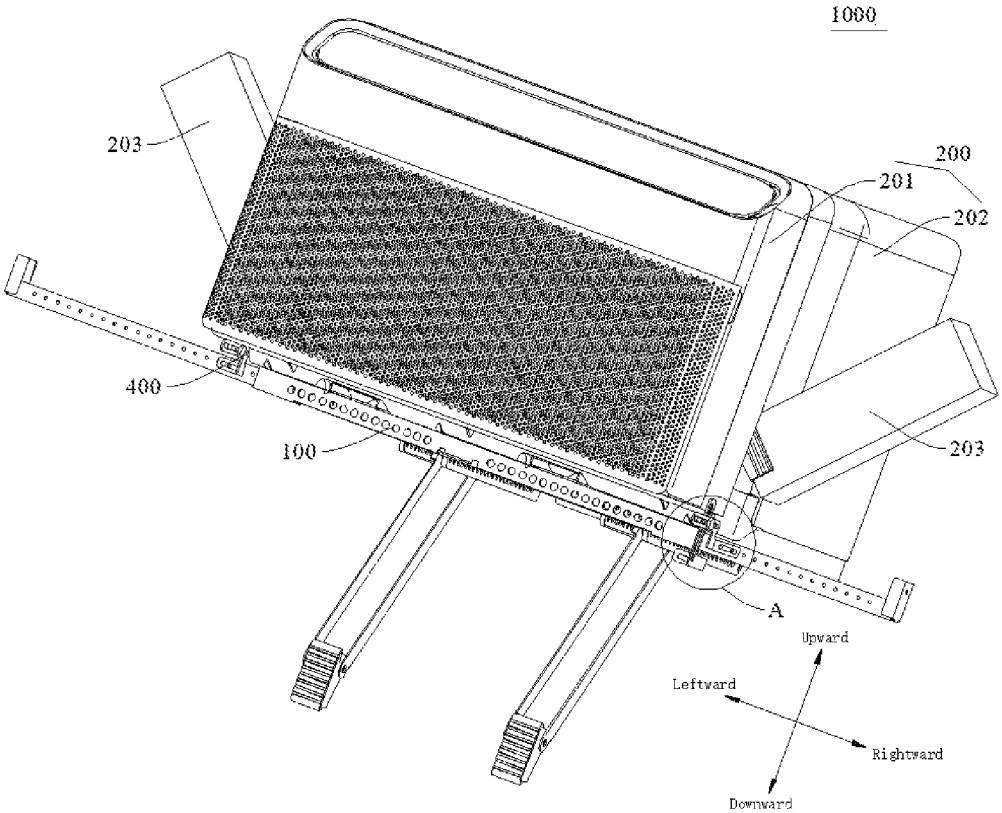
FIG. 37 is a schematic view of a window air conditioner assembly according to an embodiment of the present disclosure.

In some embodiments, as illustrated in FIG. 37, FIG. 41, and FIG. 43, the window air conditioner assembly 1000 further includes a connection assembly 400 adapted to connect the mounting bracket 100 and the window air conditioner 200. Therefore, by using the connection assembly 400 as described above, it is possible to enhance reliability of a connection between the mounting bracket 100 and the window air conditioner 200, and further enhance the mounting stability of the window air conditioner 200, thereby ensuring use safety of the window air conditioner 200.

In addition, since the connection assembly 400 is connected to each of the mounting bracket 100 and the window air conditioner 200, the mounting bracket 100 may exert a predetermined force on the window air conditioner 200 by the connection assembly 400, thereby preventing, to a certain extent, loosening of mounting of the window air conditioner assembly 1000 due to an upward overturning force F1 and/or a downward overturning force F2 exerted on a part of the window air conditioner 200 located indoors, thereby improving overturning resistance performance of the window air conditioner 200 and further, strengthening secure mounting of the window air conditioner 200. For example, when an adult lifts the window air conditioner 200 upwards in the indoor space, the mounting bracket 100 may exert a predetermined force on the window air conditioner 200 by the connection assembly 400 against at least a portion of the upward overturning force F1 exerted on the window air conditioner 200, thereby stably keeping the window air conditioner 200 at the window opening 2001 to prevent the window air conditioner 200 from easily falling outdoors and hitting a passer-by. For another example, when the window air conditioner 200 is pressed downwardly by a child in the indoor space, the mounting bracket 100 may exert a predetermined force on the window air conditioner 200 by the connection assembly 400 against at least a part of the downward overturning force F2 exerted on the window air conditioner 200 to prevent the window air conditioner 200 from falling into the indoor space easily and hitting the child.

Therefore, by configuring the connection assembly 400 to be adapted to connect the mounting bracket 100 and the window air conditioner 200, the mounting stability of the window air conditioner 200 is further enhanced to improve the overturning resistance performance of the window air conditioner 200, thereby realizing the safe use of the window air conditioner 200, and avoiding unstable mounting of the window air conditioner 200 caused by loosening of the mounting bracket 100.

Optionally, as in the examples illustrated in FIG. 41, FIG. 43, and FIG. 45, the connection assembly 400 is adapted to be arranged indoors. Therefore, in a case where one connection assembly 400 is provided, the entire connection assembly 400 is adapted to be arranged indoors, and in a case where a plurality of connection assemblies 400 are provided, each connection assembly 400 is adapted to be arranged indoors. Of course, the connection assembly 400 is not limited to being arranged in the indoor space.

It should be understood that in the case where the plurality of connection assemblies 400 is provided, the plurality of connection assemblies 400 may be spaced apart from each other in the transverse direction. For example, in an example illustrated in FIG. 37, two connection assemblies 400 are provided and arranged at both ends of the window air conditioner 200 in the transverse direction. Of course, positions of the two connection assemblies 400 are not limited thereto, and three or more connection assemblies 400 may also be provided.

In some embodiments, as illustrated in FIG. 39 and FIG. 43, the mounting bracket 100 includes a support unit 1, a positioning unit 2, and a connection unit 3. The support unit 1 is adapted to pass through the window opening 2001 in the inside-outside direction. At least a part of the support unit 1 is located outdoors and adapted to abut against the outer wall surface R of the wall body 2000. The positioning unit 2 is adapted to be arranged indoors, and connected to the part of the support unit 1 located indoors. The positioning unit 2 is adapted to be in a positioning fit with the window opening 2001 and/or the window frame 2002. The connection unit 3 is adapted to be arranged outdoors and is connected to the support unit 1. Optionally, after the window air conditioner 200 is mounted, the connecting unit 3 may be spaced apart from the window air conditioner 200 in the inside-outside direction.

For example, the support unit 1 may include a support leg 12 having a lower end adapted to directly or indirectly abut against the outer wall surface R of the wall body 2000. In this manner, the support leg 12 can provide support for the support frame 11, thereby enhancing the stability of the mounting bracket 100.

Figure 40:
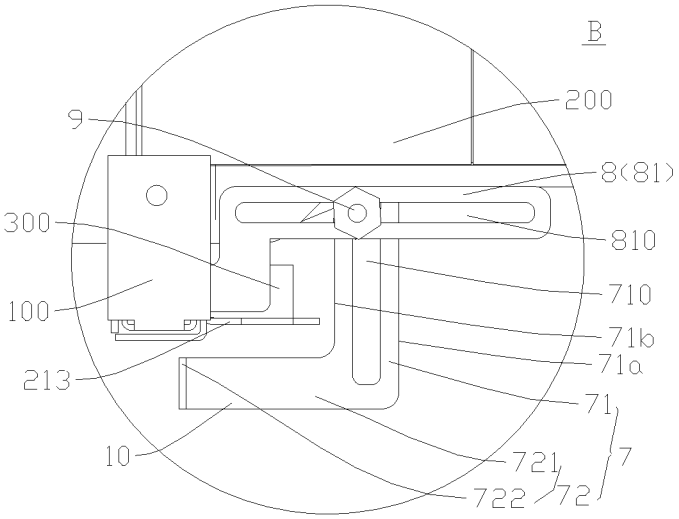
FIG. 40 is an enlarged view of part B circled in FIG. 39.
Figure 44:
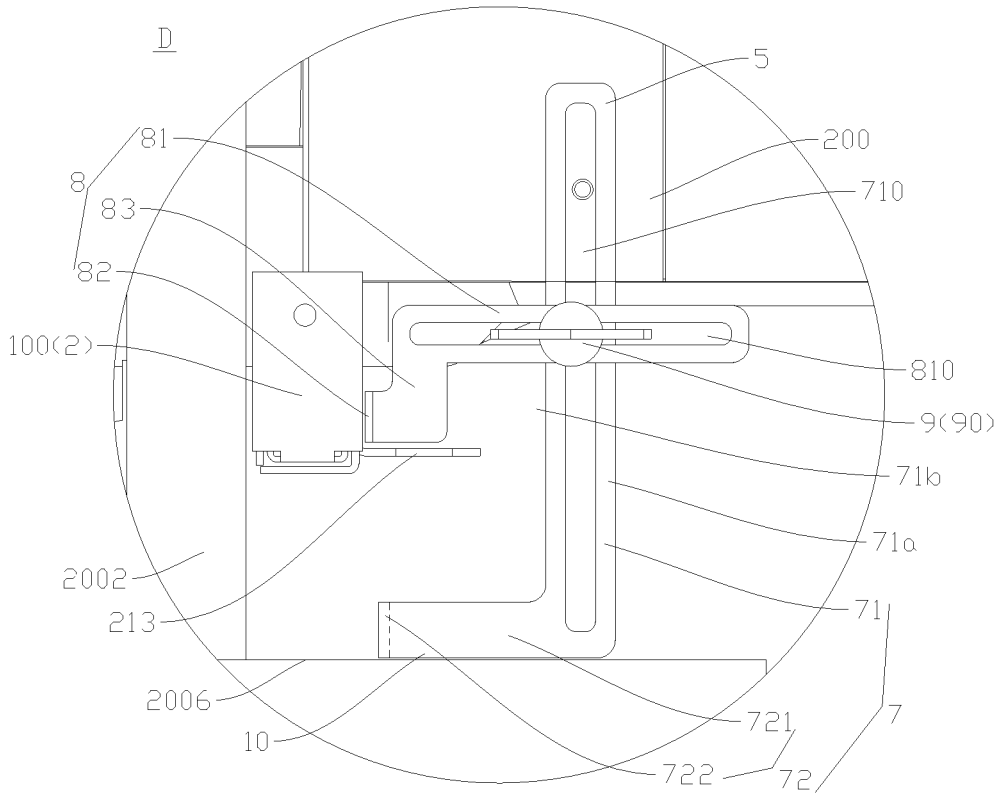
FIG. 44 is an enlarged view of part D circled in FIG. 43.

Optionally, as illustrated in FIG. 40 and FIG. 44, the positioning unit 2 includes a main frame 21 extending in the transverse direction. The main frame 21 has a mounting platform 213 provided at a transverse center position thereof and adapted to mount a level instrument 300, thereby facilitating mounting of the level instrument 300.

In some embodiments, the window air conditioner 200 includes an indoor unit 201 and an outdoor unit 202 that are spaced apart from each other in the inside-outside direction. Therefore, the indoor unit 201 and the outdoor unit 202 may be spaced apart from each other to allow a housing of the indoor unit 201 to be separated from a housing of the outdoor unit 202, thereby simplifying a structure of the housing of the indoor unit 201 and the housing of the outdoor unit 202, and facilitating fabrication of the housing of the indoor unit 201 and the housing of the outdoor unit 202.

As illustrated in FIG. 39, FIG. 41, and FIG. 45, both sides of the wall body 2000 in a thickness direction thereof are an indoor side 2004 and an outdoor side 2005, respectively. The window opening 2001 has a window sash 2003 provided thereon. An accommodation space 200*a* is formed between the indoor unit 201 and the outdoor unit 202. The accommodation space 200*a* is adapted to accommodate the window sash 2003. The accommodation space 200*a* is opened at a top and both sides thereof in a transvers direction (e.g., a left side and a right side illustrated in FIG. 45). The window sash 2003 has at least a part capable of extending into the accommodation space 200*a*. In this case, the indoor unit 201 is located at the indoor side 2004 of the window sash 2003, and the outdoor unit 202 is located at the outdoor side 2005 of the window sash 2003. The window sash 2003 may separate the indoor unit 201 from the outdoor unit 202 to prevent, to a certain extent, operating noises of the outdoor unit 202 from propagating into the indoor side 2004, thereby enhancing user's experience. In addition, the window air conditioner 200 has a flexible structure and is easy to be mounted, and it is unnecessary to deliberately open a window opening 2001 matching with the window air conditioner 200 in shape on the wall body 2000. The window opening 2001 on the wall body 2000 for mounting windows can realize mounting of the window air conditioner 200, thereby lowering mounting requirements for the window air conditioner 200.

It should be understood that when the window sash 2003 can be pushed and pulled in the upward-downward direction, the entire window sash 2003 may be positioned above the accommodation space 200*a* to ensure that the window opening 2001 has a sufficient ventilation area. In addition, since the window air conditioner 200 is mounted at the window opening 2001 by the mounting bracket 100, the window sash 2003 may be pushed and pulled without affecting the fixing and mounting of the window air conditioner 200, thereby facilitating normal use of the window sash 2003.

As illustrated in FIG. 39, FIG. 41, FIG. 43, and FIG. 45, the window air conditioner 200 includes a sealing assembly 203 adapted to be arranged between a bottom wall of the window opening 2001 and a lower end of the window sash 2003 to seal a gap between the window opening 2001 and the window sash 2003, thereby ensuring a sealing effect of the window air conditioner 200 mounted at the window opening 2001. For example, when an outdoor temperature is low in winter, the user may arrange the sealing assembly 203 between the bottom wall of the window opening 2001 and the lower end of the window sash 2003 to prevent outdoor cold air from flowing into the indoor space and impairing the comfort, and also, effectively suppress the operating noises of the outdoor unit 202.

For example, in examples illustrated in FIG. 41 and FIG. 45, the sealing assembly 203 is rotatably arranged in the accommodation space 200*a* and rotatable between a storage position (as illustrated in FIG. 41) and a sealing position (as illustrated in FIG. 45). Here, when the sealing assembly 203 is rotated to the storage position, the sealing assembly 203 is received in the accommodation space 200*a*, and when the sealing assembly 203 is rotated to the sealing position, the sealing assembly 203 performs a sealing between the bottom wall of the window opening 2001 and the lower end of the window sash 2003.

Of course, the arrangement of the sealing assembly 203 is not limited in this regard. For example, the sealing assembly 203 may also be detachably arranged at the window air conditioner 200.

As illustrated in FIG. 45, the window air conditioner 200 also includes a latch assembly 204 adapted to be locked with the window sash 2003 to prevent the window sash 2003 from moving out of the accommodation space 200*a*. In this manner, effective locking of the window sash 2003 can be performed to prevent the window sash 2003 from being opened by other people outdoors, thereby effectively preventing thefts and ensuring the safety of the user's personal property. For example, in the example illustrated in FIG. 45, the latch assembly 204 is switchable between a first state in which the latch assembly 204 is engaged with and locked to the window sash 2003 to allow the window sash 2003 to stably extend into the accommodation space 200*a* and a second state in which the latch assembly 204 is disengage from the window sash 2003 such that the window sash 2003 can move out of the accommodation space 200*a*. Here, the latch assembly 204 may include a latch member. The latch member is movable between a first position and a second position to allow the latch assembly 204 to switch between the first state and the second state.

It should be understood that a specific structure of the latch assembly 204 may be specifically determined as desired, as long as the latch assembly 204 can be engaged with and locked to the window sash 2003 to prevent the window sash 2003 from moving out of the accommodation space 200*a* after the mounting of the window air conditioner 200 is completed.

Some embodiments of a connection assembly 400 according to the present disclosure will be described below with reference to FIG. 37 to FIG. 46.

In some embodiments, as illustrated in FIG. 38, FIG. 40, and FIG. 42 to FIG. 44, the connection assembly 400 has a bottom support part 10 provided at a lower end thereof. The bottom support part 10 is configured to be supported at a windowsill 2006. Therefore, when the bottom support part 10 is supported at the windowsill 2006, the windowsill 2006 may exert a predetermined supporting force on the window air conditioner 200 by the bottom support part 10 to provide support between the window air conditioner 200 and the windowsill 2006. Therefore, the overturning resistance performance of the window air conditioner 200 can be further enhanced, thereby further improving the safety and stability of the window air conditioner 200. In addition, it is possible to reduce load bearing of the mounting bracket 100 and ensure stable support of the mounting bracket 100 for the window air conditioner 200.

Optionally, when the connection assembly 400 is adapted to be arranged indoors, the bottom support part 100 is adapted to be supported at the windowsill 2006 located indoors, thereby improving downward overturning resistance performance of the window air conditioner 200. That is, the part of the window air conditioner 200 located indoors may withstand a great downward overturning force F2. When the window air conditioner 200 is pressed downwardly by a child in the indoor space, the connection assembly 400 may stably support the window air conditioner 200 to prevent the window air conditioner 200 from falling into the indoor space easily and hitting the child. Of course, the connection assembly 400 is not limited to being positioned in the indoor space.

It should be understood that the connection assembly 400 has one or more bottom support parts 10. When a plurality of bottom support parts 10 are provided, the plurality of bottom support parts 10 may be spaced apart from each other in a transverse direction (e.g., in a leftward-rightward direction in FIG. 37). However, the present disclosure is not limited thereto.

It should be noted that in the description of the present disclosure, "a plurality of" means two or more; "transverse," or "lateral" should be understood in a broad sense and is not limited to a horizontal direction, i.e., "transverse," or "lateral" should be understood to include not only the horizontal direction (e.g., the leftward-rightward direction in FIG. 37 and FIG. 41), but also an inclined direction angled with respect to the horizontal direction; and likewise, "vertical" described in the following content should be understood in a broad sense and is not limited to a vertical direction, e.g., "vertical" should be understood to include not only the vertical direction (e.g., an upward-downward direction in FIG. 37 and FIG. 41), but also an inclined direction angled with respect to the vertical direction.

Figure 38:
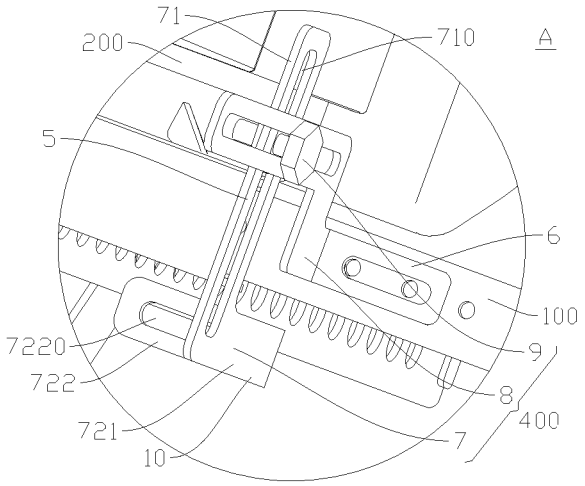
FIG. 38 is an enlarged view of part A circled in FIG. 37.
Figure 42:
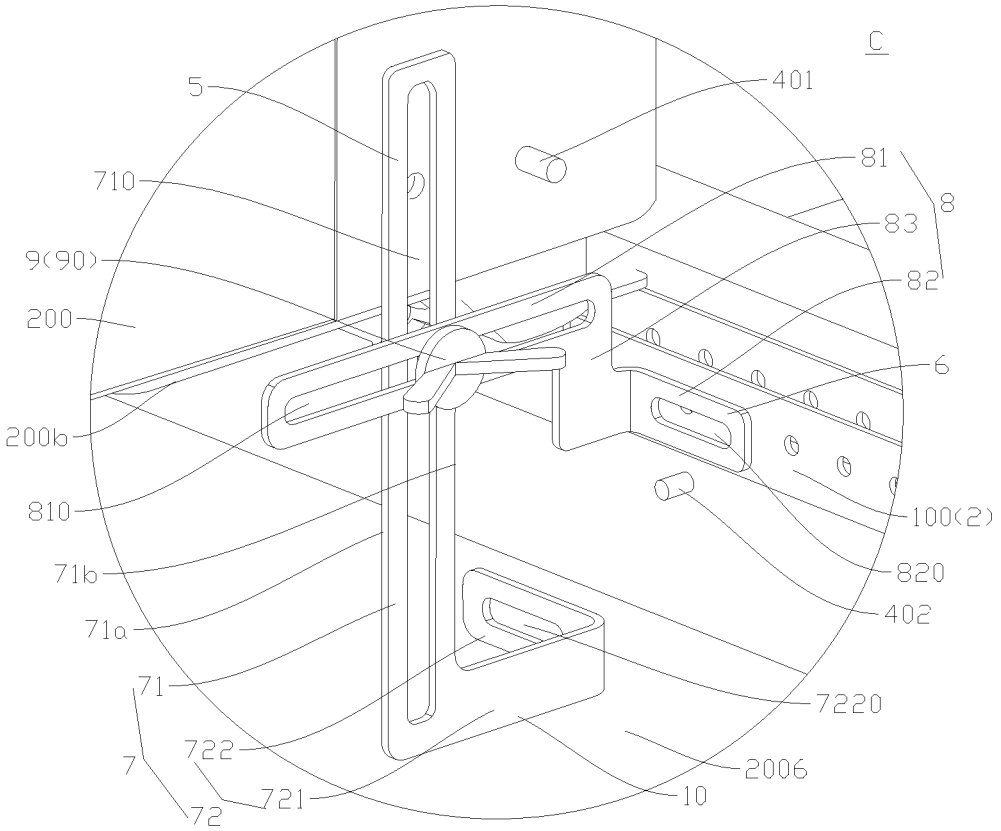
FIG. 42 is an enlarged view of part C circled in FIG. 41.

In some embodiments, as illustrated in FIG. 38 and FIG. 42, the connection assembly 400 is configured such that a relative height between the bottom support part 10 and a bottom surface 200*b* of the window air conditioner 200 is adjustable. In this case, the connection assembly 400 is configured such that a distance between the bottom support part 10 and the bottom surface 200*b* of the window air conditioner 200 in the upward-downward direction is adjustable, and thus the connection assembly 400 can be applied to window frames 2002 and window air conditioners 200 of different sizes. For example, when a change in a size of the window frame 2002 leads to a change in a distance between the bottom surface 200*b* of the window air conditioner 200 and the windowsill 2006 in the upward-downward direction, the bottom support part 10 of the connection assembly 400 may still be supported at the windowsill 2006, such that the windowsill 2006 may exert an appropriate supporting force on the window air conditioner 200 by the bottom support part 10, thereby effectively enhancing applicability and universality of the connection assembly 400.

In some embodiments, as illustrated in FIG. 38 and FIG. 42, the connection assembly 400 includes a third connection part 5 configured to be connected to the window air conditioner 200 and a fourth connection part 6 configured to be connected to the mounting bracket 100. The connection assembly 400 is configured such that a relative distance between the third connection part 5 and the fourth connection part 6 in a direction from the indoor space to the outdoor space is adjustable. In this manner, the connection assembly 400 can be applied to window frames 2002 and window air conditioners 200 of different sizes, such that the applicability and universality of the connection assembly 400 can be effectively enhanced. Thus, it is possible for the connection assembly 400 to better satisfy differentiated requirements.

For example, in examples illustrated in FIG. 37, FIG. 38, and FIG. 42, the third connection part 5 is connected to the window air conditioner 200, such that a relative distance between the third connection part 5 and the window air conditioner 200 in an inside-outside direction (e.g., a forward-backward direction in FIG. 37) may always be constant. The fourth connection part 6 is connected to the mounting bracket 100, such that a relative distance between the fourth connection part 6 and the mounting bracket 100 in the inside-outside direction may always be constant. Since the connection assembly 400 is configured such that the relative distance between the third connection part 5 and the fourth connection part 6 in the inside-outside direction is adjustable, the connection assembly 400 is configured such that a relative distance between the window air conditioner 200 and the mounting bracket 100 in the inside-outside direction is adjustable. Therefore, the connection assembly 400 may be applied to the window frames 2002, window air conditioners 200, and mounting brackets 100 of different sizes. For example, when a change in a size of the window air conditioner 200 leads to a change in the distance between the window air conditioner 200 and the mounting bracket 100 in the inside-outside direction, the connection assembly 400 can still connect the window air conditioner 200 and the mounting bracket 100, thereby effectively enhancing the applicability and universality of the connection assembly 400.

Here, the relative distance between the window air conditioner 200 and the mounting bracket 100 in the inside-outside direction should be understood as a distance between an indoor end surface of the window air conditioner 200 (e.g., a front end surface of the window air conditioner 200 in FIG. 41) and an end surface of the mounting bracket 100 facing towards the indoor space (e.g., a front end surface of the mounting bracket 100 in FIG. 41) in the inside-outside direction, or as a distance between a center of gravity of the window air conditioner 200 and a center of gravity of the mounting bracket 100 in the inside-outside direction.

Optionally, as illustrated in FIG. 42, both the third connection part 5 and the fourth connection part 6 are adapted to be arranged indoors to facilitate an adjustment of the connection assembly 400 by the operator indoors. Of course, the third connection part 5 and the fourth connection part 6 are not limited to being positioned in the indoor space.

It should be understood that a locking member may be disposed between the third connection part 5 and the fourth connection part 6. The locking member is configured to keep a distance between the third connection part 5 and the fourth connection part 6 in the inside-outside direction constant, such that the distance between the third connection part 5 and the fourth connection part 6 in the inside-outside direction remains unchanged. When it is necessary to adjust the distance between the third connection part 5 and the fourth connection part 6 in the inside-outside direction, the locking member is unlocked to adjust the distance between the third connection part 5 and the fourth connection part 6 in the inside-outside direction.

In some embodiments, as illustrated in FIG. 38, FIG. 40, and FIG. 42, the connection assembly 400 includes a first connection member 7 adapted to be connected to the window air conditioner 200, a second connection member 8 adapted to be connected to the mounting bracket 100, and a third connection member 9 configured to connect the first connection member 7 to the second connection member 8. Therefore, the connection assembly 400 has a simple structure that is not only easy to implement, but also facilitates a flexible design of the connection assembly 400.

Here, a connection method between the first connection member 7 and the window air conditioner 200 and a connection method between the second connection member 8 and the mounting bracket 100 may be determined as desired. For example, the first connection member 7 may be detachably connected to the window air conditioner 200, and the second connection member 8 may be detachably connected to the mounting bracket 100. However, the present disclosure is not limited in this regard.

Optionally, as illustrated in FIG. 42, all of the first connection member 7, the second connection member 8, and the third connection member 9 are adapted to be arranged indoors to facilitate mounting the connection assembly 400 by the operator indoors. Of course, the first connection member 7, the second connection member 8, and the third connection member 9 are not limited to being positioned indoors.

In an example illustrated in FIG. 42, the connection assembly 400 has a bottom support part 10 provided at a lower end thereof. The bottom support part 10 is configured to be supported at the windowsill 2006. The bottom support part 10 may be formed at a lower end of the first connection member 7 to ensure that the first connection member 7 may be effectively supported between the windowsill 2006 and the window air conditioner 200, thereby ensuring the safety of the window air conditioner 200.

In some embodiments, as illustrated in FIG. 38 and FIG. 42, the first connection member 7 has a first elongated hole 710 formed therein. The first elongated hole 710 extends in the upward-downward direction and is adapted to be connected to the window air conditioner by a first fastening member 401. Therefore, the first fastening member 401 may pass through the window air conditioner 200 via the first elongated hole 710 to connect the first connection member 7 to the window air conditioner 200. Since the first elongated hole 710 extends in the upward-downward direction, a connection position between the first fastening member 401 and the first connection member 7 is adjustable in an extension direction of the first elongated hole 710.

Here, the first connection member 7 has a bottom surface to be supported at the windowsill 2006, and thus the bottom surface of the first connection member 7 may be formed as the bottom support part 10. In this manner, a distance between the first fastening member 401 and the bottom surface of the first connection member 7 in the upward-downward direction may be adjusted by the first elongated hole 710 to allow a relative height between the bottom surface of the first connection member 7 and the bottom surface **200*b* of the window air conditioner 200 to be adjustable. That is, when the distance between the bottom surface 200*b* of the window air conditioner 200 and the windowsill 2006 in the upward-downward direction is changed, the bottom surface of the first connection member 7 may still be supported at the windowsill 2006, and connected to the window air conditioner 200 by the first fastening member 401, thereby effectively enhancing the applicability and universality of the connection assembly 400**.

In addition, the third connection member 9 is connected to the second connection member 8 via the first elongated hole 710. Therefore, the third connection member 9 may pass through the second connection member 8 via the first elongated hole 710 to connect the first connection member 7 to the second connection member 8. Since the first elongated hole 710 extends in the upward-downward direction, a connection position between the third connection member 9 and the first connection member 7 is adjustable in the extension direction of the first elongated hole 710. Therefore, a connection position between the second connection member 8 and the first connection member 7 is adjustable in the extension direction of the first elongated hole 710, thereby ensuring that the first connection member 7 is subjected to a reasonable force. For example, the third connection member 9 may be arranged close to the first fastening member 401, which is conducive to decreasing torque between the first fastening member 401 and the first connection member 7. Also, it is unnecessary to additionally form a connection hole connected to the second connection member 8 on the first connection member 7, which is conducive to simplifying processing steps of the first connection member 7.

Optionally, the first elongated hole 710 may be formed into an oblong hole, or a rectangular hole, etc.

Optionally, in the example illustrated in FIG. 42, the first elongated hole 710 is adapted to be arranged indoors to facilitate adjusting, by the operator from the indoor space, the connection position between the third connection member 9 and the first connection member 7, i.e., a connection position between the second connection member 8 and the first connection member 7 in the upward-downward direction. Of course, the first elongated hole 710 is not limited to being positioned in the indoor space.

In some embodiments, as illustrated in FIG. 38, FIG. 40, and FIG. 42, the second connection member 8 has a second elongated hole 810 formed therein. The second elongated hole 810 extends in the inside-outside direction. The third connection member 9 is connected to the first connection member 7 via the second elongated hole 810. Therefore, the third connection member 9 may pass through the first connection member 7 via the second elongated hole 810 to connect the second connection member 8 to the first connection member 7. Since the second elongated hole 810 extends in the inside-outside direction, a connection position between the third connection member 9 and the second connection member 8 is adjustable in an extension direction of the second elongated hole 810. Therefore, a connection position between the first connection member 7 and the second connection member 8 is adjustable in the extension direction of the second elongated hole 810.

Here, the second connection member 8 has an outer end for connecting with the mounting bracket 100, such that a relative distance between the third connection member 9 and the outer end of the second connection member 8 is adjustable in the inside-outside direction. Therefore, when the connection assembly 400 is connected between the window air conditioner 200 and the mounting bracket 100, the relative distance between the window air conditioner 200 and the mounting bracket 100 in the inside-outside direction is adjustable, such that the connection assembly 400 can be applied to window frames 2002, window air conditioners 200, and mounting brackets 100 of different sizes. For example, when the change in the size of the window air conditioner 200 leads to the change in the distance between the window air conditioner 200 and the mounting bracket 100 in the inside-outside direction, the connection assembly 400 may still realize the connection between the window air conditioner 200 and the mounting bracket 100, thereby effectively enhancing the applicability and generality of the connection assembly 400.

Optionally, the second elongated hole 810 may be formed into an oblong hole, or a rectangular hole, etc.

Optionally, in the example illustrated in FIG. 42, the second elongated hole 810 is adapted to be arranged indoors to facilitate adjusting, by the operator from the indoor space, the connection position between the third connection member 9 and the second connection member 8, i.e., a connection position between the second connection member 8 and the first connection member 7 in the inside-outside direction. Of course, the second elongated hole 810 is not limited to being positioned in the indoor space.

In some embodiments, as illustrated in FIG. 42, the first connection member 7 has the first elongated hole 710 extending in the upward-downward direction, and the second connection member 8 has the second elongated hole 810 extending in the inside-outside direction. The first fastening member 401 passes through the window air conditioner 200 via the first elongated hole 710 to connect the first connection member 7 to the window air conditioner 200. Also, the connection position between the first fastening member 401 and the first connection member 7 is adjustable in the extension direction of the first elongated hole 710. The outer end of the second connection member 8 is configured to be connected to the mounting bracket 100. The third connection member 9 is connected to the first connection member 7 and the second connection member 8 via the second elongated hole 810 and the first elongated hole 710, respectively. Therefore, the connection position between the third connection member 9 and the first connection member 7 is adjustable in the extension direction of the first elongated hole 710, and the connection position between the third connection member 9 and the second connection member 8 is adjustable in the extension direction of the second elongated hole 810. In this manner, the connection position between the first connection member 7 and the second connection member 8 can be adjustable in the extension direction of the first elongated hole 710, or can be adjustable in the extension direction of the second elongated hole 810.

Therefore, even if the relative height between the bottom surface of the first connection member 7 and the bottom surface 200*b* of the window air conditioner 200 in the upward-downward direction is changed, the connection assembly 400 can accommodate to such a change by adjusting the connection position between the first fastening member 401 and the first connection member 7. In addition, even if the distance between the window air conditioner 200 and the mounting bracket 100 in the inside-outside direction is changed, the connection assembly 400 can accommodate to such a change by adjusting the connection position between the third connection member 9 and the second connection member 8. The connection position between the third connection member 9 and the first connection member 7 can improve a load bearing of the first connection member 7 better.

Optionally, in the example illustrated in FIG. 42, both the first elongated hole 710 and the second elongated hole 810 are adapted to be arranged indoors, and the extension direction of the first elongated hole 710 is perpendicular to that of the second elongated hole 810, such that the connection positions between the second connection member 8 and the first connection member 7 in the upward-downward direction and in the inside-outside direction can be easily adjusted by the operator in the indoor space.

In some embodiments, as illustrated in FIG. 42, when the first connection member 7 is formed with the first elongated hole 710 extending in the upward-downward direction, the first connection member 7 includes a first plate member 71 extending in the upward-downward direction and a bottom support plate member 72. The first elongated hole 710 is formed in the first plate member 71 to facilitate an arrangement of the first elongated hole 710. Here, the first elongated hole 710 may pass through the first plate member 71 in a thickness direction of the first plate member 71. The bottom support plate member 72 is connected to a lower part of the first plate member 71. Both a bottom surface of the first plate member 71 and a bottom surface of the bottom support plate member 72 are configured to be supported at the windowsill 2006, thereby enhancing support stability of the first connection member 7.

It should be understood that in the above embodiments, since the first fastening member 401 passes through the window air conditioner 200 via the first elongated hole 710 to connect the first connection member 7 to the window air conditioner 200, the first plate member 71 may serve as an optional example of the third connection part 5 as described above. Of course, the third connection part 5 is not limited thereto. For example, in other embodiments of the present disclosure, the third connection part 5 may also be formed as a separate member. That is, the third connection part 5 may be a separate member of the connection assembly 400 or a part of a member of the connection assembly 400.

For example, in the example illustrated in FIG. 42, the first plate member 71 is arranged in the vertical direction, and thus the first plate member 71 has good bending resistance. The bottom support plate member 72 is also arranged in the vertical direction, and thus the bottom support plate member 72 also has good bending resistance. Such a manner facilitates a connection between the first plate member 71 and the bottom support plate member 72, and assists in ensuring vertical load-bearing capacities of the first plate member 71 and the bottom support plate member 72.

For example, as illustrated in FIG. 42 and FIG. 44, the bottom support plate member 72 further includes a second plate member 721 extending in the inside-outside direction. The second plate member 721 may be arranged in the upward-downward direction and connected to the first plate member 71. Here, the second plate member 721 being connected to an indoor side 71*a* and/or an outdoor side 71*b* of the first plate member 71 includes: 1) the second plate member 721 being connected to the indoor side 71*a* of the first plate member 71, in which case the second plate member 721 may be formed by a part of a side surface, which faces towards the indoor space, of the first plate member 71 extending in a direction facing away from the outdoor space; 2) the second plate member 721 being connected to the outdoor side 71*b* of the first plate member 71, in which case the second plate member 721 may be formed by a part of a side surface, which faces towards the outdoor space, of the first plate member 71 extending in a direction facing away from the indoor space, such that when the first connection member 7 is adapted to be arranged indoors, it is possible to prevent the first connection member 7 from occupying too much indoor space and saving an indoor space occupied by the window air conditioner assembly 100; and 3) the second plate member 721 is connected to the indoor side 71*a* and the outdoor side 71*b* of the first plate member 71, in which case two second plate members 721 may be provided, with one second plate member 721 connected to the indoor side 71*a* of the first plate member 71 and the other second plate member 721 connected to the outdoor side 71*b* of the first plate member 71.

It should be noted that "the indoor side 71*a* of the first plate member 71" refer to a side of the first plate member 71 facing towards the indoor space, rather than a side of the first plate member 71 located indoors. Similarly, "the outdoor side 71*b* of the first plate member 71" refer to a side of the first plate member 71 facing towards the outdoor space, rather than a side of the first plate member 71 located outdoors.

Therefore, each of the first plate member 71 and the second plate member 721 may be generally formed into an L-shape or T-shape, which improves lateral stiffness of the first connection member 7, thereby ensuring the overturning resistance performance of the window air conditioner 200.

In a further embodiment of the present disclosure, as illustrated in FIG. 42 and FIG. 44, the bottom support plate member 72 further includes a third plate member 722 extending from an end of the second plate member 721 facing away from the first plate member 71 in the transverse direction. Therefore, the third plate member 722 has a bottom surface configured to be supported at the windowsill 2006, thereby further enhancing the support stability of the first connection member 7.

For example, in the examples illustrated in FIG. 42 and FIG. 44, the first plate member 71 and the third plate member 722 are arranged at opposite ends of the second plate member 721, respectively, and the third plate member 722 extends in the transverse direction from the end of the second plate member 721 facing away from the first plate member 71. In this case, a transverse end of the third plate member 722 is connected to the end of the second plate member 721 facing away from the first plate member 71, such that each of the second plate member 721 and the third plate member 722 may be generally formed into an L-shape, thereby effectively improving the lateral stiffness of the first connection member 7, and ensuring the support stability of the first connection member 7. Further, it is possible to improve the overturning resistance performance of the window air conditioner 200, and allow the window air conditioner 200 to be stably supported at the windowsill 2006 by the first connection member 7.

Optionally, in the examples illustrated in FIG. 41 and FIG. 42, the first connection member 7 may be arranged at a transverse end of the window air conditioner 200, and the third plate member 722 may extend from the end of the second plate member 721 facing away from the first plate member 71 towards a transverse center of the window air conditioner 200 in the transverse direction, such that at least a part of the third plate member 722 may be located directly below the window air conditioner 200, thereby further enhancing the lateral stiffness of the first connection member 7, and ensuring the overturning resistance performance of the window air conditioner 200.

Of course, the third plate member 722 may also extend, from the end of the second plate member 721 facing away from the first plate member 71, away from the longitudinal center of the window air conditioner 200 in the transverse direction.

In some embodiments, as illustrated in FIG. 38 and FIG. 42, the third plate member 722 has a third elongated hole 7220 formed therein. The third elongated hole 7220 extends in the transverse direction. The third elongated hole 7220 may have a third fastening member provided thereon. The third fastening member may pass through the window frame 2002 or the windowsill 2006 via the third elongated hole 7220 to connect the third plate member 722 to the window frame 2002 or the wall body 2000, thereby further enhancing the support stability of the first connection member 7. In addition, a connection position between the third fastening member and the third plate member 722 is adjustable in an extension direction of the third elongated hole 7220, such that the connection assembly 400 is applicable to a situation where relative positions between the window air conditioner 200 and the mounting bracket 100 need to be adjusted in the transverse direction, thereby facilitating applications of the connection assembly 400 to window air conditioners 200 and mounting brackets 100 of different sizes.

Of course, the third elongated hole 7220 may have no third fastening member. In this case, the third plate member 722 may be placed only on the windowsill 2006 for support, and may also be applicable to the situation where the relative positions between the window air conditioner 200 and the mounting bracket 100 need to be adjusted in the transverse direction. For example, in the examples illustrated in FIG. 41 and FIG. 42, the third plate member 722 may be spaced apart from the window opening 2002 in the inside-outside direction, such that the first connection member 7 may be relatively far from the window frame 2002 in the inside-outside direction, thereby improve the overturning resistance performance of the window air conditioner 200.

In addition, the third plate member 722 may also have no third elongated hole 7220 to simplify fabrication steps of the third plate member 722.

Optionally, the third elongated hole 7220 may be formed as an oblong hole, or a rectangular hole, etc.

In some embodiments, as illustrated in FIG. 40, FIG. 42, FIG. 44, and FIG. 46, when the second connection member 8 is formed with the second elongated hole 810 extending in the inside-outside direction, the second connection member 8 includes a fourth plate member 81 extending in the inside-outside direction and a fifth plate member 82. The second elongated hole 810 is formed in the fourth plate member 81 to facilitate fabrication of the second elongated hole 810. The fifth plate member 82 is connected to an outer end of the fourth plate member 81, and extends in the transverse direction. The fifth plate member 82 is configured to be connected to the mounting bracket 100. Therefore, the fourth plate member 81 and the fifth plate member 82 may be formed into a substantially L-shaped structure or a T-shaped structure to facilitate a connection between the second connection member 8 and the mounting bracket 100.

It should be understood that in the above embodiments, the fifth plate member 82 may serve as an optional example of the fourth connection part 6 as described above. Of course, the fourth connection part 6 is not limited thereto. For example, in other embodiments of the present disclosure, the fourth connection part 6 may also be formed as a separate member. That is, the fourth connection part 6 may be a separate member of the connection assembly 400 or a part of a member of the connection assembly 400.

Figure 46:
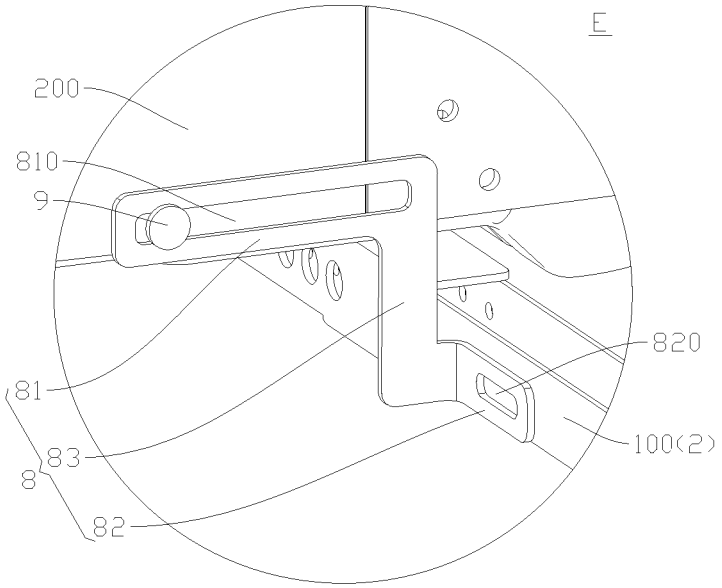
FIG. 46 is an enlarged view of part E circled in FIG. 45.

Optionally, in the examples illustrated in FIG. 42 and FIG. 46, the second connection member 8 is a one-piece member. For example, the second connection member 8 is substantially formed into an L-shaped structure. In addition, the entire second connection member 8 is bent and formed from a single plate to facilitate processing of the second connection member 8 and lower the costs.

Optionally, in the examples illustrated in FIG. 42 and FIG. 46, the second connection member 8 further includes a connection plate member 83 connected between the fourth plate member 81 and the fifth plate member 82. The connection plate member 83 is arranged in the vertical direction, and has an upper end connected to an upper side or a lower side of the outer end of the fourth plate member 81 and a lower end on a side facing towards the outdoor space connected to a transverse end of the fifth plate member 82. Such a manner is advantageous to improve vertical support stability of the second connection member 8.

Of course, the second connection member 8 may also include no connection plate member 83. In this case, the fifth plate member 82 may be directly connected to an end of the fourth plate member 81 facing towards the outdoor space, such that the second connection member 8 may be substantially formed into an L-shaped structure or a T-shaped structure.

Optionally, in the examples illustrated in FIG. 42 and FIG. 46, the second connection member 8 may be arranged at a transverse end of the window air conditioner 200. The fifth plate member 82 may extend in the transverse direction from the outer end of the fourth plate member 81 in a direction facing away from the transverse center of the window air conditioner 200. Thus, it is possible for at least a part of the fifth plate member 82 not to be positioned directly below the window air conditioner 200, such that at least a part of the fifth plate member 82 is located obliquely below the window air conditioner 200. Compared with the fifth plate member 82 being located directly below the window air conditioner 200, the at least part of the fifth plate member 82 being located obliquely below the window air conditioner 200 facilitates an exposure of at least a part of the fifth plate member 82 to the operation space, thereby easily connecting the fifth plate member 82 to the mounting bracket 100.

In some embodiments, as illustrated in FIGS. 42 and 46, the fifth plate member 82 has a fourth elongated hole 820 formed therein. The fourth elongated hole 820 extends in the transverse direction and adapted to be connected to the mounting bracket 100 by a second fastening member 402. Therefore, the second fastening member 402 may pass through the mounting bracket 100 via the fourth elongated hole 820 to connect the fifth plate member 82 to the mounting bracket 100. Since the fourth elongated hole 820 extends in the transverse direction, a connection position between the second fastening member 402 and the fifth plate member 82 is adjustable in an extension direction of the fourth elongated hole 820, such that the connection assembly 400 is applicable to a situation where relative positions between the window air conditioner 200 and the mounting bracket 100 need to be adjusted in the transverse direction, thereby facilitating applications of the connection assembly 400 to window air conditioners 200 and mounting brackets 100 of different sizes.

Optionally, the fourth elongated hole 820 may be formed as an oblong hole, or a rectangular hole, etc.

Optionally, in the example illustrated in FIG. 42, the third connection member 9 is a butterfly bolt 90, which facilitates a screwing operation of the operator and improves efficiency of the screwing operation. It should be understood that the butterfly bolt 90 facilitates frequent disassembly operations between the first connection member 7 and the second connection member 8 and maintenance of the connection assembly 400. In this case, the window air conditioner 200 and the mounting bracket 100 may be detachably connected to each other by the connection assembly 400, thereby facilitating flexible disassembly and mounting of the window air conditioner assembly 1000 and maintenance of the window air conditioner assembly 1000.

Of course, the third connection member 9 may also be other members capable of connecting the first connection member 7 to the second connection member 8, and is not limited to the butterfly bolt 90.

In some embodiments, as illustrated in FIG. 41, FIG. 43, and FIG. 45, the connection assembly 400 is adapted to be arranged indoors. Therefore, in a case where one connection assembly 400 is provided, the whole connection assembly 400 is adapted to be arranged indoors. In addition, in a case where a plurality of connection assemblies 400 are provided, each of the plurality of connection assemblies 400 is adapted to be arranged indoors. Of course, the connection assembly 400 is not limited to being positioned indoors.

It should be understood that in other embodiments of the present disclosure, the connection assembly 400 may also be configured to include the second connection member 8 and the third connection member 9 and not include the first connection member 7 (e.g., as illustrated in FIG. 45 and FIG. 46). In this case, the second connection member 8 is adapted to be connected to each of the mounting bracket 100 and the window air conditioner 200, and the third connection member 9 is adapted to be connected to the second connection member 8 and the window air conditioner 200 or adapted to be connected to the second connection member 8 and the mounting bracket 100.

Optionally, in the examples illustrated in FIG. 45 and FIG. 46, the second connection member 8 includes a fourth plate member 81 connected to the window air conditioner 200 and a fifth plate member 82 connected to the mounting bracket 100. The second elongated hole 810 extending in the inside-outside direction is formed in the fourth plate member 81. The third connection member 9 is adapted to be connected to the second connection member 8 and the window air conditioner 200 via the second elongated hole 810. Therefore, a connection position between the third connection member 9 and the second connection member 8 is adjustable in the extension direction of the second elongated hole 810 to allow a relative distance between the third connection member 9 and the fifth plate member 82 to be adjustable in the inside-outside direction, such that the connection assembly 400 can be applied to window frames 2002 and window air conditioners 200 of different sizes, thereby enhancing the applicability and universality of the connection assembly 400. Of course, the structure of the connection assembly 400 is not limited thereto.

In some embodiments, the connection assembly 400 of the window air conditioner assembly 1000 is adapted to be at least connected to the window air conditioner 200 and has a lower end provided with the bottom support part 10 that is supported at the windowsill 2006.

Here, the connection assembly 400 being adapted to be connected to at least the window air conditioner 200 and may include: 1) the connection assembly 400 being adapted to be connected to the window air conditioner 200 only; and 2) the connection assembly 400 being adapted to be connected to not only the window air conditioner 200, but also other members than the window air conditioner 200, e.g., the mounting bracket 100, etc.

As illustrated in FIG. 41 and FIG. 42, when the bottom support part 10 is supported at the windowsill 2006, the windowsill 2006 may exert a predetermined supporting force on the window air conditioner 200 via the bottom support part 10 to provide support between the window air conditioner 200 and the windowsill 2006. Therefore, it is possible to further enhance the overturning resistance performance of the window air conditioner 200, thereby further improving the safety and stability of the window air conditioner 200.

For example, in a case where the connection assembly 400 is adapted to be arranged indoors, the bottom support part 100 is adapted to be supported at the windowsill 2006 located indoors, thereby effectively improving the downward overturning resistance performance of the window air conditioner 200. If the window air conditioner 200 is pressed downwardly by a child in the indoor space, the connection assembly 400 may stably support the window air conditioner 200 to prevent the window air conditioner 200 from falling into the indoor space easily and hitting the child.

Therefore, with the connection assembly 400 as described above, it is beneficial to further improve the stability of the mounting of the window air conditioner 200, enhance the overturning resistance performance of the window air conditioner 100, and ensure the use safety of the window air conditioner 200.

In some embodiments, the connection assembly 400 is connected to the window air conditioner 200 only, and may be configured to include the first connection member 7 and the third connection member 9 as described above and not include the second connection member 8 as described above (such an embodiment is not illustrated in the figure). The first connection member 7 is adapted to be connected to the window air conditioner 200 by the third connection member 9. The bottom support part 10 may be formed at a lower end of the first connection member 7.

For example, when the connection assembly 400 includes the first connection member 7 and the third connection member 9 and does not include the second connection member 8, the first connection member 7 may have the first elongated hole 710 formed therein. The first elongated hole 710 may extend in the upward-downward direction and be located above the bottom support part 10. The third connection member 9 is adapted to be connected to the first connection member 7 and the window air conditioner 200 via the first elongated hole 710. The connection position between the third connection member 9 and the first connection member 7 is adjustable in the extension direction of the first elongated hole 710 to allow a relative height between the third connection member 9 and the bottom support part 10 to be adjustable in the upward-downward direction. Therefore, the connection assembly 400 can be applied to window frames 2002 and window air conditioners 200 of different sizes, thereby enhancing the applicability and universality of the connection assembly 400.

It should be understood that one or more connection assemblies 400 may be provided. In a case where a plurality of connection assemblies 400 are provided, the plurality of connection assemblies 400 may be spaced apart from each other in the transverse direction. For example, in the example illustrated in FIG. 37, two connection assemblies 400 are provided. The two connection assemblies 400 are arranged at both ends of the window air conditioner 200 in the transverse direction, respectively. Of course, a position of the connection assembly 400 is not limited to any one of these examples. Three or more connection assemblies 400 may also be provided.

In some embodiments, as illustrated in FIG. 38 and FIG. 42, the connection assembly 400 is configured such that the relative height between the bottom support part 10 and the bottom surface **200*b* of the window air conditioner 200 is adjustable. In this case, the connection assembly 400 is configured such that a distance between the bottom support part 10 and the bottom surface 200*b* of the window air conditioner 200 is adjustable in the upward-downward direction, and thus the connection assembly 400 can be applied to window frames 2002 and window air conditioners 200 of different sizes. For example, when a change in a size of the window frame 2002 leads to a change in a distance between the bottom surface 200*b* of the window air conditioner 200 and the windowsill 2006 in the upward-downward direction, the bottom support part 10 of the connection assembly 400 may still be supported at the windowsill 2006, such that the windowsill 2006 may exert an appropriate supporting force on the window air conditioner 200 by the bottom support part 10, thereby effectively enhancing applicability and universality of the connection assembly 400**.

It should be understood that when the relative height between the bottom support part 10 and the bottom surface **200*b* of the window air conditioner 200 is adjustable, the connection assembly 400 may include the first connection member 7 and the third connection member 9 as described above, and does not include the second connection member 8 as described above (not illustrated). The first connection member 7 is adapted to be connected to the window air conditioner 200 by the third connection member 9. The bottom support part 10 may be formed at the lower end of the first connection member 7. The first elongated hole 710** is formed in the first connection member 7. The third connection member 9 passes through the first elongated hole 710 and is connected to the window air conditioner 200. In this manner, the first connection member 7 is connected to the window air conditioner 200, and the connection position between the third connection member 9 and the first connection member 7 is adjustable in the extension direction of the first elongated hole 710 to allow the relative height between the bottom support part 10 and the bottom surface 200*b* of the window air conditioner 200 to be adjustable. Alternatively, the connection assembly 400 may further include the first connection member 7, the second connection member 8, and the third connection member 9 as described above. The bottom support part 10 may be formed at the lower end of the first connection member 7. The third connection member 9 is connected to the first connection member 7 and the second connection member 8. Likewise, such a manner may also realize an adjustment of the relative height between the bottom support part 10 and the bottom surface 200*b* of the window air conditioner 200.

In some embodiments, the connection assembly 400 is also connected to the mounting bracket 100 to further ensure stability of the connection between the window air conditioner 200 and the mounting bracket 100. The connection assembly 400 includes the third connection part 5 connected to the window air conditioner 200 and the fourth connection part 6 connected to the mounting bracket 100. The connection assembly 400 is configured such that the relative distance between the third connection part 5 and the fourth connection part 6 is adjustable in the direction from the indoor space to the outdoor space. In this manner, the connection assembly 400 can be applied to window frames 2002 and window air conditioners 200 of different sizes, such that the applicability and universality of the connection assembly 400 can be effectively enhanced. Therefore, it is possible for the connection assembly 400 to better satisfy differentiated requirements.

For example, in the examples illustrated in FIG. 38 and FIG. 42, the third connection part 5 is connected to the window air conditioner 200, such that the relative distance between the third connection part 5 and the window air conditioner 200 in the inside-outside direction may always be constant. The fourth connection part 6 is connected to the mounting bracket 100, such that the relative distance between the fourth connection part 6 and the mounting bracket 100 in the inside-outside direction may always be constant. Since the connection assembly 400 is configured such that the relative distance between the third connection part 5 and the fourth connection part 6 is adjustable in the inside-outside direction, the connection assembly 400 is configured such that the relative distance between the window air conditioner 200 and the mounting bracket 100 is adjustable in the inside-outside direction. Therefore, the connection assembly 400 may be applied to the window frames 2002, window air conditioners 200, and mounting brackets 100 of different sizes. For example, when a change in the size of the window air conditioner 200 leads to a change in the distance between the window air conditioner 200 and the mounting bracket 100 in the inside-outside direction, the connection assembly 400 may still realize the connection between the window air conditioner 200 and the mounting bracket 100, thereby effectively enhancing the applicability and universality of the connection assembly 400.

In some embodiments, as illustrated in FIG. 41, FIG. 43, and FIG. 45, the connection assembly 400 is adapted to be arranged indoors. Therefore, in a case where one connection assembly 400 is provided, the entire connection assembly 400 is adapted to be arranged indoors. In addition, in a case where a plurality of connection assembly 400 are provided, each of the plurality of connection assemblies 400 is adapted to be arranged indoors. Of course, the connection assembly 400 is not limited to being positioned indoors.

In the description of the present disclosure, it should be understood that the orientation or position relationship indicated by the terms "center," "longitudinal," "transverse," "length," "width," "thickness," "upper," "lower," "front," "rear," "left," "right," "vertical," "horizontal," "top," "bottom," "inner," "outer," etc., is based on the orientation or position relationship shown in the drawings, and is only for the convenience of describing the present disclosure and simplifying the description, rather than indicating or implying that the associated device or element must have a specific orientation or must be constructed and operated in a specific orientation. Thus, the orientation or position relationship indicated by these terms cannot be understood as limitations on the present disclosure.

In addition, the terms "first" and "second" are only used for purpose of description, and should not be understood as indicating or implying relative importance or implicitly indicating the number of indicated technical features. Therefore, the features associated with the terms "first" and "second" may explicitly or implicitly include at least one of the features.

In the description of the present disclosure, unless otherwise clearly specified and defined, terms such as "install," "mount," "connect to," "connected with," "fixed to" and the like should be understood in a broad sense. For example, it may be a fixed connection or a detachable connection or integral connection; mechanical connection or electrical connection or mutual communication; direct connection or indirect connection by an intermediate; internal communication of two components or an interaction relationship between two components. For those of ordinary skill in the art, the specific meaning of the above-mentioned terms in the present disclosure can be understood according to specific circumstances.

In the present disclosure, unless expressly specified and defined otherwise, the first feature being "on" or "under" the second feature may indicate that the first feature is in direct contact with the second feature, or the first and second features are in contact with each other via an intermediate medium. Moreover, the first feature being "above" the second feature may indicate that the first feature is directly above or obliquely above the second feature, or simply indicate that a level of the first feature is higher than that of the second feature. The first feature being "below" the second feature may indicate that the first feature is directly below or obliquely below the second feature, or merely indicate that a level of the first feature is less than that of the second feature.

In the description of this specification, descriptions with reference to the terms "an embodiment," "some embodiments," "an example," "a specific example," "some examples," etc., mean that specific features, structure, materials, or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics may be combined in any one or more embodiments or examples in a suitable manner. In addition, different embodiments or examples and features of different embodiments or examples described in the specification may be combined by those skilled in the art without mutual contradiction.

Although embodiments of the present disclosure have been illustrated and described, it is conceivable for those skilled in the art that various changes, modifications, replacements, and variations can be made to these embodiments without departing from the principles and spirit of the present disclosure. The scope of the present disclosure shall be formed by the claims as appended and their equivalents.

What is claimed is:

1. A mounting bracket comprising:

a support frame extending in an inside-outside direction and including an outdoor part configured to be arranged outdoors, the support frame including:

a support plate extending in the inside-outside direction and configured to support a bottom of a window air conditioner; and a mounting plate connected below a transverse side of the support plate, the mounting plate including a flange provided at a lower end of the mounting plate, and the flange being bent in the transverse direction;

a support leg configured to be arranged outdoors, an upper end of the support leg being connected to the outdoor part of the support frame and a lower end of the support leg being configured to directly or indirectly abut against an outer wall surface of a wall body;

wherein:

the outdoor part of the support frame includes a first limiting structure, the first limiting structure including a limiting groove extending in the inside-outside direction, wherein the limiting groove has an opening on one transverse side of the limiting groove and a side wall on another transverse side of the limiting groove;

the support leg includes a second limiting structure provided at the upper end of the support leg, wherein the second limiting structure is assembled in the limiting groove through the opening, and includes an upper limiting member abutting against a top wall of the limiting groove and a lower limiting member abutting against a bottom wall of the limiting groove;

the second limiting structure is in a limiting fit with the first limiting structure to limit a maximum included angle between the support leg and the support frame facing towards an indoor side so as to prevent a rotation angle of the support leg relative to the support frame in a direction facing away from the wall body from exceeding the maximum included angle; and the support plate forms the top wall of the limiting groove, the mounting plate forms the side wall of the limiting groove, and the flange forms the bottom wall of the limiting groove.

2. The mounting bracket according to claim 1, wherein the support leg includes a leg side plate, and the lower limiting member is arranged at an upper end of the leg side plate and located at a side of the leg side plate close to an indoor space.

3. The mounting bracket according to claim 2, wherein:

the lower limiting member extends towards the side wall of the limiting groove in the transverse direction; or the upper limiting member includes:

a support surface that is a top surface of the leg side plate; and an extension member extending from the upper end of the leg side plate towards the side of the leg side plate close to the indoor space.

4. The mounting bracket according to claim 2, wherein:

a first connection hole is formed in the upper end of the leg side plate;

a plurality of second connection holes are formed in the side wall of the limiting groove and are spaced apart from each other in the inside-outside direction; and the first connection hole is configured to be fixedly connected to one of the plurality of second connection holes by a connection member.

5. The mounting bracket according to claim 1, further comprising:

a support foot configured to be arranged outdoors and connected to a lower end of the support leg, the support foot including:

a body mounted at the support leg; and a cladding wrapping around the body;

wherein:

the support foot is configured to abut against the outer wall surface of the wall body with the cladding; and the body is in a positioning fit with the cladding via a positioning structure including a positioning hole and a positioning protrusion engaged with the positioning hole.

6. The mounting bracket according to claim 5, wherein a connection hole is formed at the body and a connection member is configured to pass through the connection hole and the cladding to be fixed at the outer wall surface of the wall body; or wherein:

the body includes:

a panel member; and a side plate member located at a transverse side of the panel member and connected to the support leg; and the cladding includes:

an end surface part covering one side of the panel member in a thickness direction of the panel member;

an upper flange part connected to a longitudinal upper end of the end surface part and bent towards another side of the panel member in the thickness direction of the panel member; and a lower flange part connected to a longitudinal lower end of the end surface part and bent towards the other side of the panel member in the thickness direction of the panel member.

7. A mounting bracket comprising:

a support unit including a support frame extending in an inside-outside direction, the support frame including an outdoor part configured to be arranged outdoors, the support frame including a first connection part at an outdoor end part of the support frame, and the first connection part extending in a vertical direction; and a connection unit configured to be arranged outdoors and connected to the support unit, the connection unit including:

a connection rod extending in a transverse direction; and a second connection part arranged at the connection rod and connected to the first connection part, the second connection part including:

a mounting structure configured to be fixedly connected to the first connection part via a connection member; and a shielding structure connected to the mounting structure and configured to shield at least one of an upper side or a transverse side of the connection member.

8. The mounting bracket according to claim 7, wherein the mounting structure includes a mounting plate extending in the vertical direction, the mounting plate being located at a side of the first connection part close to an indoor space and configured to be fixedly connected to the first connection part by the connection member.

9. The mounting bracket according to claim 8, wherein the shielding structure includes:

a first visor plate connected to an upper edge of the mounting plate and located above the first connection part; and a second visor plate connected to an edge on a transverse side of the mounting plate and located at a transverse side of the first connection part.

10. The mounting bracket according to claim 8, wherein the first connection part extends upwardly from the outdoor end part of the support frame, the second connection part is located above the support frame, and the connection rod is located at a side of the second connection part close to the indoor space.

11. The mounting bracket according to claim 10, wherein the connection rod includes:

a top plate supported at the support frame;

a side plate connected below the top plate and located at a transverse side of the support unit; and a reinforcement plate located adjacent the support frame.

12. The mounting bracket according to claim 7, wherein the support unit is configured to pass through a window opening in the inside-outside direction, and the outdoor part of the support unit is configured to abut against an outer wall surface of a wall body;

the mounting bracket further comprising:

a positioning unit configured to be arranged indoors and connected to an indoor part of the support unit, the positioning unit being configured to be in a positioning fit with at least one of a window opening or a window frame, and the positioning unit including:

a main frame extending in the transverse direction; and a plurality of sub-frames each extending in the transverse direction and being configured to cooperate with the main frame in a withdrawable manner in the transverse direction to adjust a transverse length of the positioning unit, the plurality of sub-frames being configured to cooperate with the main frame in a replaceable manner, and at least two of the plurality of sub-frames having different transverse lengths.

13. The mounting bracket according to claim 12, wherein:

each of the plurality of sub-frames includes a frame rod extending in the transverse direction and a stop rod extending in the vertical direction, the stop rod being arranged at a transverse end of the frame rod; and the stop rod includes:

two stop plates extending in the transverse direction and spaced apart from each other in the inside-outside direction; and a connection plate extending in the inside-outside direction and connected to the two stop plates.

14. The mounting bracket according to claim 13, wherein:

the connection plate has a first connection hole extending in the transverse direction; and the frame rod has at least one of:

a plurality of second connection holes extending in the vertical direction and spaced apart from each other in the transverse direction; or a plurality of third connection holes extending in the inside-outside direction and spaced apart from each other in the transverse direction.

15. The mounting bracket according to claim 13, wherein:

the main frame has a sliding groove extending in the transverse direction and being opened at two transverse ends of the sliding groove;

the frame rod is introduced into the sliding groove and is withdrawable relative to the main frame in the transverse direction; and the stop rod is stopped outside the sliding groove.

16. The mounting bracket according to claim 13, wherein:

the connection member is a first connection member;

a cross section of the main frame is ⊏-shaped;

a plurality of first positioning holes are formed in an indoor side wall surface of the main frame and spaced apart from each other in the transverse direction; and the frame rod has a second positioning hole formed in each of an indoor side wall surface and an outdoor side wall surface thereof, the second positioning hole being configured to be fixedly connected to one of the plurality of first positioning holes via a second connection member.

17. A window air conditioner assembly comprising:

a window air conditioner;

a mounting bracket configured to be mounted at a window opening in a wall body and support the window air conditioner, the mounting bracket including:

a support unit including a support frame extending in an inside-outside direction, the support frame including an outdoor part configured to be arranged outdoors, the support frame including a first connection part at an outdoor end part of the support frame, and the first connection part extending in a vertical direction; and a connection unit configured to be arranged outdoors and connected to the support unit, the connection unit including:

a connection rod extending in a transverse direction; and a second connection part arranged at the connection rod and connected to the first connection part, the second connection part including:

a mounting structure configured to be fixedly connected to the first connection part via a connection member; and a shielding structure connected to the mounting structure and configured to shield at least one of an upper side or a transverse side of the connection member; and a connection assembly configured to connect the mounting bracket and the window air conditioner.

18. The window air conditioner assembly according to claim 17, wherein:

the connection assembly includes a bottom support part provided at a lower end of the connection assembly, the bottom support part being configured support a windowsill; and the connection assembly is configured such that a relative height between the bottom support part and a bottom surface of the window air conditioner is adjustable.

19. The window air conditioner assembly according to claim 17, wherein:

the connection assembly includes a third connection part configured to be connected to the window air conditioner and a fourth connection part configured to be connected to the mounting bracket; and the connection assembly is configured such that a relative distance between the third connection part and the fourth connection part in a direction from an indoor space to an outdoor space is adjustable.

20. The window air conditioner assembly according to claim 17, wherein the connection assembly includes a first connection member configured to be connected to the window air conditioner, a second connection member configured to be connected to the mounting bracket, and a third connection member configured to connect the first connection member and the second connection member; and wherein:

the first connection member has a first elongated hole extending in an upward-downward direction and configured to be connected to the window air conditioner via a first fastening member, and the third connection member is connected to the second connection member through the first elongated hole, and the first connection member has a bottom surface configured to be supported at the windowsill; and/or the second connection member has a second elongated hole and an outer end configured to be connected to the mounting bracket, the second elongated hole extending in the inside-outside direction, and the third connection member is connected to the first connection member through the second elongated hole.

21. The window air conditioner assembly according to claim 20, wherein:

the first connection member has the first elongated hole;

the first connection member includes a plate member extending in the upward-downward direction and a bottom support plate member connected to a lower part of the plate member;

the first elongated hole is formed in the plate member; and each of a bottom surface of the first plate member and a bottom surface of the bottom support plate member is configured to be supported at the windowsill.

22. The window air conditioner assembly according to claim 21, wherein:

the plate member is a first plate member; and the bottom support plate member includes:

a second plate member extending in the inside-outside direction and connected to at least one of an indoor side or an outdoor side of the first plate member; and a third plate member extending from an end of the second plate member facing away from the first plate member in the transverse direction, the third plate member having a third elongated hole extending in the transverse direction.

23. The window air conditioner assembly according to claim 20, wherein:

the second connection member has the second elongated hole;

the second connection member includes:

a first plate member extending in the inside-outside direction; and a second plate member connected to an outer end of the first plate member and extending in the transverse direction, and configured to be connected to the mounting bracket;

the second elongated hole is formed in the first plate member; and the second plate member has a third elongated hole extending in the transverse direction and configured to be connected to the mounting bracket via a fastening member.

* * * * *